US011413679B2

(12) United States Patent
Matzen et al.

(10) Patent No.: US 11,413,679 B2
(45) Date of Patent: Aug. 16, 2022

(54) LONG-LIFE DIE FOR THE MANUFACTURING OF ELONGATE BODIES

(71) Applicant: Enkotec A/S, Skanderborg (DK)

(72) Inventors: Claus Peter Matzen, Silkeborg (DK); Kenn Christian Prinds, Egtved (DK)

(73) Assignee: Enkotec A/S, Skanderborg (DK)

( * ) Notice: Subject to any disclaimer, the term of this patent is extended or adjusted under 35 U.S.C. 154(b) by 0 days.

(21) Appl. No.: 17/524,444

(22) Filed: Nov. 11, 2021

(65) Prior Publication Data

US 2022/0062971 A1 Mar. 3, 2022

Related U.S. Application Data

(63) Continuation-in-part of application No. 17/154,235, filed on Jan. 21, 2021, now Pat. No. 11,207,726, and
(Continued)

(51) Int. Cl.
*B21J 13/02* (2006.01)
*B21G 3/16* (2006.01)
(Continued)

(52) U.S. Cl.
CPC ..... *B21J 13/025* (2013.01); *B21G 3/16* (2013.01); *B21G 3/28* (2013.01); *B21G 3/30* (2013.01); *B21G 3/32* (2013.01); *B21J 13/02* (2013.01)

(58) Field of Classification Search
CPC ... B21G 3/16; B21G 3/18; B21G 3/28; B21G 3/12; B21G 3/32; B21J 13/02; B21J 13/025
See application file for complete search history.

(56) References Cited

U.S. PATENT DOCUMENTS 3,359,582 A * 12/1967 Powers ..... B21G 3/32 470/193
3,965,716 A 6/1976 Suzuki et al.
(Continued)

FOREIGN PATENT DOCUMENTS

EE 01325 11/2015
EE 201500028 4/2017
(Continued)

OTHER PUBLICATIONS

Charvet, Pierre, International Search Report and Written Opinion issued in Europe for PCT/EP2019/073650; dated Nov. 25, 2019; 18 pages.
(Continued)

*Primary Examiner* — Adam J Eiseman
*Assistant Examiner* — Bobby Yeonjin Kim
(74) *Attorney, Agent, or Firm* — Ulmer & Berne LLP

(57) ABSTRACT

A die holder mounts a die to form heads on nails or screws. A top surface of the die includes a groove for longitudinally receiving and holding an elongate body. The die has a recess merging into the groove at one end of the groove to form a nail or screw head. The die is conical for press fit by contact with an inner surface of a bore or hole in the die holder. A top surface of the die is planar to a top surface of the die holder with a bottom surface engaging bottom part of the die holder. The bottom portion of the die has a recess or engaging with a corresponding protrusion die holder fixing an angular orientation of the groove relative to the die holder. Two opposite dies are brought together by two opposite die holders forming the head.

12 Claims, 36 Drawing Sheets

Related U.S. Application Data a continuation-in-part of application No. PCT/EP2021/073975, filed on Aug. 31, 2020, said application No. 17/154,235 is a continuation of application No. 16/778,670, filed on Jan. 31, 2020, now Pat. No. 10,906,087, which is a continuation of application No. PCT/EP2019/073650, filed on Sep. 5, 2019.

(51) Int. Cl.

| | |
|---|---|
| ***B21G 3/28*** | (2006.01) |
| ***B21G 3/32*** | (2006.01) |
| ***B21G 3/30*** | (2006.01) |

(56) References Cited

U.S. PATENT DOCUMENTS

| | | | | |
|---|---|---|---|---|
| 6,477,883 | B2 * | 11/2002 | Liu | B21D 19/08 72/344 |
| 6,508,715 | B1 * | 1/2003 | Jensen | B21G 3/12 470/121 |
| 6,520,860 | B1 * | 2/2003 | Jensen | B21G 3/12 470/121 |
| 6,676,528 | B1 * | 1/2004 | Carlsen | B21G 3/12 470/34 |
| 6,780,116 | B2 * | 8/2004 | Hurst | B21G 3/00 470/195 |
| 6,786,828 | B2 * | 9/2004 | Sørensen | B21G 3/28 72/482.3 |
| 7,004,846 | B2 * | 2/2006 | Hurst | B21G 3/00 470/195 |
| 7,090,585 | B2 * | 8/2006 | Forrester | B21G 3/20 470/146 |
| 8,920,094 | B2 * | 12/2014 | Ali | B21G 3/12 411/923 |
| 8,998,733 | B2 * | 4/2015 | Kim | B21G 3/20 470/110 |
| 10,906,087 | B1 * | 2/2021 | Matzen | B21J 13/025 |
| D921,721 | S | 6/2021 | Matzen | |
| 2003/0032489 | A1 * | 2/2003 | Hurst | B21G 3/28 470/195 |
| 2004/0235578 | A1 * | 11/2004 | Jensen | B21G 3/00 470/129 |
| 2010/0130295 | A1 * | 5/2010 | Yao | B21G 3/32 470/121 |

FOREIGN PATENT DOCUMENTS

| | | | | |
|---|---|---|---|---|
| EE | 05812 | B1 | 11/2018 | |
| GB | 252195 | A * | 5/1925 | B21J 13/02 |
| GB | 252195 | | 5/1927 | |
| GB | 252195 | A | 5/1927 | |
| KR | 102255937 | B1 | 5/2021 | |
| WO | WO0037195 | | 6/2000 | |
| WO | WO2009052538 | | 4/2009 | |
| WO | 2020088823 | A1 | 5/2020 | |

OTHER PUBLICATIONS

Charvet, Pierre, Extended European Search Report, including the Annex to the Search Report, and the European Search Opinion: Patent Application No. EP18203697; dated Apr. 4, 2019; 7 pages.

Charvet, Pierre; International Search Report and Written Opinion of the International Searching Authority, issued in International Application No. PCT/EP2021/073975; dated May 24, 2022; 6 pages.

* cited by examiner

LONG-LIFE DIE FOR THE MANUFACTURING OF ELONGATE BODIES

CROSS-REFERENCE TO RELATED APPLICATIONS

This patent application is a continuation-in-part of U.S. patent application Ser. No. 17/154,235 filed on Jan. 21, 2021, which was a continuation of U.S. patent application Ser. No. 16/778,670 filed on Jan. 31, 2020 (now U.S. Pat. No. 10,906,087), which was a continuation of PCT/EP2019/073650 filed on Sep. 5, 2019. This patent application is also a continuation-in-part of PCT/EP2021/073975 filed on Aug. 31, 2020, the disclosures of which are hereby incorporated by reference herein in their entirety and made part of the present U.S. utility patent application for all purposes.

TECHNICAL FIELD

The subject application relates to a new design of tooling, specifically a die and die ring, for production of elongate bodies, such as nails or screws in a wire-fed nail machine.

BACKGROUND

In an existing nail-machine one of the main-issues is the wear and related replacement of dies for production of said nails, especially forming the head on the nail. The machine is continuously fed with a raw material, a wire, which is shaped into nails through pressure from a stamping, rolling or roll forming process which includes two corresponding dies.

In some nail-machines, the dies are fixated, with thread based fastening means, to a rotating ring tool within the nail-machine, the dies arranged around the ring tool. Replacing the dies on a regular basis is a labour intensive task where several fastening elements are involved to fasten each die. Furthermore, tolerances of each of the fastening elements involved in fastening of the die tend to degrade position precision of the die in the die holder, and thus in the end reduce the quality of the nails as well as introducing wear. An example of such nail producing machine can be seen e.g. in EP 1 631 400 B1.

Hence, an improved die for the manufacturing of elongate bodies would be advantageous, and in particular a more efficient and/or reliable method of replacing the dies would be advantageous.

SUMMARY

The subject application provides a die for the manufacturing of elongate bodies that solves the above mentioned problems of existing technology with simplified replacement of dies within the die holder, such as a tool ring, reducing down-time and increasing yield from a nail-machine. At the same time, it is preferred that the die is precisely positioned in the die holder.

Thus, the above described technology includes a first aspect of the subject application by providing a die for mounting in an associated die holder for the production of heads on elongate bodies, such as a metal nail or screw, the die comprising:

a body with a top surface provided with a through-going groove, such as with gripping marks, for receiving and holding an elongate body longitudinally in said groove, a recess at one end of the groove suitable for forming the head on the elongate body, a side surface shaped for press fit by contact with an inner surface of a bore or hole in the associated die holder, a bottom stop surface for engaging with a stop part in the hole or bore of the associated die holder, so as to determine a height of the die in relation to the associated die holder, e.g. a height of the groove relative to a surface of the die holder, and a recess or protrusion serving to engage with a corresponding protrusion or recess of the associated die holder, in order to fix angular orientation of the groove relative to the die holder.

In the context of the subject application, 'die' is to be understood as a tool or device for imparting a desired shape, form, or finish to a material or for impressing an object or material, such as shaping the head on a nail or screw from a metal wire.

In the context of the subject application, 'recess' is to be understood as a depression into part of a surface, such as, but not limited to, a cleft, cut or cavity. In the context of the recess for forming the head on the elongate body, the recess can be a combination of a cut out for forming a surface, e.g. a plane surface, suitable for forming the head by applying pressure on the end of the elongate body when being held by the groove. Further, the recess may comprise specific features for forming a specific head shape on the elongate body, e.g. a chamfer and/or a round etc.

In the context of the subject application, 'head' is to be understood as the uppermost extremity or projecting part of an object.

In the most example embodiments, the groove is perpendicular or substantially perpendicular to a central longitudinal axis through the body between top surface and bottom part of the body of the die. Preferably, the groove is perpendicular to the central longitudinal axis through the body. Especially, a small offset angle of such as 0.1° may be preferred, and thus most preferably, the groove forms an angle of 89.8°-90.2° with the central longitudinal axis through the body of the die.

In an embodiment of the subject application, the recess or protrusion serving to fix angular orientation is shaped so as to guide the die into the corresponding protrusion or recess of the associated die holder. This will reduce the time spend on aligning the die surface in respect to the direction from which the wire is fed into the groove.

In an embodiment of the subject application, the elongate body is processed into rivets.

In an embodiment of the subject application, the elongate body is processed into spokes, such as, but not limited to, spokes for a bicycle.

In an embodiment of the subject application, the wire to be fed into the machine is smooth.

In an embodiment of the subject application, the wire to be fed into the machine is profiled, such as a round, square or spline profile.

In an embodiment of the subject application, the die has a cylindrical shape, which could improve the durability of the die, as sharp edges are usually the weakest point, most prone to chipping, when using alloy-steels suitable for tools. In general, the die can be formed by a variety of material including metals as well as non-metals.

In the context of the subject application, 'alloy steels' is to be understood as steels that are well-suited to be made into tools. Alloying elements such as, but not limited to Tungsten, Chromium, Vanadium or Molybdenum are added, forming carbides in the steel, to increase the hardness, corrosion and heat resistance, abrasiveness and deformation of the steel.

In an embodiment of the subject application, at least a part of the die could be made from cement carbide, or a ceramic, such as Oxide ceramics with e.g. Zirconia additives, Mixed ceramics with e.g. carbides or Silicon nitride ceramics and SiAlON grade ceramics. Ceramics have excellent wear resistance which could improve the durability of the die or the die holder.

In an embodiment of the subject application, at least a part of the body of the die is tapered improving the fixation of the die within the die holder. In example embodiments, the tapered part of the body of the die, or the entire body of the die, has a circular cross section. It is to be understood that the circular cross section may likewise be slightly elliptic or lightly oval.

In an embodiment of the subject application at least a part of the body of the die has a conical shape, such as wherein a side surface of said part of the body providing an angle of 0.1°-3°, such as 0.5°-2.5°, such as 1.0°-2.0°, with a central axis of the body.

In an embodiment of the subject application, the die has at least one recess forming a shoulder, preferably with a chamfer, for guiding the die into an associated die holder, wherein the recess has a corresponding protrusion within said die holder, in order to fix angular orientation of the groove relative to the die holder.

In an embodiment of the subject application, the die has a stop surface with at least one surface on a lower part of the body of the die for engaging with a bottom surface or lower shoulder surface in the hole or bore of the associated die holder.

In an embodiment of the subject application, the top surface of the die and the surface part of the die holder are to be substantially plane in respect to each other when the stop surface of the die is abutting said bottom surface or lower shoulder surface of the die holder.

In an embodiment of the subject application, the die has one or more holes or bores in the bottom surface and the die holder has one or more pins corresponding to said holes or bores, the pins engaging with the holes or bores, in order to fix angular orientation of the groove relative to the die holder.

In an embodiment of the subject application, the stop surface of said die has an inclined groove so as to ease the extraction or ejection of said die when seated in an associated die holder, when applying pressure with an elongate tool, such as a pin, preferably with a inclined tip corresponding to the inclination of the groove thereby driving the die out of the associated die holder without damaging said die holder or elongate tool.

In an embodiment of the subject application, the inclined groove on the stop surface of the die has an angle between 1° to 40°, such as between 2° to 30°, such as 5° to 20° or such as 8° to 15°, relative to the stop surface of the die, wherein the angle reduces the pressure needed to extract said die from an associated die holder.

In the context of the subject application, inclined groove is to be understood as a narrow cut or low area in a surface angled from one area in said surface to another area in said surface and wherein the groove varies in depth, relative to said surface from one end of the groove to the opposite end of the groove.

In an embodiment of the subject application, the bottom surface of the die has an inclined groove so as to ease the extraction or ejection of said die when seated in an associated die holder, when applying pressure with an elongate tool, such as a pin, preferably with a inclined tip corresponding to the inclination of the groove thereby driving the die out of the associated die holder without damaging said die holder or tool.

In some embodiments of the die, the stop surface and the bottom surface are one and the same. In some embodiments, the stop surface may be a recess cut into the body of the die at a position above the bottom surface.

In an embodiment of the subject application, the inclined groove on the bottom or stop surface of the die has a width (W) and the die has an outer diameter (D), and where a ratio (W/D) between said width and said outer diameter is between 0.01 and 1, more preferably between 0.1 and 0.5 as these ratios are ideal for the production of dies from steel, such as from tool grade steel or other hard alloys, especially such as a hard metal, e.g. tungsten carbide, or other hard materials suitable for the production of elongate bodies, such as a nail or screw.

In another embodiment of the subject application, the inclined groove has at least a plane surface part so as to reduce friction between an elongate tool and the plane surface, thereby easing the ejection of the die from die holder, when said die is firmly seated in said die holder.

In an embodiment of the subject application, the groove is a plane surface being parallel with an axis perpendicular to a central axis of the die, so as to ease the insertion of an elongate tool for the ejection of the die from die holder, when said die is firmly seated in said die holder.

In an embodiment of the subject application, the plane surface has an inclination angle of 0.5° to 50°, such as 1° to 40° or such as 2° to 20° relative to the stop surface or bottom surface of the die.

In an embodiment of the subject application, the inclined groove has at least a curved surface part.

In an embodiment of the subject application, the outer diameter (D) of the die and an overall height (H) of the die has a ratio (D/H) between 0.1 and 5 or more preferably between 0.5 and 2.0 to optimize manufacturing costs of the die and an associated die holder, such as a tool ring.

In a second aspect, the subject application relates to an elongate tool comprising a tip shaped to match the groove of the die according to the first aspect of the subject application, wherein the elongate tool is arranged to remove the die from an associated die holder.

In the context of the subject application, it is to be understood that the elongate tool may be used as a wedge, wherein the tip of said elongate tool is wedged between a bottom surface of the die and the bottom surface of the associated die holder, so as to apply a pressure for pushing the die upwards and out of the bore or hole in the die holder.

In an embodiment of the subject application, the tip on the elongate tool has an inclined flat surface arranged for engagement with an inclined flat surface of the inclined groove of the die, so as to ease the ejection of said die seated in an associated die holder.

In a third aspect, the subject application relates to a die holder comprising:

a body having at least a top surface part, a plurality of holes or bores in the top surface part, wherein each of the plurality of holes or bores has an inner surface shaped for receiving a die and for press fit by contact with the side surface of the die, a stop part located in the hole or bore for engaging with a stop surface of the die when being pressed into the hole or bore, so as to fix a height of a top surface of the die in relation to the top surface part of the die holder, and a protrusion or recess serving to engage with a corresponding recess or protrusion of the die, in order to fix angular orientation of the die relative to the die holder.

This aspect of the subject application is particularly, but not exclusively, advantageous in that the die holder according to the subject application may be implemented by insertion in an older, less advanced machine, such as a nail manufacturing machine, as an upgrade kit. The subject application is advantageous for new nail or screw manufacturing machines, as well as existing machines which can be modified or updated to include a die holder with dies according to the first aspect of the subject application.

In an embodiment of the subject application, the top surface part of the die holder is ring-shaped, and the plurality of holes or bores are evenly distributed on the ring-shaped top surface part so as to ensure structural integrity of said die holder.

In an embodiment of the subject application, the die holder comprises at least 10 holes or bores evenly distributed on the ring-shaped top surface part, such as 10-100 holes or bores, so as to maximize the amount of said bores or holes on said ring-shaped top surface. In specific embodiments, the die holder may have such as 24, 30, 36, 40, 48, or 60 holes or bores evenly distributed on the ring-shaped top surface part of the die holder, however other numbers of holes or bores may be preferred.

In an embodiment of the subject application, the body of the die holder is monolithic and made of a metals so as to decrease the amount of parts needed to fixate a die in said die holder.

In a fourth aspect, the subject application relates to a machine for producing elongated bodies, such as nails, the machine comprising:

a die according to the first aspect of the subject application, and a die holder comprising:

a body having at least a substantially plane top surface part, a hole or bore in the substantially plane top surface part, wherein the hole or bore has an inner surface shaped for receiving the die and for press fit by contact with the side surface of the die, a stop part located in the hole or bore for engaging with the bottom surface of the die when being pressed into the hole or bore, so as to fix a height of the top surface of the die in relation to the top surface part of the die holder, and a protrusion or recess serving to engage with a corresponding recess or protrusion of the die, in order to fix angular orientation of the groove of the die relative to the die holder.

In the context of the subject application, 'press fit' is to be understood as the fit of a body driven into a hole slightly smaller than itself to be held tight and motionless.

In an embodiment of the subject application, the top surface part of the die holder is substantially ring-shaped, having a central axis of rotation, the ring-shaped die holder being mounted so as to rotate about said axis.

In an embodiment of the subject application, the machine has two opposite ring-shaped die holders, the die holders angled or slanted so as to, when rotating, to bring two opposite dies close enough together to almost brush against each other.

In an embodiment of the subject application, the top surface of the ring-shaped circular die holder has a plurality of holes or bores, such as 10-100 holes or bores, arranged for mounting of respective dies according to the first aspect of the subject application.

In an embodiment of the subject application, the plurality of holes or bores are parallel and evenly distributed around the top surface part of the ring-shaped die holder.

In an embodiment of the subject application, the die holder body has an opening, such as a hole or bore, connected to a bottom part of the hole or bore shaped for receiving and holding the die, so as to allow an elongate tool to engage with a lower part of the die to push the die upwards for removal of the die from the die holder, such as by exerting a force between the bottom surface of the die and a surface of the die holder. This embodiment is particularly, but not exclusively, advantageous for fast and simple removal of a worn-down or chipped die from the die holder, which will could significantly reduce the down-time of a machine.

In an embodiment of the subject application, the opening, for the insertion of the elongate tool into the die holder body, is a hole or bore perpendicular to the hole or bore for receiving and holding the die.

In an embodiment of the subject application, the die holder is ring-shaped, and the opening for the insertion of the elongate tool into the die holder body, is located on an inner side of the ring, so as to allow removal of the die, when the die holder is mounted for normal operation.

In an embodiment of the subject application, the die holder has one or more pins located in the hole or bore, serving to engage with a corresponding protrusion or recess of the die to fix angular orientation of the groove relative to the die holder.

The machine may especially be a nail producing machine, such as for producing nails with round heads, or for producing nails with D-shaped heads. The machine may alternatively be a screw producing machine, e.g. for producing heads on threaded elongate bodies.

In a fifth aspect, the subject application relates to a method for manufacturing a head on an elongate body, such as metal nails or screws, using the die according to the first aspect. In an embodiment, the method comprising:

providing first and second die holders, each of the first and second die holders comprising:

a body having at least a substantially plane top surface part, a hole or bore in the substantially plane top surface part, wherein the hole or bore has an inner surface shaped for receiving the die and for press fit by contact with a side surface of the die, a stop part located in the hole or bore for engaging with a bottom surface of the die when being pressed into the hole or bore, so as to fix a height of the top surface of the die in relation to the top surface part of the die holder, and a protrusion or recess serving to engage with a corresponding recess or protrusion of the die, in order to fix angular orientation of the groove of the die relative to the die holder.

providing first and second dies, each of the first and second dies comprising:

a body with a top surface provided with a through-going groove for receiving and holding an elongate body longitudinally in said groove, a recess at one end of the groove suitable for forming the head on the elongate body, a side surface shaped for press fit by contact with an inner surface of a bore or hole in the associated die holder, a bottom surface for engaging with a stop part in the hole or bore of the associated die holder, so as to determine a height of the top surface of the die in relation to a surface part of the associated die holder, and a recess or protrusion serving to engage with a corresponding protrusion or recess of the associated die holder, in order to fix angular orientation of the groove relative to the die holder, bringing the top surface of the first die so near to the top surface of the second die that the grooves of the first and second dies hold the elongate body, and providing force onto the elongate body at the recess end of the grooves so as to form a head on the elongate body.

This aspect of the subject application is particularly, but not exclusively, advantageous in that the method according to the subject application may be implemented by providing a ring shaped die holder according to the third aspect and the die according the first aspect. The subject application is advantageous for new nail or screw manufacturing machines, as well as existing machines which can be modified or updated to include a die holder with dies according to the subject application.

In a sixth aspect, the subject application relates to a method for manufacturing a head on an elongate body, such as a nail, using the die holder according to the third aspect of the subject application.

This aspect of the subject application is particularly, but not exclusively, advantageous in that the method according to the subject application may be implemented by inserting a die holder according the second aspect, in an older, less advanced machine, such as a nail manufacturing machine, as an upgrade kit. The subject application is advantageous for new nail or screw manufacturing machines, as well as existing machines, which can be modified or updated to include a die holder with dies according to the first aspect of the subject application.

In a seventh aspect, the subject application relates to a method for manufacturing a head on an elongate body, such as a nail, using the machine according to the fourth aspect of the subject application.

In an eighth aspect, the subject application relates to a method for ejecting a die according to the first aspect of the subject application from an associated die holder according to the third aspect of the subject application, wherein said method comprises:

providing an elongate tool, such as a pin, inserting said elongate tool into an opening of the associated die holder, applying a force in a length axis of the elongate tool towards the die so as to force said die to eject from the associated die holder, in a direction substantially perpendicular to the direction of the applied force.

This aspect of the subject application is particularly, but not exclusively, advantageous in that the method according to the subject application may be implemented by using an elongate tool according to the second aspect of the subject application in combination with the die according to first aspect of the subject application and the die holder according to the second aspect, in an older, less advanced machine, such as a nail manufacturing machine, as an upgrade kit. The subject application is advantageous for new nail or screw manufacturing machines, as well as existing machines, which can be modified or updated so as to faster replace any damaged dies from the die holder and hence, reduce down time on the manufacturing machine.

In an embodiment of the subject application, the method comprises engaging between a tip of the elongate tool and a groove in the stop part or a bottom part of the die, wherein said tip and said groove are shaped to match so as to facilitate ejection of the die.

In an embodiment of the subject application, the groove comprises a plane surface with an inclination angle between 1° to 40° or such as between 2° to 20° relative to the stop surface or bottom surface of the die, and wherein a tip on the elongate tool has a plane surface shaped to engage with said plane surface of the groove.

In a ninth aspect, the subject application relates to the use of a die according to the first aspect of the subject application for manufacturing a head on an elongate body, such as a nail.

In a tenth aspect, the subject application relates to the use of a die holder according to the third aspect of the subject application, for manufacturing a head on an elongate body, such as a nail.

In an eleventh aspect, the subject application relates to the use of a machine according to the fourth aspect of the subject application, for manufacturing a head on an elongate body, such as a nail.

In a twelfth aspect, the subject application provides a nail manufactured according to any of the fifth, sixth or seventh aspect.

In a thirteenth aspect, the subject application provides a method of manufacturing nails comprising:

receiving and holding an elongate body longitudinally in a groove on a top surface of a body, forming a head on an elongate body via a recess at one end of the groove, press fitting, by contact, a side surface with an inner surface of a bore or hole in an associated die holder, engaging a stop surface with a stop part in the hole or bore of the associated die holder, so as to determine a height of the die in relation to the associated die holder, and engaging a recess or protrusion with a corresponding protrusion or recess of the associated die holder to fix an angular orientation of the groove relative to the die holder.

The subject application provides a die for the manufacturing of heads on elongate bodies that solves the above mentioned problems of the existing technology with and reducing down-time and increasing yield from a nail-machine.

In a fourteenth aspect, the subject application provides a die for mounting in an associated die holder for the production of heads on elongate bodies, the die comprising:

a body with a top surface provided with a through-going groove for receiving and holding an elongate body longitudinally in said groove, a recess at one end of the groove suitable for forming the head on the elongate body, a side surface comprising a first portion with a curved shaped arranged for press fit by contact with a curved portion of an inner surface of a bore or hole in the associated die holder, and a stop surface for engaging with a stop part in the hole or bore of the associated die holder, so as to determine a height of the die in relation to the associated die holder, wherein the side surface further comprises a second portion shaped to engage with a corresponding portion of the inner surface of the bore or hole in the associated die holder, in order to guide angular orientation of the groove relative to the associated die holder.

In an embodiment of the subject application, the first portion of the side surface of the die has a round shape, such as a circular or cylindrical shape, which may improve the durability of the die, as sharp edges are usually the weakest point, most prone to chipping, when using alloy-steels suitable for tools. In another embodiment, said first portion of the side surface has a conical shape, which has an advantageous shape for press fitting with a corresponding conical bore of an associated die holder.

In another embodiment of the subject application, the second portion of the side surface of the die comprises a plane portion serving to engage with a corresponding plane portion of the inner surface of the bore or hole in the associated die holder. This embodiment is particularly advantageous, as the plane portion provides a lock and key feature with a corresponding bore or hole of an associated die holder, thus preventing an operator from inserting the stop surface into said bore or hole. Thus, the flat surface provides an intuitive design for assembly. Furthermore, the plane portion, as per the inventors significant testing, has proven to provide a very durable die, thus saving time and material, when manufacturing nails.

The inventors have tested the die under normal operational conditions. Normal operational conditions is to be understood as operational conditions according to factory required and/or recommended conditions, i.e. wherein the nail manufacturing machine, wherein the die is positioned, is maintained according to factory recommendations and machine parameters are adjusted and set, according to factory recommendations.

The subject application introduces a novel die and method for fixing a die in a die holder for the forming of heads on elongate bodies, such as nails or screws. The introduction of the plane side surface portion which engages with a corresponding plane inner surface portion of the bore or hole of the die holder, the angular orientation guiding between die and die holder is handled without requiring any element which increases height of the die, and a limited height of the die helps increasing its stability under normal head forming operations and thereby eliminates or at least reduces problems with damages and wear.

The inventors have realized and verified by tests under normal nail production conditions, that the die according to the fourteenth aspect has a surprisingly long lifetime compared to the existing technology dies, including the dies disclosed in WO 2020/088823 A1. Thus, a nail-producing machine with such dies can be expected to have a very limited downtime, and thus a high yield, since it is only required to very rarely stop nail production due to worn out or damaged head forming dies.

Furthermore, compared to the existing technology dies disclosed in WO 2020/088823 A1, the dies according to the subject application are easier to mount, since they have one plane side surface only and can therefore not fit into the bore or hole of the die holder with the recess for head forming to the wrong side. This helps to reduce mounting time and eliminates damages or time spent on operating a nail producing machine with one or more dies with the head forming recess in the wrong position. The plane side surface further provides a clear, visual lock and key indication which provides an operator with an immediate information as to how the die are to be positioned respective to the bore of an associated die holder, when said operator is tasked with e.g. replacing a die in an associated die holder of a nail manufacturing machine.

Still further, compared to the existing technology dies disclosed in WO 2020/088823 A1, the dies according to the subject application are easier to manufacture, since the design is simpler and therefore can be performed with fewer manufacturing steps.

Even further, the dies can be designed with a volume of only 40-50% of the existing technology dies disclosed in WO 2020/088823 A1. Thus, the die design helps to save a significant amount of material, typically a hard metal alloy. Hereby, the dies according to the subject application are therefore also more environmental friendly than the existing technology dies.

In the context of the subject application, 'die' is to be understood as a tool or device for imparting a desired shape, form, or finish to a material or for impressing an object or material, such as shaping the head on a nail or screw from a metal wire.

In the context of the subject application, 'recess' is to be understood as a depression into part of a surface, such as, but not limited to, a cleft, cut or cavity. In the context of the recess for forming the head on the elongate body, the recess can be a combination of a cut out for forming a surface, e.g. a plane surface, suitable for forming the head by applying pressure on the end of the elongate body when being held by the groove. Further, the recess may comprise specific features for forming a specific head shape on the elongate body, e.g. a chamfer and/or a round shape etc.

In the context of the subject application, 'head' is to be understood as the uppermost extremity or projecting part of an object.

In the most example embodiments, the groove is perpendicular or substantially perpendicular to a central axis through the body between top surface and a bottom surface of the body of the die. In some embodiments, the bottom surface and the stop surface of the die are the same surface, i.e. the bottom surface constitutes the stop surface. Preferably, the groove is perpendicular to the central axis through the body. Especially, a small offset angle of such as 0.1° may be preferred, and thus most preferably, the groove forms an angle of 89.8°-90.2° with the central axis through the body of the die.

In an embodiment of the subject application, the elongate body is processed into rivets.

In an embodiment of the subject application, the elongate body is processed into spokes, such as, but not limited to, spokes for a bicycle.

In an embodiment of the subject application, the wire to be fed into the machine is smooth.

In an embodiment of the subject application, the wire to be fed into the machine is profiled, such as a round, square or spline profile.

In an embodiment of the subject application, the plane portion of the side surface is parallel with a central axis of the die. This embodiment may be advantageous for further providing strength to the structure of the die, thus providing a more durable die.

In the context of the subject application, the central axis is an axis extending through a bottom plane and a top plane of the die.

In another embodiment if the subject application, the plane portion of the die forms an angle of 0.5-2.0° with a central axis of the die. This embodiment may be advantageous for providing press fit of the side surface of said die with respect to a corresponding bore or hole of an associated die holder.

In yet another embodiment of the subject application the second portion of the side surface of the die comprises a curved portion serving to engage with a corresponding curved portion of the inner surface or bore in the associated die holder.

In yet another embodiment of the subject application, the curved portion of the second portion of the side surface has a different curvature than a curvature of the first portion of the side surface.

In another embodiment of the subject application, the second portion of the side surface of the die is arranged for press fit by contact with the corresponding portion of the inner surface of the bore or hole in the associated die holder.

In another example embodiment of the subject application, the first portion of the side surface of the die has a conical shape, and wherein the conical shaped portion of the side surface forms an angle of 0.5-2.0°, such as 0.8-1.6°, such as 1.0-1.4°, such as 1.1-1.3°, relative to a central axis of the die. The above examples may provide an optimal press fit angle for providing a durable die, i.e. a die that may be operational for more than 2.000 hours, preferably more than 3.000 hours, more preferably for more than 4.000 hours, even more preferably for between 4.500 and 10.000 hours or more.

In an embodiment of the subject application, an area of the second portion of the side surface is smaller than an area of the first portion of the side surface, such as the area of the second portion of the side surface being 10-40% of an area of the first portion of the side surface. This embodiment may be particularly advantageous for providing a more durable die.

In another embodiment of the subject application, the side surface of the die has chamfered portions, interconnecting said first and second portions of the side surface. In an embodiment of the subject application wherein the side surface of the has a first and second portion, the die has a first and second chamfered portion. This embodiment may be advantageous for reducing machining time of both the die and in particular the bore or hole of the associated die holder.

In another example embodiment of the subject application, the first and second chamfered portions interconnect respective first and second sides of the second portion of the side surface and the first portion of the side surface.

In yet another example embodiment of the subject application, the chamfered portions extend from a bottom surface or stop surface of the body of the die. This embodiment may be particularly advantageous for reducing machining time of both the die and in particular the bore or hole of the associated die holder. In some embodiments of the subject application, the chamfered portions extend from a bottom surface or stop surface to the top surface of the die.

In another embodiment of the subject application, the chamfered portions occupy only a part of the side surface between the bottom surface of the body to the top surface of the body, such as 30-80%, or such as 40-70%, of the distance between the bottom surface of the body to the top surface of the body. This embodiment may be advantageous for providing a more durable die.

In an embodiment of the subject application, the chamfered portions of the side surface of the die occupy a total of 1-20% of a circumference of the body of the die, such as 2-10% of the circumference of the body.

It is to be understood, that the circumference of the body of the die is to be understood as a total length of the perimeter of the side surfaces of the die, in a plane perpendicular to the central axis and substantially parallel to the top surface of the die, e.g. the circumference of a first and second portion of a side surface of a die with only two side portions.

In another embodiment of the subject application, the chamfered portions of the side surface of the die comprise a plane portion. This embodiment may be particularly advantageous for reducing machining time of both the die and in particular the bore or hole of the associated die holder, i.e. by reducing tolerances of said bore or hole with respect to the corresponding die.

In another embodiment of the subject application, the chamfered portions comprise a curved portion. This embodiment may be advantageous for providing a more durable die.

In yet another embodiment of the subject application, the second portion of the side surface of the die extends from the top surface to a bottom surface and/or stop surface of the body. This embodiment may be advantageous for providing a more durable die as well as a bore or hole within an associated die holder, which is faster to machine.

In an another embodiment of the subject application, the recess for forming the head on the elongate body is formed as a recess in an upper part of the second portion of the side surface. In an embodiment of the subject application, the second portion of the side surface is substantially flat, extending from a bottom surface of the die to the top surface of the die and wherein the recess is formed in an upper part of the flat surface. This embodiment is particularly advantageous for providing a more durable die, as the inventors have discovered that providing an extending flat surface on a side of the die, corresponding to a pressing surface for forming the head on the elongate body, provides for a stronger and more durable die which does not crack during extensive use, such as within the first 2.000 to 3.000 hours of operation.

In another embodiment of the subject application, an axis along the through-going groove is parallel to a normal to a plane portion of the second portion of the side surface.

In the context of the subject application, it is to be understood that a normal is a defining object such an axis or vector that is perpendicular to a given object. For example, the normal line to a plane curve at a given point is the (infinite) line perpendicular to the tangent line to the curve at the point.

In another embodiment of the subject application, the groove on the top surface of the die is perpendicular or substantially perpendicular to a central axis of the die.

In an advantageous embodiment, a bottom surface of the body forms the stop surface.

In a more advantageous embodiment of the subject application, bottom surface has a plane portion serving as a stop surface. This embodiment is particularly advantageous for providing a more simple die and corresponding die holder, which are faster and more simple to manufacture.

In an embodiment of the subject application, the die further comprises a dummy element or an associated dummy element, such as a monolithic element, arranged for position at a bottom part of the hole or bore of the associated die holder, wherein the dummy element comprises a top surface arranged to engage with a bottom surface of the body of the die, so as to form the stop surface in cooperation with the bottom part of the hole or bore of the associated die holder.

In an embodiment, a bottom surface or stop surface of the die has a groove, so as to allow an associated tool to engage with the groove in order to push the die upwards for removal of the die from an associated die holder.

In an embodiment of the subject application, the bottom or stop surface of said die has an inclined groove so as to ease the extraction or ejection of said die when seated in an associated die holder, when applying pressure with an elongate tool, such as a pin, preferably with a inclined tip corresponding to the inclination of the groove thereby driving the die out of the associated die holder without damaging said die holder or the associated elongate tool.

In another embodiment of the subject application, the groove is an inclined groove with an inclination angle between 2° to 20° relative to a bottom surface of the die.

In another embodiment of the subject application, the inclined groove on the stop surface of the die has an angle between 1° to 40°, such as between 2° to 30°, such as 5° to 20° or such as 8° to 15°, relative to the stop surface of the die, wherein the angle reduces the pressure needed to extract said die from an associated die holder.

The above embodiments are advantageous, as an inclined groove at a bottom or stop surface of the die may provide easier extraction or ejection of said die when seated in an associated die holder, when applying pressure with an elongate tool, such as a pin, preferably with a inclined tip corresponding to the inclination of the groove thereby driving the die out of the associated die holder without damaging said die holder or tool.

In the context of the subject application, inclined groove is to be understood as a narrow cut or low area in a surface angled from one area in said surface to another area in said surface and wherein the groove varies in depth, relative to said surface from one end of the groove to the opposite end of the groove.

In some embodiments of the die, the stop surface and the bottom surface are one and the same. In some embodiments, the stop surface may be a recess cut into the body of the die at a position above the bottom surface.

In an embodiment of the subject application, the inclined groove on the bottom or stop surface of the die has a width (W) and the die has an outer diameter (D), and where a ratio (W/D) between said width and said outer diameter is between 0.01 and 1, more preferably between 0.1 and 0.5 as these ratios may be ideal for the production of dies from steel, such as from tool grade steel or other hard alloys, especially such as a hard metal, e.g. tungsten carbide, or other hard materials suitable for the production of elongate bodies, such as a nail or screw.

In another embodiment of the subject application, the inclined groove has a width (W) and the die has an outer diameter (D), and where a ratio (W/D) between said width and said outer diameter is between 0.1 and 0.5.

In another embodiment of the subject application, the inclined groove has at least a plane surface part. This embodiment may be advantageous for reducing friction between an associated elongate tool and the plane surface, thereby easing the ejection of the die from die holder, when said die is firmly seated in said die holder.

In an embodiment of the subject application, the groove is a plane surface being parallel with an axis perpendicular to a central axis of the die, so as to ease the insertion of an associated elongate tool for the ejection of the die from die holder, when said die is firmly seated in said die holder.

In an embodiment of the subject application, the plane surface has an inclination angle of 0.5° to 50°, such as 1° to 40° or such as 2° to 20° relative to the stop surface or bottom surface of the die.

In an embodiment of the subject application, the inclined groove has at least a curved surface part.

In the context of the subject application, it is to be understood that the associated elongate tool may be used as a wedge, wherein the tip of said elongate tool is wedged between a bottom surface of the die and the bottom surface of the associated die holder, so as to apply a pressure for pushing the die upwards and out of the bore or hole in the associated die holder.

In an embodiment of the subject application, the tip on the associated elongate tool has an inclined flat surface arranged for engagement with an inclined flat surface of the inclined groove of the die, so as to ease the ejection of said die seated in the associated die holder.

In another embodiment of the subject application, the groove of the bottom surface is parallel with the through-going groove of the top surface.

In yet another embodiment of the subject application, the groove of the bottom surface forms a recess in a bottom part of the second portion of the side surface.

In yet another embodiment of the subject application, the body of the die has a symmetry plane, which is parallel with an axis along the through-going groove.

In another embodiment of the subject application, the body of the die is monolithic and made of a metal or a ceramics. This embodiment is particularly advantageous for providing a stronger and more durable die, which is faster to manufacture. In general, the die can be formed by a variety of material including metals, alloy steels as well as non-metals.

In the context of the subject application, 'alloy steels' is to be understood as steels that are well-suited to be made into tools. Alloying elements such as, but not limited to Tungsten, Chromium, Vanadium or Molybdenum are added, forming carbides in the steel, to increase the hardness, corrosion and heat resistance, abrasiveness and deformation of the steel.

In an embodiment of the subject application, at least a part of the die could be made from cemented carbide, or a ceramic, such as Oxide ceramics with e.g. Zirconia additives, mixed ceramics with e.g. carbides or Silicon nitride ceramics and SiAlON grade ceramics. Ceramics have excellent wear resistance which could improve the durability of the die or the die holder.

In another embodiment of the subject application, an outer diameter (D) and an overall height (H) of said die has a ratio between 0.5 and 2.0, such as between 0.7 and 1.5.

In another example embodiment of the subject application, the height of the die between the top surface and a bottom surface is 5-20 mm, such as 8-18 mm, such as 10-16 mm, such as 12-15 mm.

In yet another example embodiment of the subject application, the overall length of the through-going groove of the top surface of the die is 5-30 mm, such as 10-20 mm, such as 10-18 mm, such as 10-17 mm or such as 11-17 mm.

In yet another example embodiment, the through-going groove on the top surface of the die has a width of 1.2-5.5 mm or such as 1.8-4.5 mm.

In an embodiment of the subject application, at least a part of the body of the die, such as the first portion of the side surface of the die, is tapered, improving the fixation of the die within the die holder, i.e. providing a die, which is suitable for press-fit in a die holder with a corresponding tapered geometry. In some embodiments, the tapered part of the body of the die or the entire body of the die may have one or more a circular cross sections. It is to be understood that the circular cross section may likewise be slightly elliptic or slightly oval.

In another embodiment of the subject application, first portion of the side surface has a conical shape and occupies more than 180°, such as 200-280°, such as 230-260°, such as 240-250°, of an angular portion of a cross sectional area of the die.

In an embodiment of the subject application at least a part of the body of the die has a conical shape, such as wherein a side surface of said part of the body providing an angle of 0.1°-3°, such as 0.5°-2.5°, such as 1.0°-2.0°, with a central axis of the body.

In an embodiment of the subject application, the top surface of the die and the surface part of the associated die holder are to be substantially parallel in respect to each other when the stop surface of the die is abutting said bottom surface or lower shoulder surface of the associated die holder.

In an embodiment of the subject application, the outer diameter (D) of the die and an overall height (H) of the die has a ratio (D/H) between 0.1 and 5, preferably between 0.5 and 2.0, even more preferably between 0.5 to 1.0, even more preferably between 0.7 to 1.0, even more preferably between 0.8 to 1.0 and even more preferably between 0.9 to 1.0, to optimize manufacturing costs of the die and an associated die holder, such as a tool ring.

In a fifteenth aspect, the subject application relates to a die holder comprising:

a body having a surface part, a plurality of holes or bores in the surface part, wherein each of the plurality of holes or bores has a first inner side surface portion with a curved shaped and arranged for receiving a die and for press fit engagement with the die by contact with a side surface of the die, wherein each of the holes or bores has a second inner side surface portion serving to engage with a corresponding side surface portion of the die, in order to fix angular orientation of the die relative to the die holder, and wherein in each of the holes or bores has a stop part arranged to fix a height of a top surface of the die in relation to the surface part of the die holder.

In the context of the subject application, 'press fit' is to be understood as the fit of a body driven into a hole slightly smaller than itself to be held tight and motionless or substantially motionless.

In another embodiment if the subject application, the die holder is ring-shaped.

In another example embodiment of the subject application, the plurality of holes or bores have parallel central axes and radially distributed on the die holder.

In yet another example embodiment of the subject application, the die holder comprises at least 10 holes or bores, such as 20-60 holes or bores, evenly distributed on a ring-shaped top surface part of the die holder. This embodiment is particularly advantageous for ensuring structural integrity of said die holder.

In some embodiment of the subject application, the die holder comprises at least 10 holes or bores evenly distributed on the ring-shaped top surface part, such as 10-100 holes or bores, so as to maximize the amount of said bores or holes on said ring-shaped top surface. In specific embodiments, the die holder may have such as 24, 30, 36, 40, 48, or 60 holes or bores evenly distributed on the ring-shaped top surface part of the die holder, however other numbers of holes or bores may be preferred.

In another embodiment of the subject application, the plurality of holes or bores are axially distributed on an inner or outer surface part of the die holder.

In an advantageous embodiment of the subject application, the body of the die holder is monolithic and made of a metal.

In another advantageous embodiment of the subject application, each of the plurality of holes or bores of the die holder has a conical shaped inner surface portion with an angle of 0.5-2.0° relative to a central axis of the hole or bore. This embodiment of the subject application is particularly advantageous for providing a bore, which is suitable for press fit, when inserting an element into said bore, which has a corresponding conical shape, such as the die according to the fourteenth aspect of the subject application.

In another embodiment of the subject application, each of the plurality of holes or bores has a plane inner side surface portion. This embodiment of the subject application is particularly advantageous for providing a die holder, which is fast to manufacture while still maintaining a sufficient fixation of an element inserted into said hole or bore, such as the die according to the fourteenth aspect of the subject application.

In an embodiment of the subject application, the plane inner side surface portion is parallel with a central axis of the hole or bore.

This aspect of the subject application is particularly, but not exclusively, advantageous in that the die holder according to the subject application may be implemented by insertion in an older, less advanced machine, such as a nail manufacturing machine, as an upgrade kit. The subject application is advantageous for new nail or screw manufacturing machines, as well as existing machines which can be modified or updated to include a die holder with dies according to the fourteenth aspect of the subject application.

In a sixteenth aspect, the subject application relates to a machine for producing heads on elongated bodies, the machine comprising at least one die according to the fourteenth aspect of the subject application, and a die holder according to the fifteenth aspect of the subject application.

In another embodiment of the subject application, a top surface part of the die holder is ring-shaped, having a central axis of rotation, the ring-shaped die holder being mounted so as to rotate about said axis.

In another example embodiment of the subject application, the top surface of the ring-shaped circular die holder has a plurality of holes or bores, arranged for mounting of respective dies.

In an embodiment of the subject application, the top surface of the ring-shaped circular die holder has a plurality of holes or bores, such as 10-100 holes or bores, arranged for mounting of respective dies according to the fourteenth aspect of the subject application.

In an embodiment of the subject application, the plurality of holes or bores are parallel and evenly distributed around the top surface part of the ring-shaped die holder.

In an embodiment of the subject application, the machine has two opposite ring-shaped die holders, the die holders angled or slanted so as to, when rotating, to bring two opposite dies close enough together to almost brush against each other.

In an advantageous embodiment of the subject application, the die holder body has an opening, connected to a part of the hole or bore shaped for receiving and holding the die, so as to allow an elongate tool to engage with a lower part of the die to push the die upwards for removal of the die from the die holder.

In an embodiment of the subject application, the die holder body has an opening, such as a hole or bore, connected to a bottom part of the hole or bore shaped for receiving and holding the die, so as to allow an associated elongate tool to engage with a lower part of the die to push the die upwards for removal of the die from the die holder, such as by exerting a force between the bottom surface of the die and a surface of the die holder. This embodiment is particularly, but not exclusively, advantageous for fast and simple removal of a worn-down or chipped die from the die holder, which will could significantly reduce the downtime of a machine.

In another embodiment of the subject application, the die holder is ring-shaped, and wherein said opening is located on an inner side of the ring, so as to allow removal of the die, when the die holder is mounted for normal operation.

In an embodiment of the subject application, the opening, for the insertion of the associated elongate tool into the die holder body, is a hole or bore perpendicular to the hole or bore for receiving and holding the die.

In another embodiment of the subject application, the machine comprises a head forming mechanism arranged to apply a force onto the elongate body at the recess end of the groove of the die, when the elongate body is fixated by the groove of the die, so as to form a head on the elongate body shaped according to the recess of the die.

In another example embodiment of the subject application, the first portion of the side surface of the at least one die has a conical shape, wherein the conical shaped portion of the side surface forms a first angle relative to a central axis of the die, and wherein each of the plurality of holes or bores of the die holder has a first inner side surface portion with a conical shape which forms a second angle relative to a central axis of the holes or bores.

In an embodiment of the subject application, the first and second angles differ by less than 0.02°.

In another embodiment of the subject application, the first angle is larger than the second angle, such as the first angle being 0.02°-0.10° larger than the second angle.

In yet another embodiment of the subject application, both of the first and second angles are within 0.5-2.0°, such as 0.8-1.6°, such as 1.0-1.4°, such as 1.1-1.3°.

In another embodiment of the subject application, the second portion of the side surface of the at least one die comprises a plane portion, and wherein the second inner side surface portion of the holes or bores of the die holder comprise corresponding plane side surface portions.

In an embodiment of the subject application, the plane portion of the at least one die is parallel with a central axis of the at least one die, and wherein said plane side surface portions of the inner side surface of the holes or bores of the die holder are parallel with a central axis of the holes or bores of the die holder.

In an advantageous embodiment of the subject application, a bottom surface of the at least one die forms said stop surface of the at least one die, and wherein a bottom surface of the holes or bores of the die holder form said stop part in the holes or bores of the die holder.

In some embodiments of the subject application, the machine comprises a dummy element arranged between a bottom surface of the at least one die and a bottom surface of the holes or bores of the die holder. This embodiment of the subject application may be advantageous for providing a more durable die within the nail manufacturing machine.

In another embodiment of the subject application, a distance between a bottom surface and the top surface of the at least one die is equal to a distance between a bottom surface of the holes or bores and a surface part of the die holder.

The machine may especially be a nail producing machine, such as for producing nails with round heads, or for producing nails with D-shaped heads. The machine may alternatively be a screw producing machine, e.g. for producing heads on threaded elongate bodies.

In a seventeenth aspect, the subject application relates to a die for the manufacture of heads on elongate bodies, such as nails, in a machine according to the sixteenth aspect of the subject application.

In a eighteenth aspect, the subject application relates to a die holder for the manufacture of heads on elongate bodies, such as nails, in a machine according to the sixteenth aspect of the subject application.

This aspect of the subject application is particularly, but not exclusively, advantageous in that the method according to the subject application may be implemented by inserting a die holder according the fifteenth aspect, in an older, less advanced machine, such as a nail manufacturing machine, as an upgrade kit. The subject application is advantageous for new nail or screw manufacturing machines, as well as existing machines, which can be modified or updated to include a die holder with dies according to the fourteenth aspect of the subject application.

In a nineteenth aspect, the subject application relates to a method for manufacturing a head on an elongate body using the die according to the fourteenth aspect of the subject application.

In another embodiment of the subject application, the method comprises mounting the die in a hole or bore of a die holder by means of press fitting, and forming the head of the elongate body with the die, when the die is mounted in the die holder.

In another example embodiment of the subject application, the method comprises mounting the die in the hole or bore of the die holder in a tool-less mounting process. This embodiment is particularly advantageous for easy and fast fixation of the die within the die holder.

In the context of the subject application, tool-less is to be understood as a method wherein a die can be inserted into the bore of a die holder without the use of any other tools, than the hands of an operator. I.E., the operator does not need a hammer, measuring tool or any other tools, to successfully complete the mounting process.

In yet another example embodiment of the subject application, the method comprises operating a machine to produce heads on elongate bodies using the die mounted in the die holder in a second step, after mounting the die in the hole or bore without the use of tools, in a first step. This embodiment is particularly advantageous for the production of nails, the process of inserting a new die into the hole or bore of a die holder is fast and only requires few steps, e.g. two steps, after which the production of nails can immediately continue.

It is to be understood that any service hatches needs to be opened/closed before/after the insertion of any dies.

In an embodiment of the subject application, the method comprises:

a. providing (S1) first and second die holders, each of the first and second die holders comprising:
   i. a body having at least a surface part,
   ii. a hole or bore in the surface part, wherein the hole or bore has a first inner surface portion with a curved shaped and arranged for receiving the die and for press fit by contact with a first side surface portion of the die,
   iii. a stop part located in the hole or bore for engaging with a bottom surface of the die when being pressed into the hole or bore, so as to fix a height of the top surface of the die in relation to the surface part of the die holder, and
   iv. a second inner surface portion of the bore or hole engaging with a corresponding second side surface portion of the die, in order to fix angular orientation of the groove of the die relative to the die holder,
b. providing (S2) first and second dies, each of the first and second dies comprising:

i. a body with a top surface provided with a through-going groove for receiving and holding an elongate body longitudinally in said groove, ii. a recess at one end of the groove suitable for forming the head on the elongate body, iii. a first side surface portion with a curved shape for press fit by contact with a first inner surface portion of a bore or hole in the associated die holder, iv. a stop surface for engaging with a stop part in the hole or bore of the associated die holder, so as to determine a height of the top surface of the die in relation to a surface part of the associated die holder, and v. a second side surface portion serving to engage with the corresponding second inner surface portion of the die holder, in order to fix angular orientation of the groove relative to the die holder, c. bringing (S3) the top surface of the first die so near to the top surface of the second die that the grooves of the first and second dies hold the elongate body, and d. providing (S4) force onto the elongate body at the recess end of the grooves so as to form a head on the elongate body.

In an embodiment of the subject application, the method comprises ejecting the die from a hole or bore in a die holder.

In an embodiment of the subject application, the method comprises:

providing an elongate tool, such as a pin, inserting said elongate tool into an opening of the associated die holder, and applying a force in a length axis of the elongate tool towards the die so as to force said die to eject from the die holder, in a direction substantially perpendicular to the direction of the applied force.

This embodiment of the subject application is particularly, but not exclusively, advantageous in that the method according to the subject application may be implemented by using an elongate tool in combination with the die according to the fourteenth aspect of the subject application and the die holder according to the fifteenth aspect, in an older, less advanced machine, such as a nail manufacturing machine, as an upgrade kit. The subject application is advantageous for new nail or screw manufacturing machines, as well as existing machines, which can be modified or updated so as to faster replace any damaged dies from the die holder and hence, reduce down time on the manufacturing machine.

In another embodiment of the subject application, the method comprises engaging between a tip of the elongate tool and a groove in a bottom part of the die, wherein said tip and said groove are shaped to match so as to facilitate ejection of the die.

This aspect of the subject application is particularly, but not exclusively, advantageous in that the method according to the subject application may be implemented by providing a ring shaped die holder according to the fifteenth aspect and the die according the fourteenth aspect. The subject application is advantageous for new nail or screw manufacturing machines, as well as existing machines, which can be modified or updated to include a die holder with dies according to the subject application.

In a twentieth aspect, the subject application relates to a method for manufacturing a head on an elongate body, such as a nail, using the die holder according to the fifteenth aspect of the subject application.

In an sixtieth twenty-first, the subject application relates to a method for manufacturing a head on an elongate body, such as a nail, using the machine according to the sixteenth aspect of the subject application.

In a twenty-second aspect, the subject application relates to a method of manufacturing nails comprising:

1) press fitting, by contact, a first side surface portion with a curved shape of the die with a curved second inner surface portion of a hole or bore in a die holder, 2) engaging a stop surface of the die with a stop part in the hole or bore of the die holder, so as to determine a height of the die in relation to the die holder, 3) fixing angular position of the die relative to the die holder by engaging a second side surface portion, such as a plane side surface portion, of the die with a corresponding second inner surface portion of the hole or bore in the die holder, after steps 1), 2) and 3), receiving and holding an elongate body longitudinally in a groove on a top surface of a die, and forming a head on an elongate body via a recess at one end of the groove of the die.

In a twenty-third aspect, the subject application relates to a nail manufactured according to any one of the sixth to sixty-first aspect of the subject application.

In an twenty-fourth aspect, the subject application relates to the use of a die according to the fourteenth aspect of the subject application, for manufacturing a head on an elongate body, such as a nail.

In a twenty fifth aspect, the subject application relates to the use of a die holder according to the fifteenth aspect of the subject application, for manufacturing a head on an elongate body, such as a nail.

In a twenty-sixth aspect, the subject application relates to the use of a machine according to the sixteenth aspect of the subject application, for manufacturing a head on an elongate body, such as a nail.

In a twenty-seventh aspect, the subject application relates to a method of forming a manufacture comprising:

mounting a die in an associated die holder for the production of heads on elongate bodies, receiving and holding an elongate body longitudinally in a groove through a top surface of the die, forming a head on the elongate body at a recess of one end of the groove, press fitting a first side surface portion with a curved shape of the die by contact with a first inner surface portion of a bore or hole with a curved shape in the associated die holder, engaging a second side surface portion, such as a plane portion, of the die with a second inner surface portion of the bore or hole in the associated die holder so as to fix angular orientation of the groove relative to the associated die holder, and engaging a stop surface of the die with a stop part in the hole or bore of the associated die holder, so as to determine a height of the die in relation to the associated die holder.

BRIEF DESCRIPTION OF THE FIGURES

The die according to the subject application will now be described in more detail with regard to the accompanying figures. The figures show one way of implementing the subject application and is not to be construed as being limiting to other possible embodiments falling within the scope of the attached claim set.

DETAILED DESCRIPTION OF EMBODIMENTS

Figure 1:
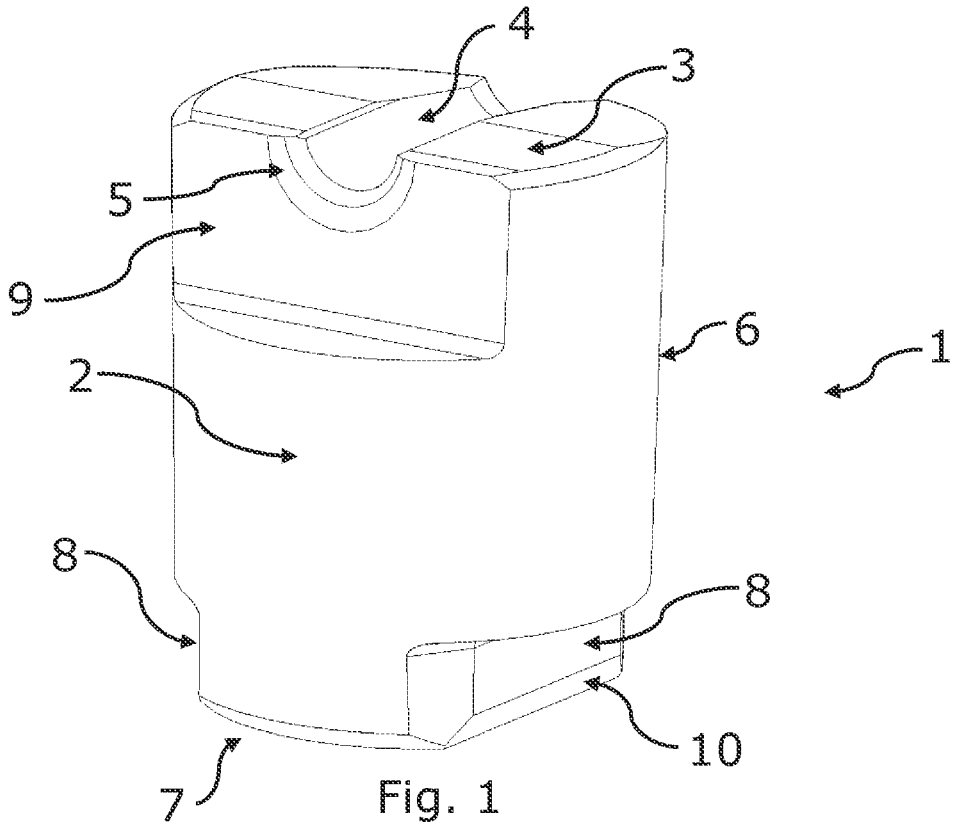
FIG. 1 is a trimetric view of a die embodiment.

FIG. 1 is a trimetric view of a die 1 embodiment. The figure illustrates a die 1 for mounting in an associated die holder for the production of heads on elongate bodies, such as a metal nail or screw. The die 1 comprises a body 2 with a top surface 3. The top surface has a through-going groove 4 suitable for receiving and holding the elongate body longitudinally in the groove 4. The groove 4 may have gripper marks (not visible) for increased friction with the elongate body to improve the holding effect. The body 2 of the die 1 has a cut-out surface 9 on one side and the cut-out surface 9 has a recess 5, which extends from the cut-out surface 9 and merges into the groove 4. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder.

Figure 2:
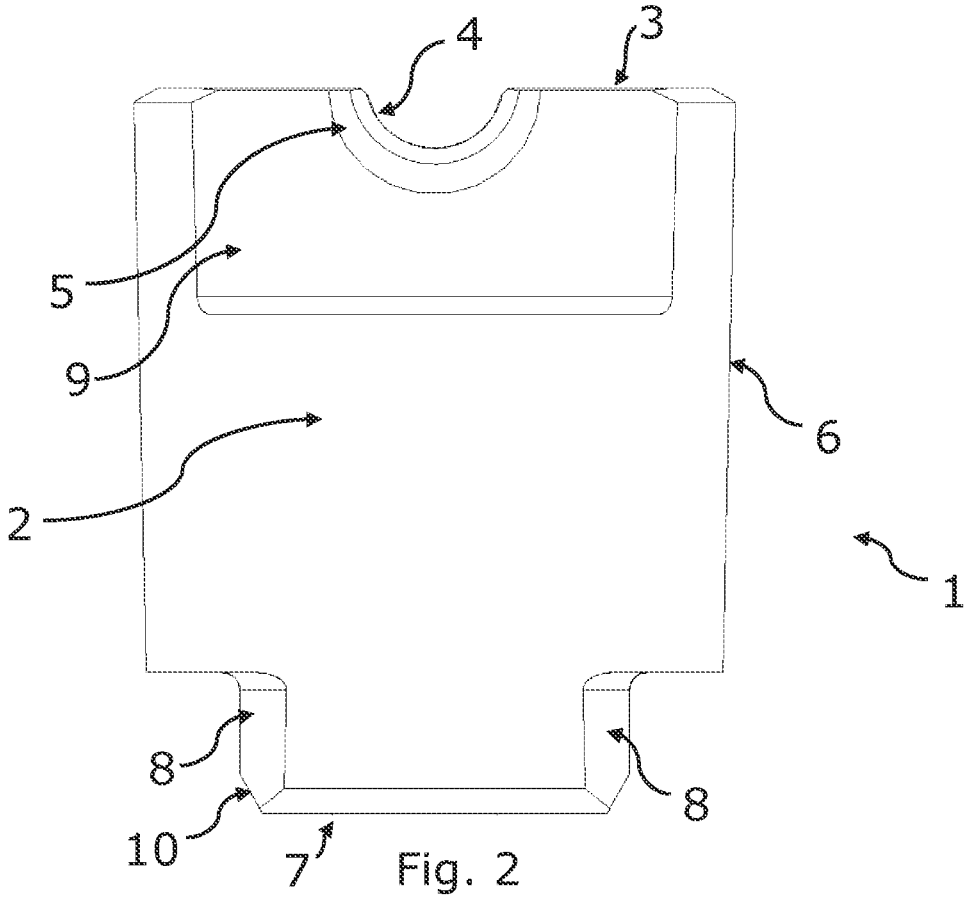
FIG. 2 is a side view of a die embodiment.

FIG. 2 is a side view of a die 1 embodiment having a conical shaped side surface 6. The figure illustrates the body 2 of the die 1 when viewed directly towards the cut-out surface 9. The cut-out surface has a recess 5, which merges into the groove 4 on the top surface 3 of the die 1. The recess 5 is substantially round, shapes so at to form half of the head of a nail or screw. The side surface 6 of the die 1 is angled, suitable for press fitting into a corresponding shape of a die holder. The angle of the side surface 6 with a central axis of the body 2 is between one and two degrees in this particular embodiment, but could be in the range of a tenth of a degree to 5 degrees. On the bottom portion of the die 1 two opposite recesses 8 are shaped to engage with corresponding protrusions or shoulders to fix the angular orientation of the recess 5 and groove 4 relative to the die holder. The bottom surface 7 of the die 1 is chamfered 10 for easy insertion and guiding of the die 1 into the die holder.

Figure 3:
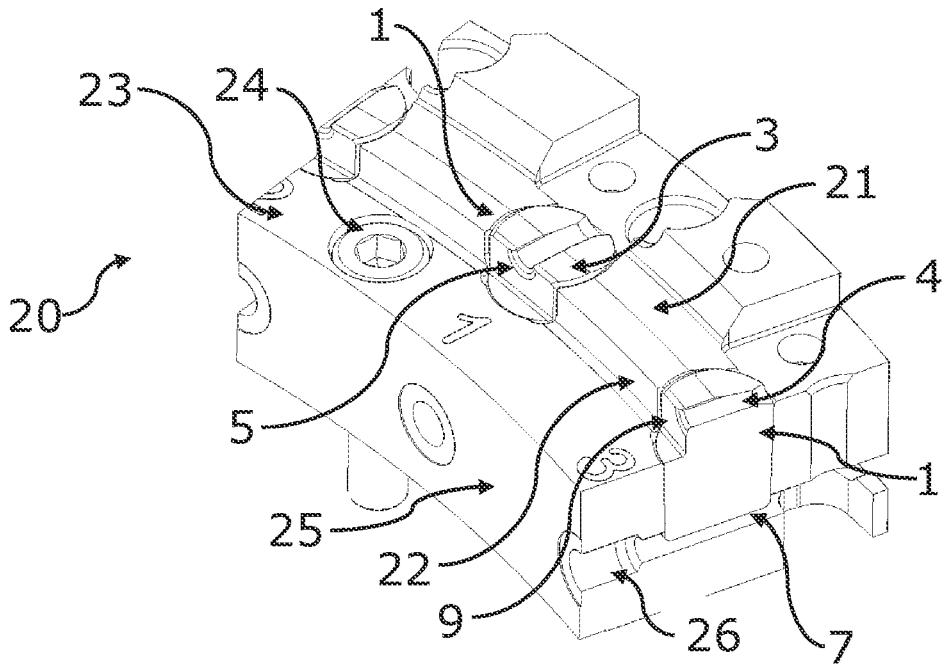
FIG. 3 is a trimetric view of a section of a die holder with a mounted die embodiment.

FIG. 3 is a trimetric view of a section of a die holder 20 with three mounted dies 1. The figure illustrates a section of a rings-shaped die holder 20 with a cross-section view of the die holder 20 and a mounted die 1. The top surface 3 of the die 1 and the top surface part 21 of the die holder 20 are plane in respect to each other. A side surface 22 of the die holder 20 is furthermore plane in respect to the cut-out surface 9 of the die 1, wherein the recess 5 of the die 1 for shaping the head of the elongate body is placed. On a third surface 23 of the die holder 20, parallel to the top surface 21, a pin or bolt 24 is seated for mounting the die holder 20 to a machine (not illustrated). On an inner side 25 of the die holder 20, an opening 26 is located, the opening 26 extending to the bottom surface 7 of the die 1.

Figure 4:
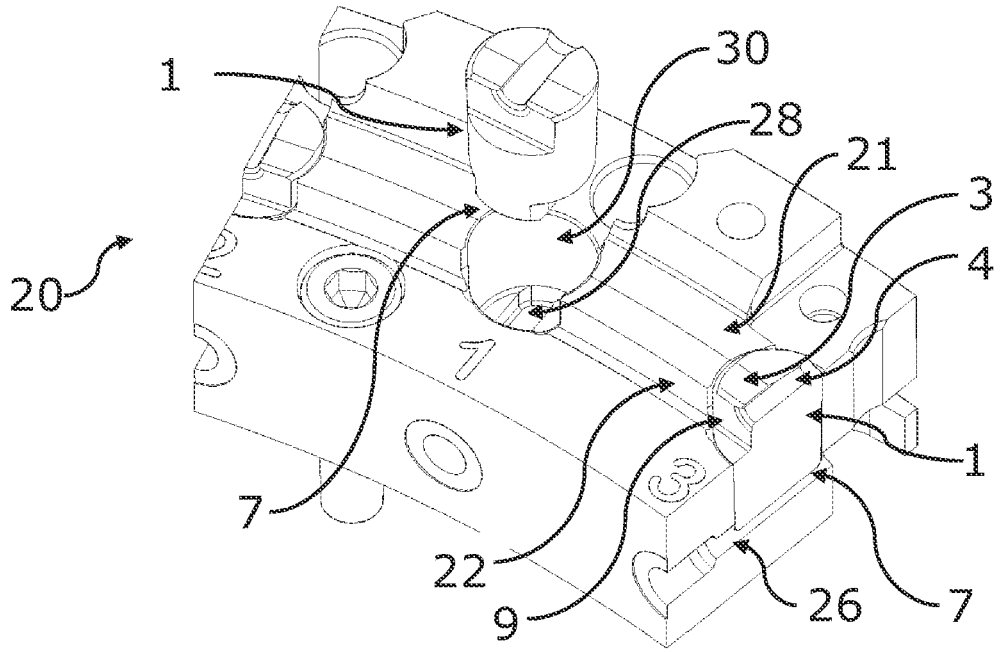
FIG. 4 is a trimetric view of a section of a die holder with an unmounted die embodiment.

FIG. 4 is a trimetric view of a section of a die holder 20 with an unmounted die. The figure illustrates a section of a rings-shaped die holder 20 with a cross-section view of the die holder 20 and a mounted die 1. Furthermore, an unmounted die 1 is floating above a bore 30 in the top surface 21 of the die holder 20. The floating die 1 has a bottom surface 7 corresponding to a bottom surface 28 of the die holder 20. The top surface 3 of the die 1 and the surface part 21 of the die holder 20 are plane in respect to each other when the stop or bottom surface 7 of the die 1 is abutting the bottom surface 28 of the die holder 20.

Figure 5:
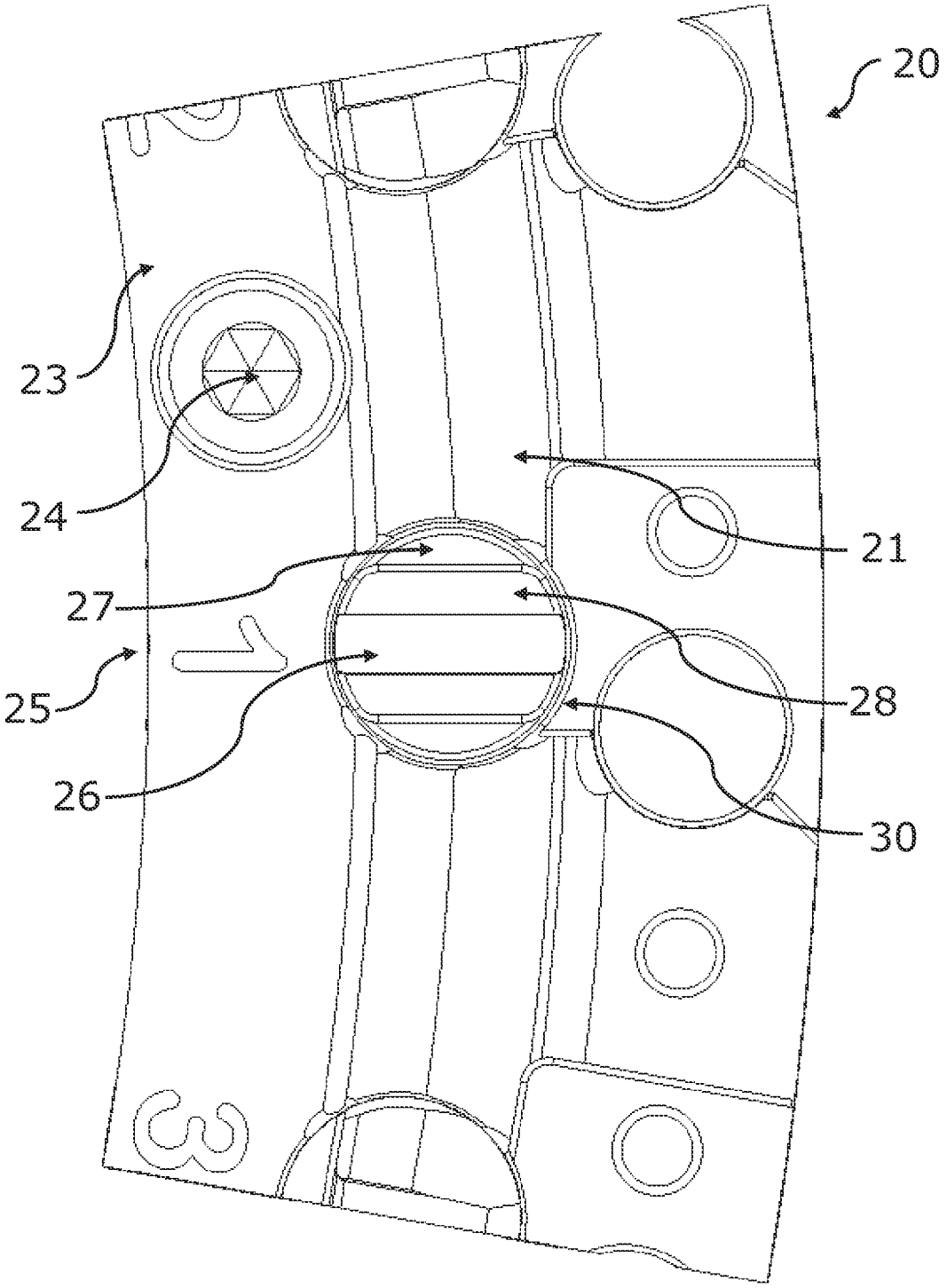
FIG. 5 is a top view of a section of a die holder embodiment.

FIG. 5 is a top view of a section of a ring-shaped die holder 20, according to the subject application. In the middle of the figure, the bore 30 in the top surface 21 of the die holder 20 is located. In the bottom of the bore 30, there is a bottom surface 28 and lower shoulder surfaces 27 parallel to each other. Furthermore, in the bottom of the bore, the opening 26 is visible, extending from the inner side 25 of the die holder 20. On a third surface 23 of the die holder 20, parallel to the top surface 21, a pin or bolt 24 is seated for mounting the die holder 20 to a machine (not illustrated).

Figure 6:
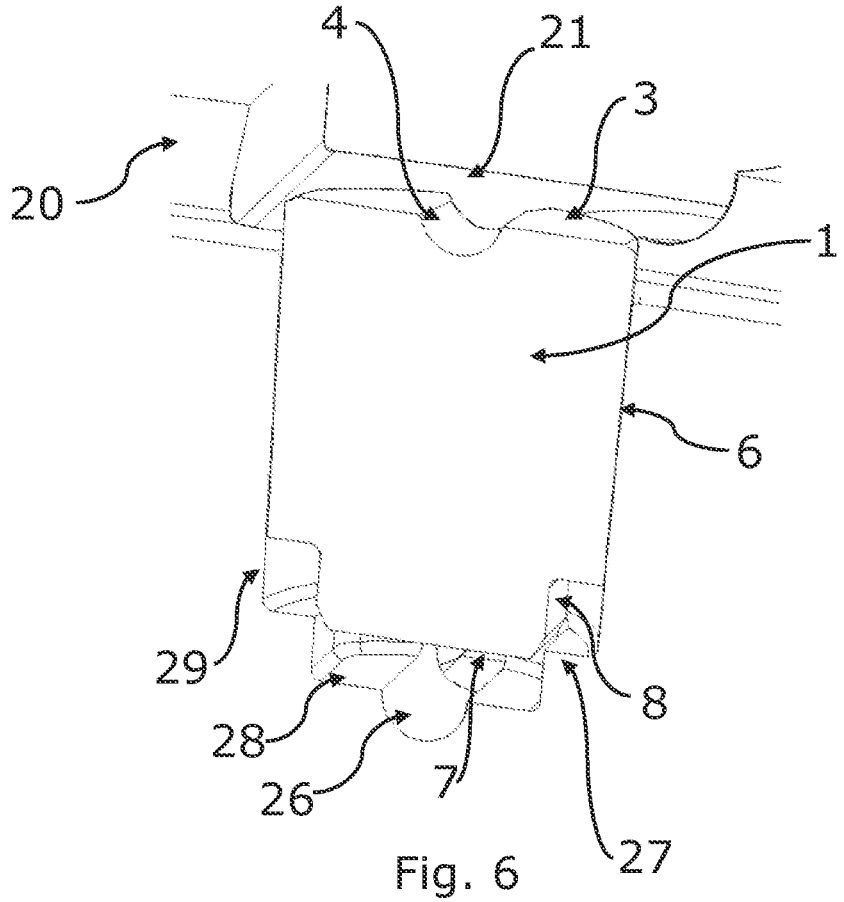
FIG. 6 is a side view of a cross-section of a die holder and die, the die not entirely mounted into the die holder.

FIG. 6 is a side view of a cross-section of a die holder 20 and die 1, the die 1 not entirely mounted into the bore 30 in the die holder 20. The die 1 has a side surface 6 shaped for press fit by contact with an inner surface 29 of the bore 30 in the die holder 20. The press fit serves to interlock the die 1 within the bore 30 of the die holder 20. At the lower portion of the die 1 there are two opposite recesses 8 serving to engage with a lower shoulder surface 27 of the die holder 20, in order to fix angular orientation of the groove 4 relative to the die holder 20. Furthermore, when the bottom surface 7 of the die 1 engage with the bottom surface 28 of the die holder 20, the top surface 3 of the die 1 becomes flush or plane with the top surface 21 of the die holder 20.

Figure 7:
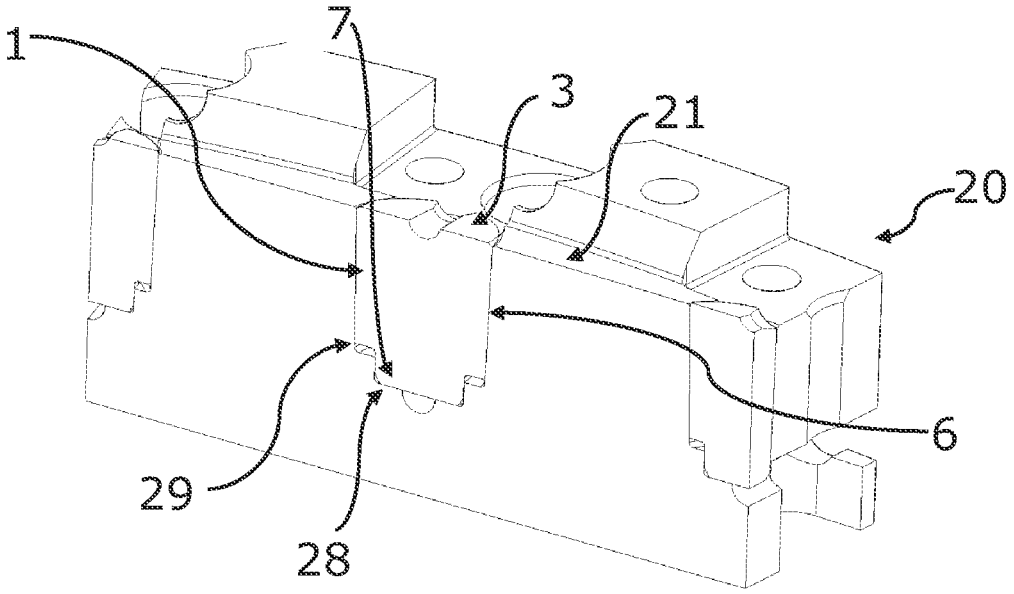
FIG. 7 is a side view of a cross-section of a die holder and die, the die pressed into the die holder.

FIG. 7 is a side view of a cross-section of a die holder 20 and die 1, the die 1 pressed into the die holder 20. The side surface 6 of the die interlocks with the inner surface 29 of the bore and the bottom surface 7 of the die 1 functions as a stop surface for engaging with the bottom surface 28 in the bore of the die holder 20, so as to determine the height of the top surface 3 of the die 1 in relation to the top surface 21 of the die holder 20.

Figure 8:
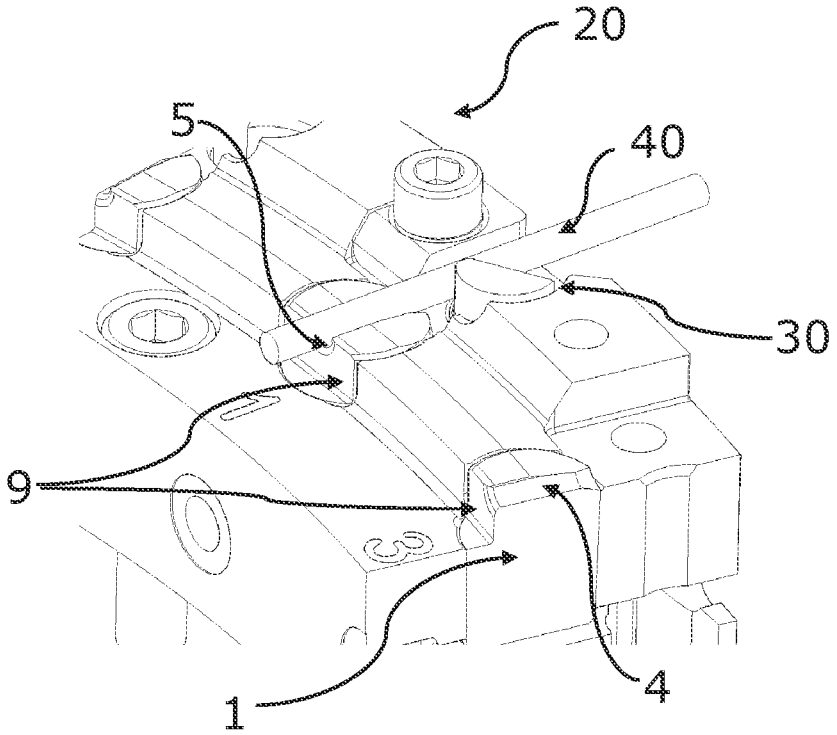
FIG. 8 is a trimetric view of an elongate body fixed in a die and a die holder embodiment.

FIG. 8 is a trimetric view of an elongate body 40 fixed in a die 1 and a ring-shaped die holder 20. The elongate body 40 is placed in the groove 4 of the die 1 and is furthermore locked in place by a locking mechanism 30. Part of the elongate body 40 protrudes at the recess 5 of the cut-out surface 9 of the die 1, seated to be formed onto the head of a nail.

Figure 9:
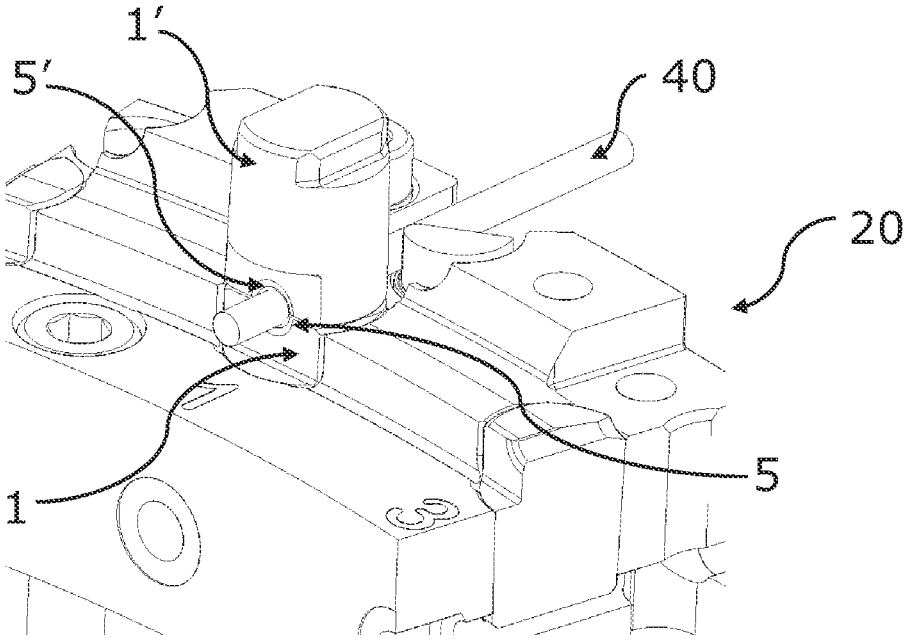
FIG. 9 is a trimetric view of an elongate body fixed between two corresponding dies and a section of a die holder.

FIG. 9 is a trimetric view of an elongate body 40 fixed between two corresponding dies 1, 1' and a section of a ring-shaped die holder 20. The recesses 5, 5' on each die 1, 1' forms the shape of the head of a nail, when the two dies 1, 1' are positioned with their corresponding top surfaces facing towards each other and their grooves aligned.

Figure 10:
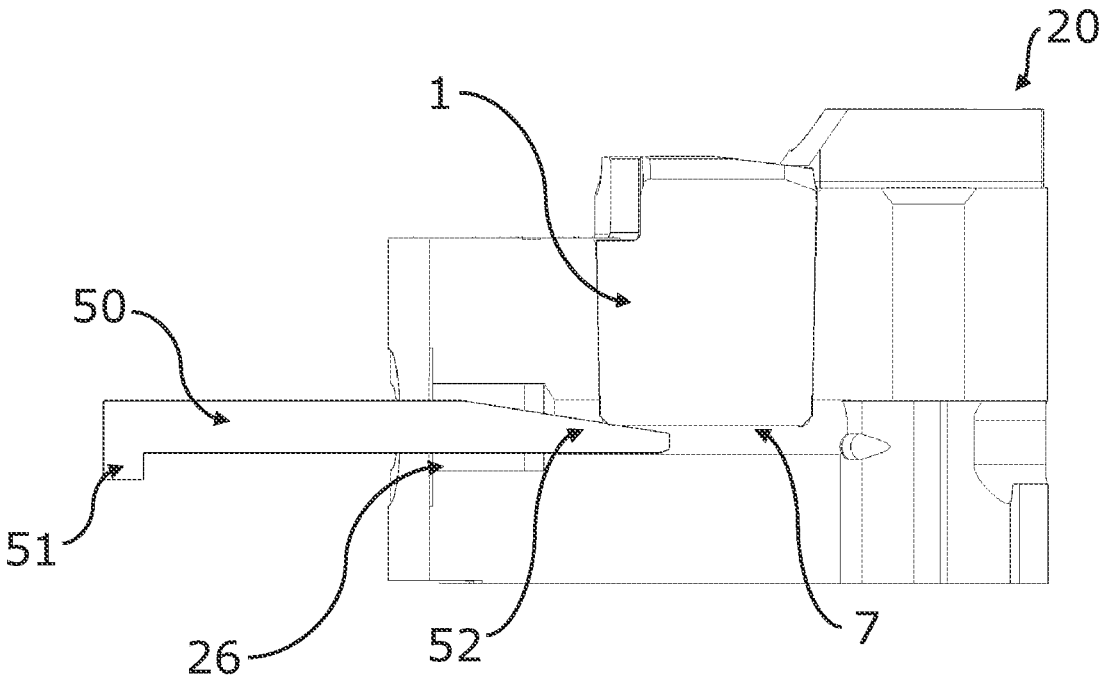
FIG. 10 is a side view of a cross-section of an elongate tool, placed in an opening of a die holder, between the die holder and a die, according to an embodiment.

FIG. 10 is a side view of a cross-section of an elongate tool 50, placed in an opening 26 of a die holder 20, between the die holder 20 and a die 1, according to the subject application. The elongate tool has a tapered tip 52 abutting the bottom surface 7 of the die 1. Furthermore, the back end of the elongate tool 50 has a protrusion 51 to indicate to an operator how to orient the elongate tool about a longitudinal axis. When the elongate tool 50 is forced towards the die 1, the die 1 is forced away from the die holder 20, releasing the die 1 from the die holder 20 for maintenance of the die holder 20 or die 1.

Figure 11:
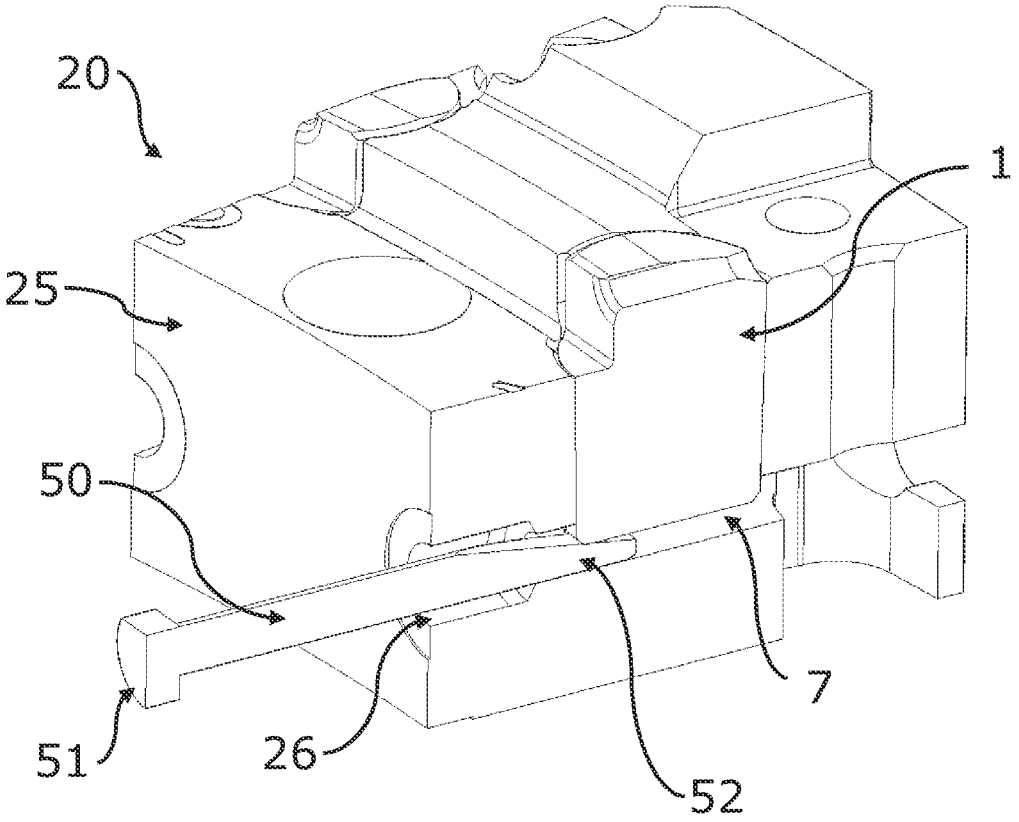
FIG. 11 is a trimetric view of a cross-section of an elongate tool, placed in an opening of a die holder, between the die holder and a die.

FIG. 11 is a trimetric view of a cross-section of an elongate tool 50, placed in an opening 26 on the inner side 25 of a ring-shaped die holder 20, between the die holder 20 and a die 1, according to the subject application. When the opening 26 is located at the inner side 25 of the ring-shaped die holder 20, the opening is unobstructed with the die holder 20 mounted for normal operation. The elongate tool 50 has a tapered tip 52 abutting the bottom surface 7 of the die 1. Furthermore, the back end of the elongate tool 50 has a protrusion 51 to indicate to an operator how to orient the elongate tool 50 about a longitudinal axis. When the elongate tool 50 is forced towards the die 1, the die 1 is forced away from the die holder 20, releasing the die 1 from the die holder 20 for maintenance of the die holder 20 or die 1.

Figure 12:
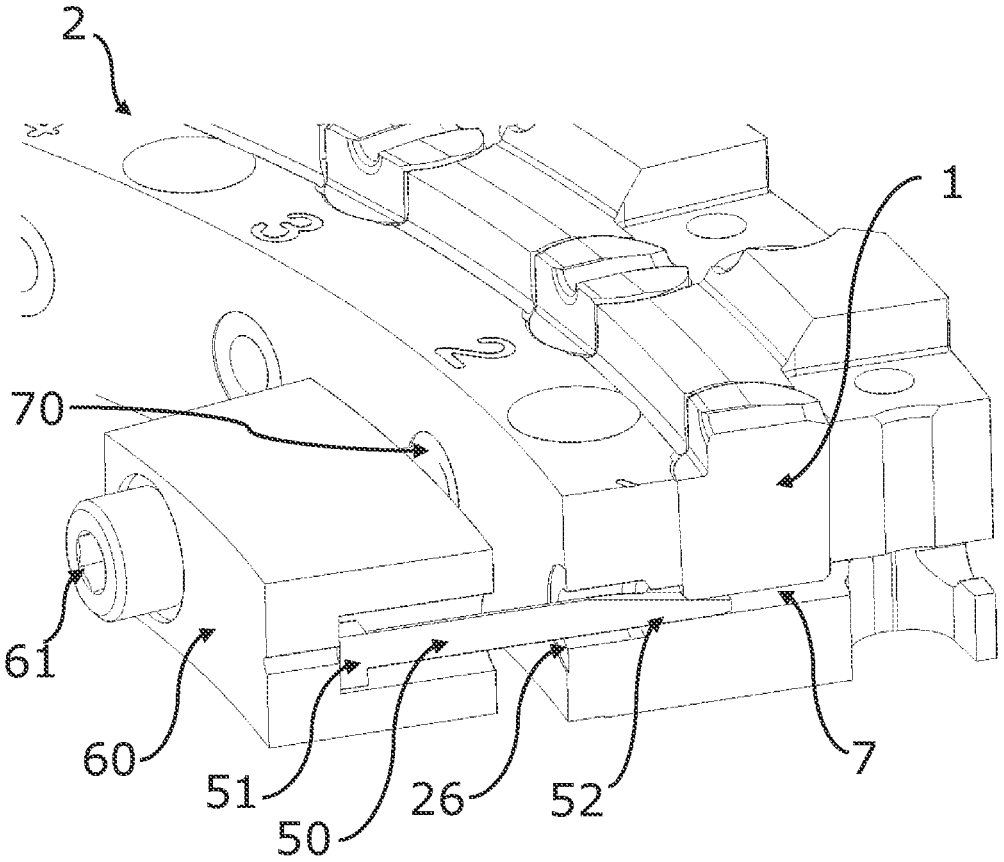
FIG. 12 is a trimetric view of a cross-section of an elongate tool and associated press tool, the press tool mounted on the die holder.

FIG. 12 is a trimetric view of a cross-section of an elongate tool 50 and associated press tool 60, the press tool 60 mounted on the die holder 20, according to the subject application. The press tool 60 is mounted through a bolt 61 engaging with a threaded section 70 of a neighbouring opening 26, in relation to the opening 26, which the elongate tool 50 is positioned within. When the press tool 60 is placed on the back end 51 of the elongate tool 50 and the bolt 70 is turned so as to move inwards according to the threading 70, towards the die holder 20, force is applied to the elongate tool 50. As a result, the elongate tool 50 and hence the tapered tip 52 is forced towards the die 1 and the die 1 is forced away from the die holder 20, releasing the die 1 from the die holder 20 for maintenance of the die holder 20 or die 1.

Figure 13:
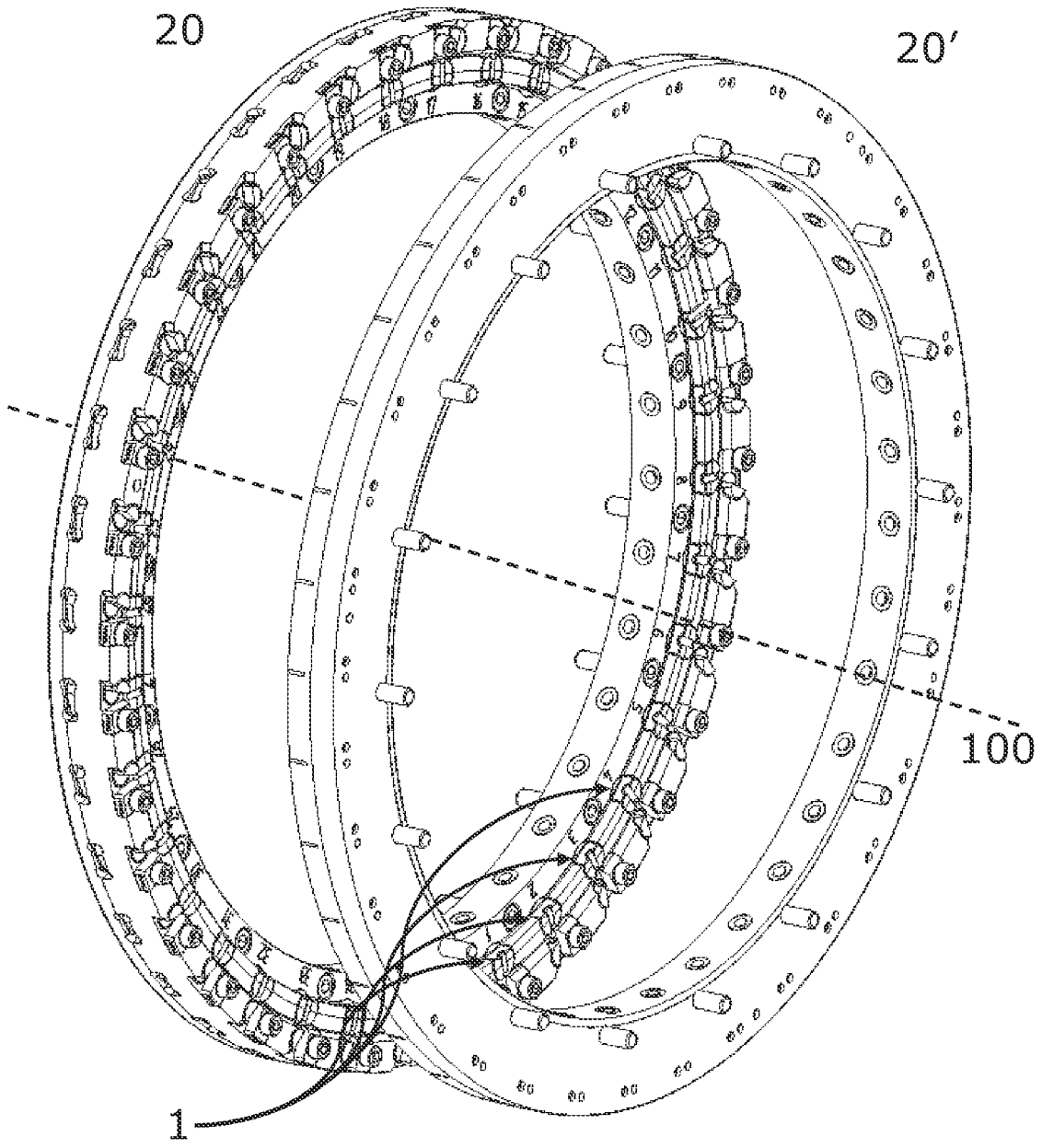
FIG. 13 is a side view of two ring-shaped die holders oriented towards each other, such as for forming part of a nail producing machine.

FIG. 13 is a trimetric view of two ring-shaped die holder embodiments 20, 20' oriented towards each other. The ring-shaped die holders 20, 20' have a central axis of rotation 100, about which they are arranged to rotate. A plurality of dies 1 are positioned within the die holders 20, 20' around the circumference. The dies 1 are mounted on each of the die holders 20, 20' are arranged facing towards each other. Especially, one of the die holders 20, the bores or holes for the dies are parallel with the axis of rotation 100, while on the other die holder 20', the bores or holes for the dies are slightly angled.

Figure 14:
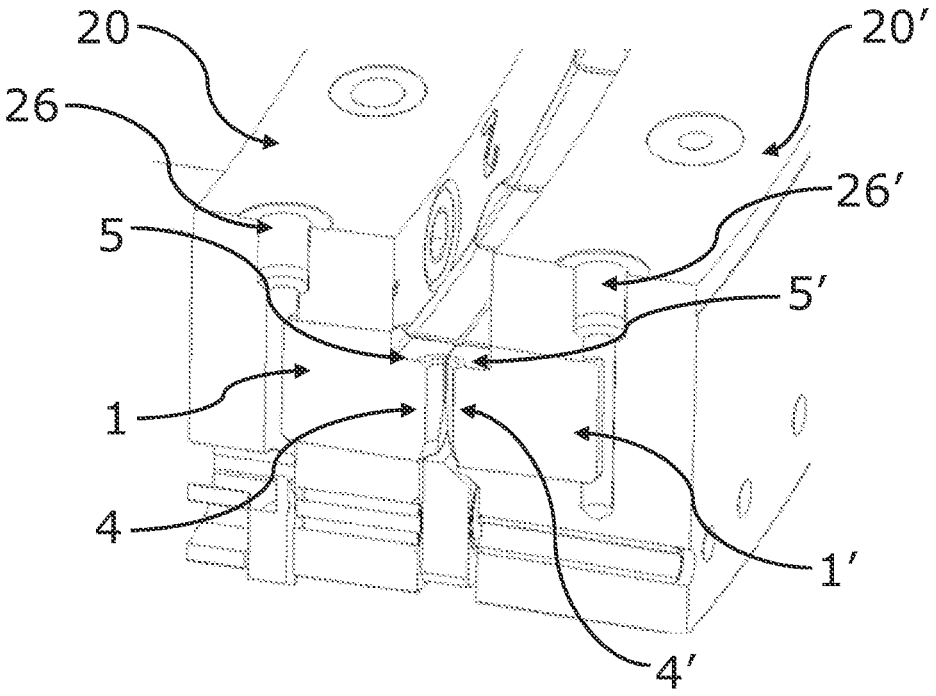
FIG. 14 is a cross-section of a side view of two corresponding dies mounted in two corresponding die holders.

FIG. 14 is a cross-section of a side view of two corresponding dies 1, 1' mounted in two corresponding ring-shaped die holders 20, 20', according to the subject application. The dies 1, 1' are aligned with their grooves 4, 4' and recesses 5, 5' facing each other. Furthermore the openings 26, 26' are illustrated, extending towards the dies 1, 1'.

Figure 15:
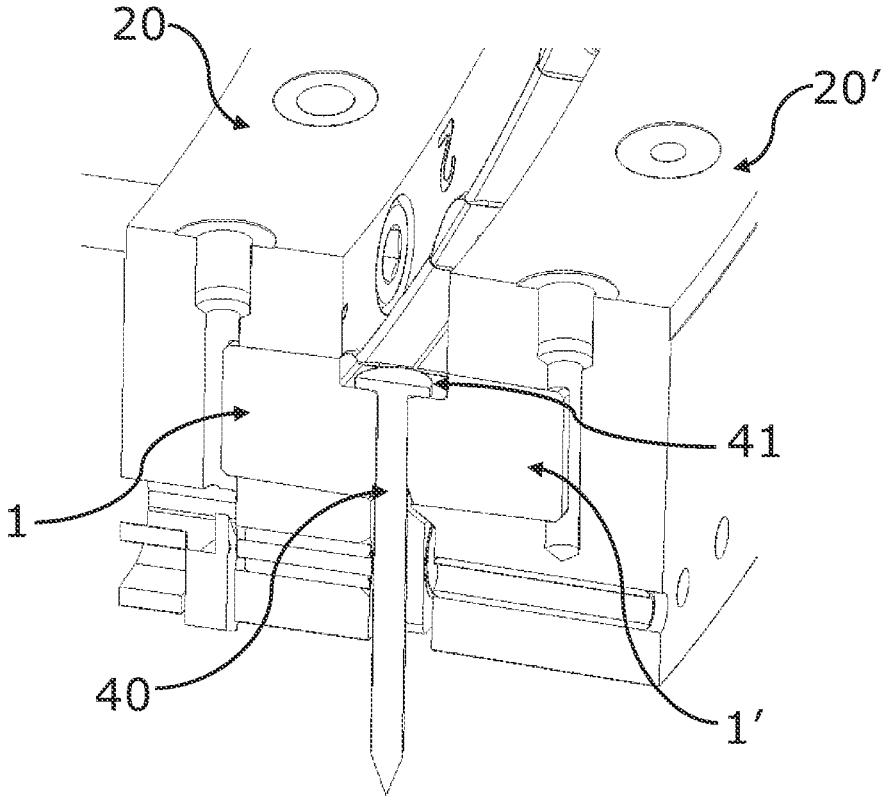
FIG. 15 is a cross-section of a side view of a nail, fixed between two corresponding dies mounted in two corresponding die holders.

FIG. 15 is a cross-section of a side view of an elongate body 40 formed into a nail with a head 41, fixed between two corresponding dies 1, 1' mounted in two corresponding ring-shaped die holders 20, 20', according to the subject application.

Figure 16:
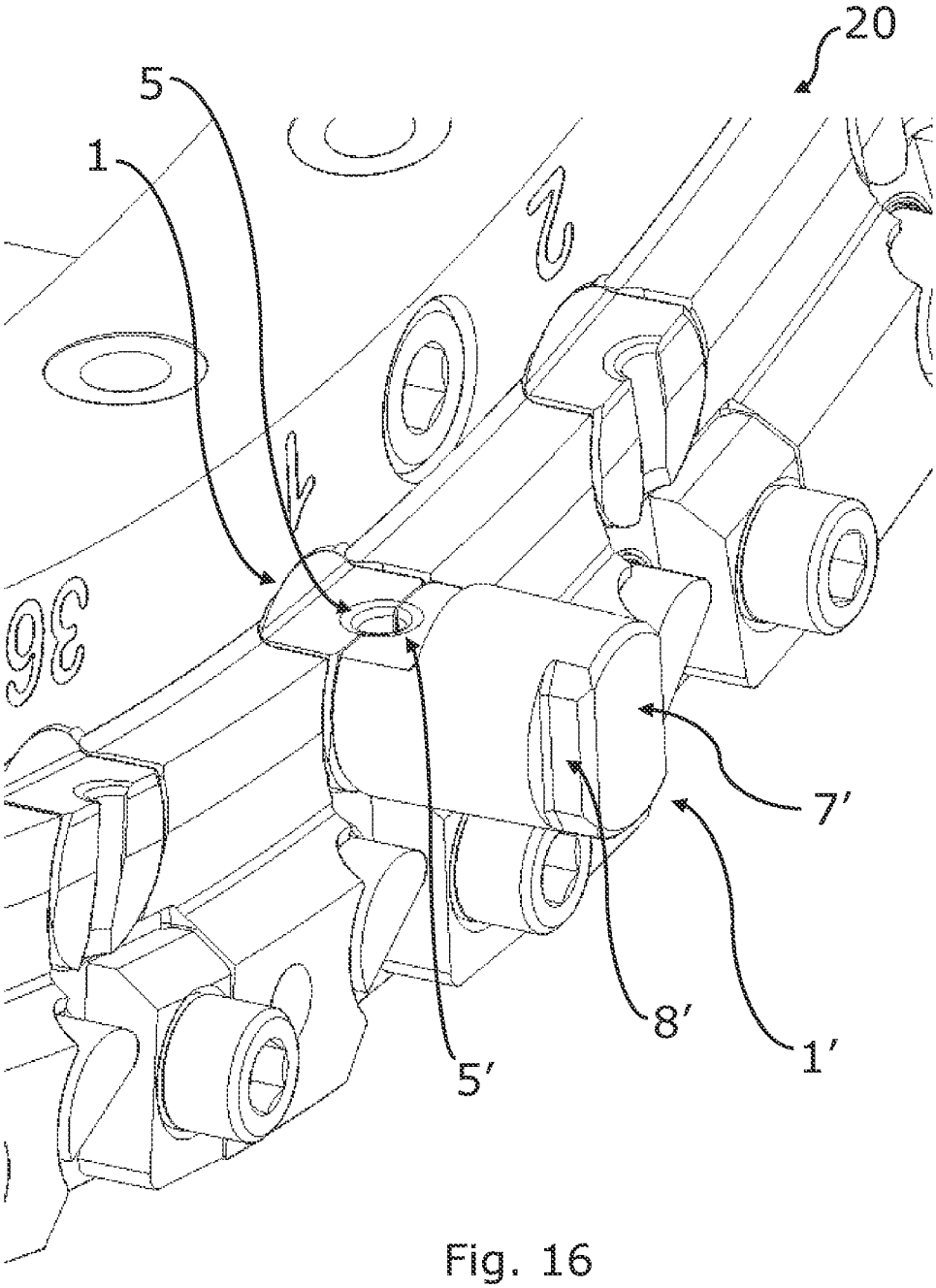
FIG. 16 is trimetric view of a section of a ring-shaped die holder with a mounted die and a corresponding, free-floating die to illustrate cooperation of recesses of two dies for producing a head on a nail.

FIG. 16 is trimetric view of a section of a ring-shaped die holder 20 with a mounted die 1 and a corresponding, free-floating die 1'. The two opposing dies 1, 1' form the head of a nail with their corresponding recesses 5, 5'. The figure illustrates how the die 1 is seated in the die holder 20 by observing the visible bottom surface 7' of the floating die 1' and the recess 8' shaped to ensure angular fixation of the groove on the top surface of the die 1'.

Figures 17A, 17B, 17C:
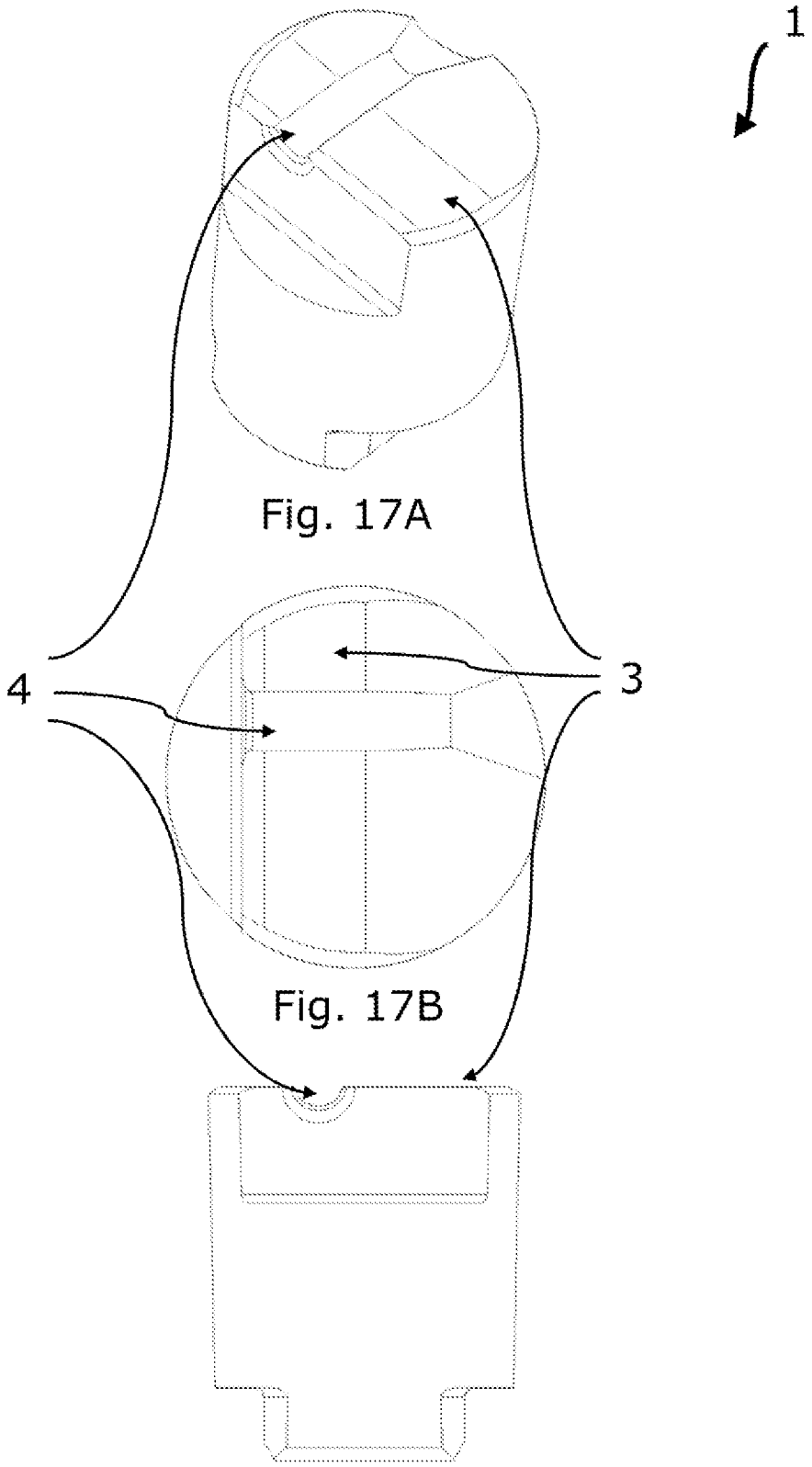
FIGS. 17A, 17B and 17C show three different views of an alternative die.

FIG. 17 shows three different views of an alternative die embodiment, where the groove is offset from a longitudinal axis through the body of the die from top surface 3 to bottom of the die body. FIG. 17A is a trimetric view of a die 1, the die 1 having a groove 4 which is off-center in relation to the top surface 3 of the die 1. FIG. 17B is a top view of a die 1, the die 1 having a groove 4 which is off-center in relation to the top surface 3 of the die 1. FIG. 17C is a side view of a die 1, the die 1 having a groove 4 which is off-center in relation to the top surface 3 of the die 1.

Figure 18:
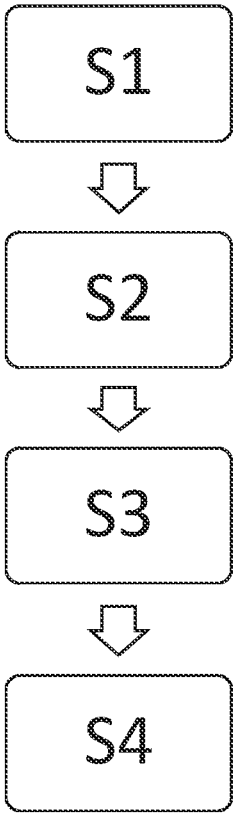
FIG. 18 is a flow-chart of a method according to the subject application.

FIG. 18 is a flow-chart of a method embodiment for manufacturing a head on an elongate body, such as metal nails or screws, the method comprising:

S1 providing first and second die holders, each of the first and second die holders comprising:

1. a body having at least a substantially plane top surface part,
2. a hole or bore in the substantially plane top surface part, wherein the hole or bore has an inner surface shaped for receiving the die and for press fit by contact with a side surface of the die,
3. a stop part located in the hole or bore for engaging with a bottom surface of the die when being pressed into the hole or bore, so as to fix a height of the top surface of the die in relation to the top surface part of the die holder, and
4. a protrusion or recess serving to engage with a corresponding recess or protrusion of the die, in order to fix angular orientation of the groove of the die relative to the die holder.

S2 providing first and second dies, each of the first and second dies comprising:

1. a body with a top surface provided with a through-going groove for receiving and holding an elongate body longitudinally in said groove,
2. a recess at one end of the groove suitable for forming the head on the elongate body,
3. a side surface shaped for press fit by contact with an inner surface of a bore or hole in the associated die holder,
4. a bottom surface for engaging with a stop part in the hole or bore of the associated die holder, so as to determine a height of the top surface of the die in relation to a surface part of the associated die holder, and
5. a recess or protrusion serving to engage with a corresponding protrusion or recess of the associated die holder, in order to fix angular orientation of the groove relative to the die holder, S3 bringing the top surface of the first die so near to the top surface of the second die that the grooves of the first and second dies hold the elongate body, and S4 providing force onto the elongate body at the recess end of the grooves so as to form a head on the elongate body.

In a further embodiment, the method may comprise the step of removing the die by pushing a bottom part of the die, such as by a dedicated tool, through an opening in the die holder.

Figure 19:
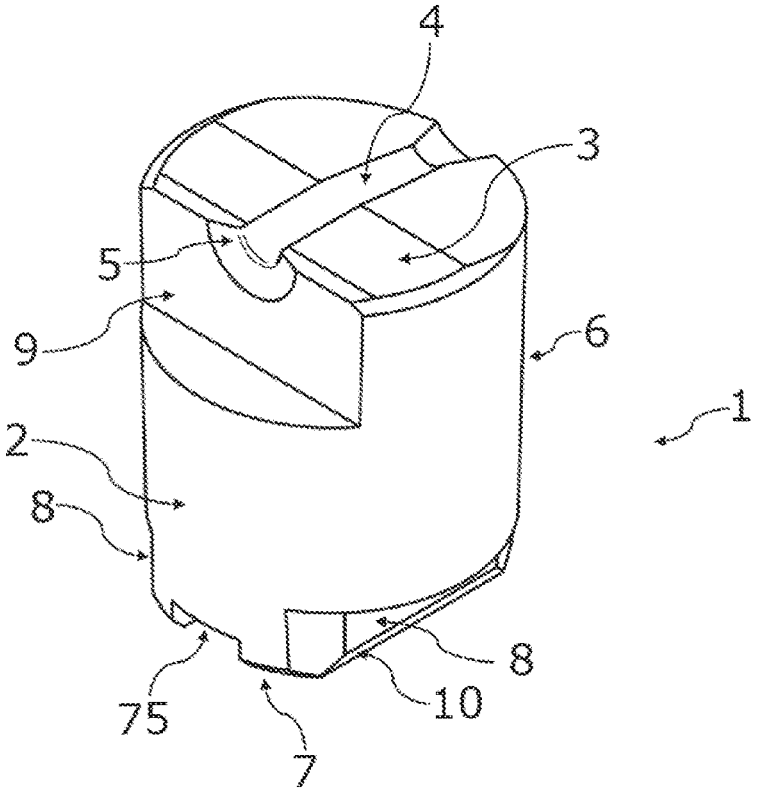
FIG. 19 is a trimetric view of a die embodiment with a groove at a bottom surface.

FIG. 19 is a trimetric view of a die 1 embodiment with a groove 75 at a bottom surface 7. The figure illustrates a die 1 for mounting in an associated die holder for the production of heads on elongate bodies, such as a metal nail or screw. The die 1 comprises a body 2 with a top surface 3. The top surface has a through-going groove 4 suitable for receiving and holding the elongate body longitudinally in the groove 4. The groove 4 may have gripper marks (not visible) for increased friction with the elongate body to improve the holding effect. The body 2 of the die 1 has a cut-out surface 9 on one side and the cut-out surface 9 has a recess 5, which extends from the cut-out surface 9 and merges into the groove 4. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder.

On the bottom surface 7, a groove 75 has been cut into the body 2 of the die 1. The purpose of this groove 75 is to allow an elongate tool with a tip matching the groove 75 to engage with the groove in order to push the die 1 upwards, when press fit mounted in a die holder. Especially, such elongate tool can be inserted in an opening in the die holder and thus facilitate removing the die for replacement.

Figure 20:
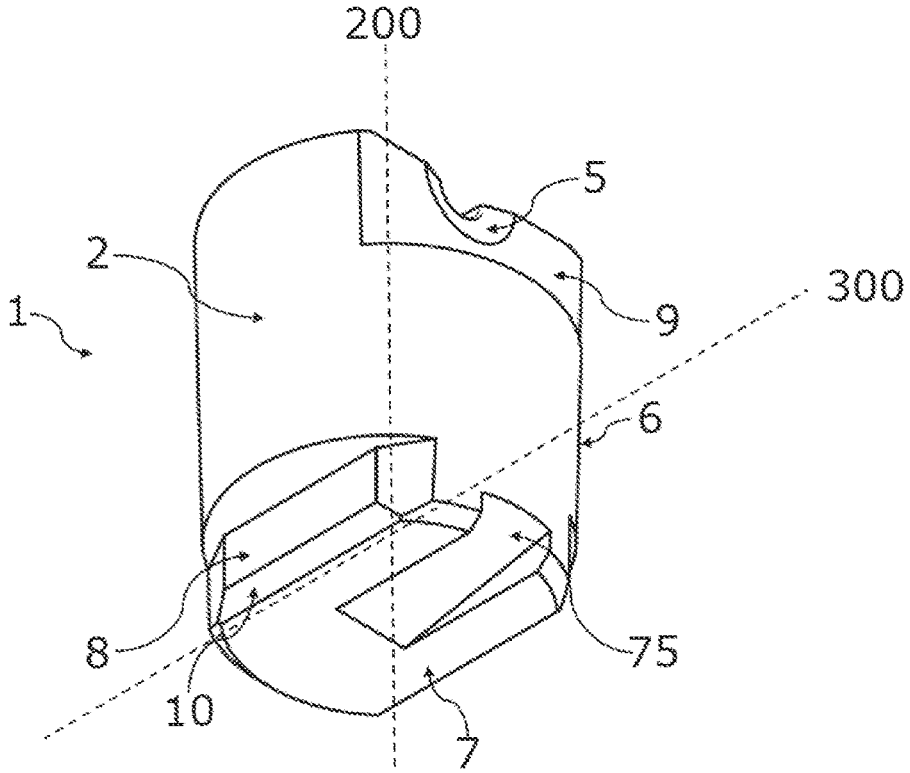
FIG. 20 is another trimetric view of a die embodiment with a groove at a bottom surface.

FIG. 20 is another trimetric view of a die 1 embodiment with a groove 75 at a bottom surface 7. The figure illustrates a die 1 for mounting in an associated die holder for the production of heads on elongate bodies, such as a metal nail or screw. The die 1 comprises a body 2 with a cut-out surface 9 on one side and the cut-out surface 9 has a recess 5, which extends from the cut-out surface 9. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 (one recess not shown) serving to engage with a corresponding protrusion of the associated die holder, in order to fix angular orientation of the groove 4 relative to the die holder.

On the bottom surface 7, an inclined groove 75 has been cut into the body 2 of the die 1. In the present embodiment, the inclined groove 75 is a plane surface being parallel with an axis 300 perpendicular to a central axis/length axis 200 of the die 1. The angle of inclination is preferably 2°-20°. The inclined plane surface helps to provide a force in an upward direction to drive out the die 1 from a die holder. The tool preferably has a tip with an inclination angle matching the inclination angle of the plane surface of the groove 75. An example of such tool will be given below.

Figure 21:
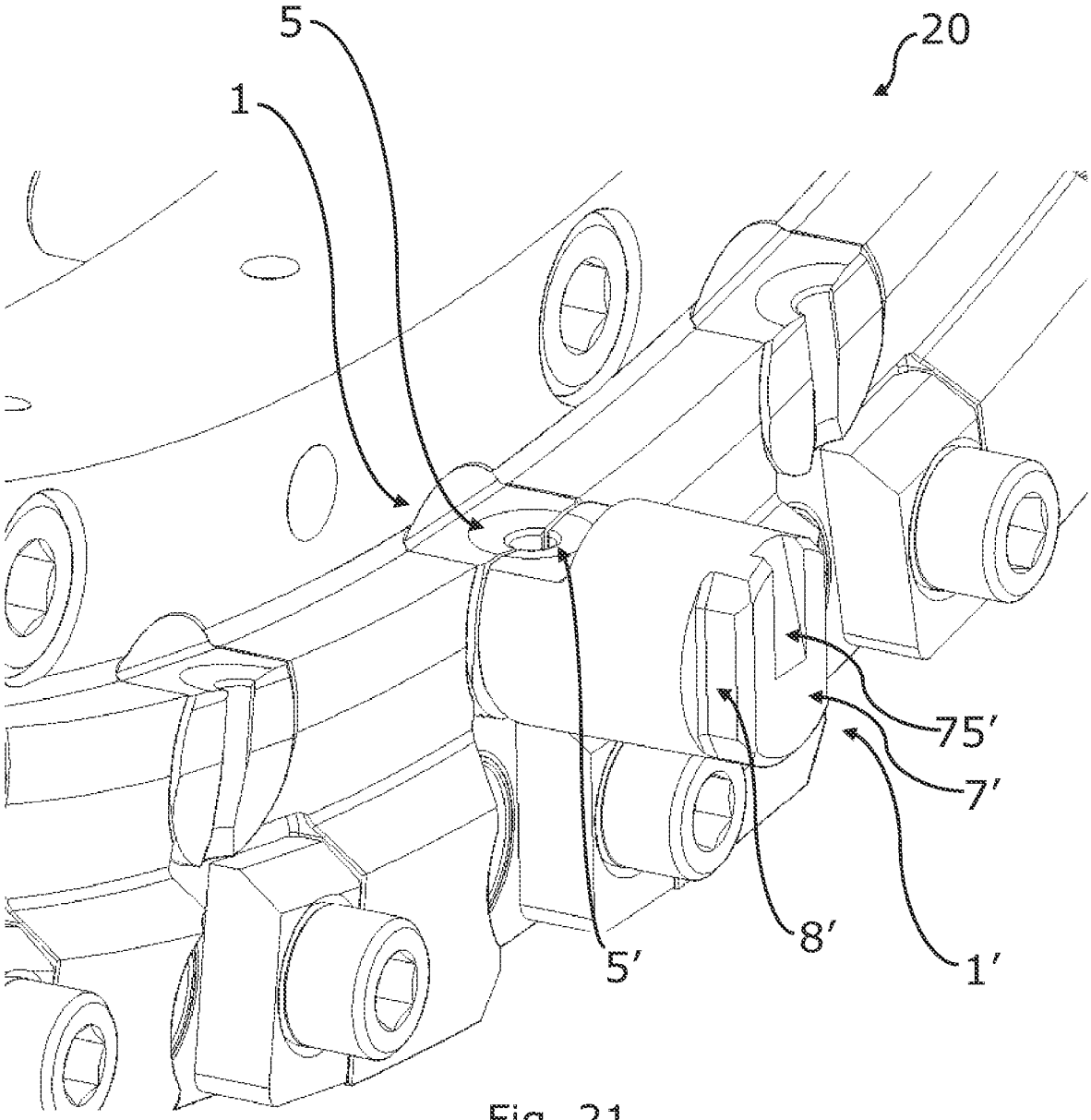
FIG. 21 is trimetric view of a section of a ring-shaped die holder with a mounted die and a corresponding, free-floating die, with an inclined groove to illustrate cooperation of recesses of two dies for producing a head on a nail.

FIG. 21 is trimetric view of a section of a ring-shaped die holder with a mounted die and a corresponding, free-floating die, with an inclined groove to illustrate cooperation of recesses of two dies for producing a head on a nail. The two opposing dies 1, 1' form the head of a nail with their corresponding recesses 5, 5'. The figure illustrates how the die 1 is seated in the die holder 20 by observing the visible bottom surface 7' of the floating die 1' and the recess 8' shaped to ensure angular fixation of the groove on the top surface of the die 1'. On the bottom surface 7 of the floating die 1', an inclined groove 75' is visible, i.e. a groove 75' with the functionality as explained for the groove 75 above.

Preferably, the die holder 20 is a monolithic element made of metal, preferably a metal which is softer than the metal or other material which forms the associated dies to be press fit in the holes or bores 30. The dies are preferably made of a hard material, e.g. a hard metal, to provide a long life time. By the press fitting principle, the hard material die is securely fastened in the hole or bore 30, thus providing optimal support of the edge of the hard material die, thereby providing a long life time of the die.

The holes or bores 30 each has an inner surface shaped for receiving a die and for press fit by contact with the side surface of the die. In the hole or bore 30, a stop part is formed so as to allow engagement with a stop surface of the die when the die is being pressed into the hole or bore, so as to fix a height of a top surface of the die in relation to the top surface part of the die holder 20. Further, the die holder 20 has a protrusion or recess serving to engage with a corresponding recess or protrusion of the die, in order to fix angular orientation of the die relative to the die holder, thereby facilitating precise angular orientation of the die during the mounting in the die holder 20, e.g. after replacement of the die.

Examples of the stop part and protrusion or recess for angular orientation fixing of the die can be seen in FIGS. 4-7. These features may be made in the die holder 20 by a milling process in the hole or bore 30.

Figure 22:
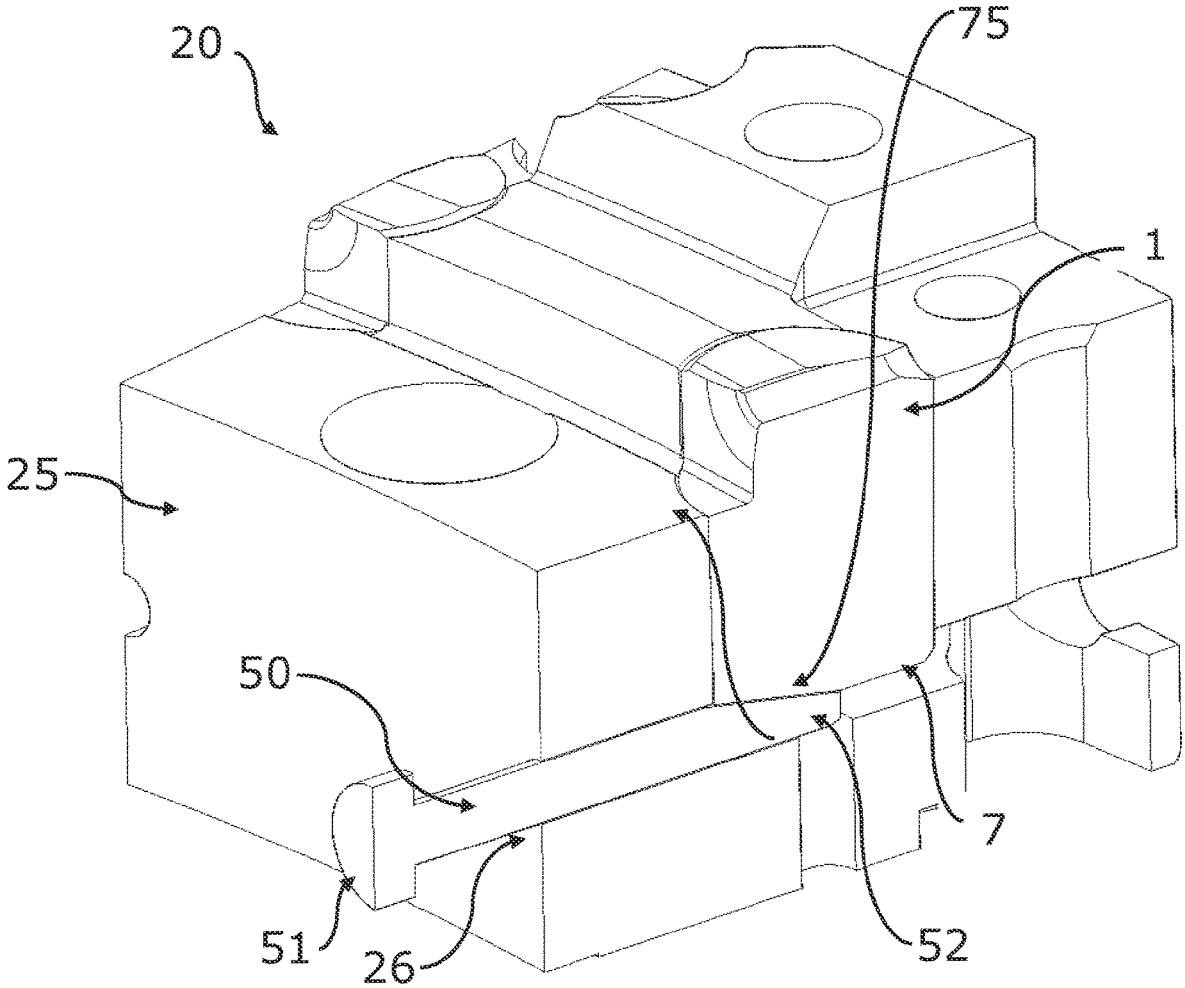
FIG. 22 is a trimetric view of a cross-section of an elongate tool, placed in an opening of a die holder, between the die holder and a die with an inclined groove at the bottom surface.

FIG. 22 is a trimetric view of a cross-section of an elongate tool 50, placed in an opening 26 on the inner side 25 of a ring-shaped die holder 20, between the die holder 20 and a die 1, according to the subject application. When the opening 26 is located at the inner side 25 of the ring-shaped die holder 20, the opening is unobstructed with the die holder 20 mounted for normal operation. The elongate tool 50 has an inclined tip 52 abutting a corresponding inclined groove 75 on the bottom surface 7 of the die 1. Furthermore, the back end of the elongate tool 50 has a protrusion 51 to indicate to an operator how to orient the elongate tool 50 about a longitudinal axis. When the elongate tool 50 is forced towards the die 1, the die 1 is forced away from the die holder 20, releasing the die 1 from the die holder 20 for maintenance of the die holder 20 or die 1.

Figure 23:
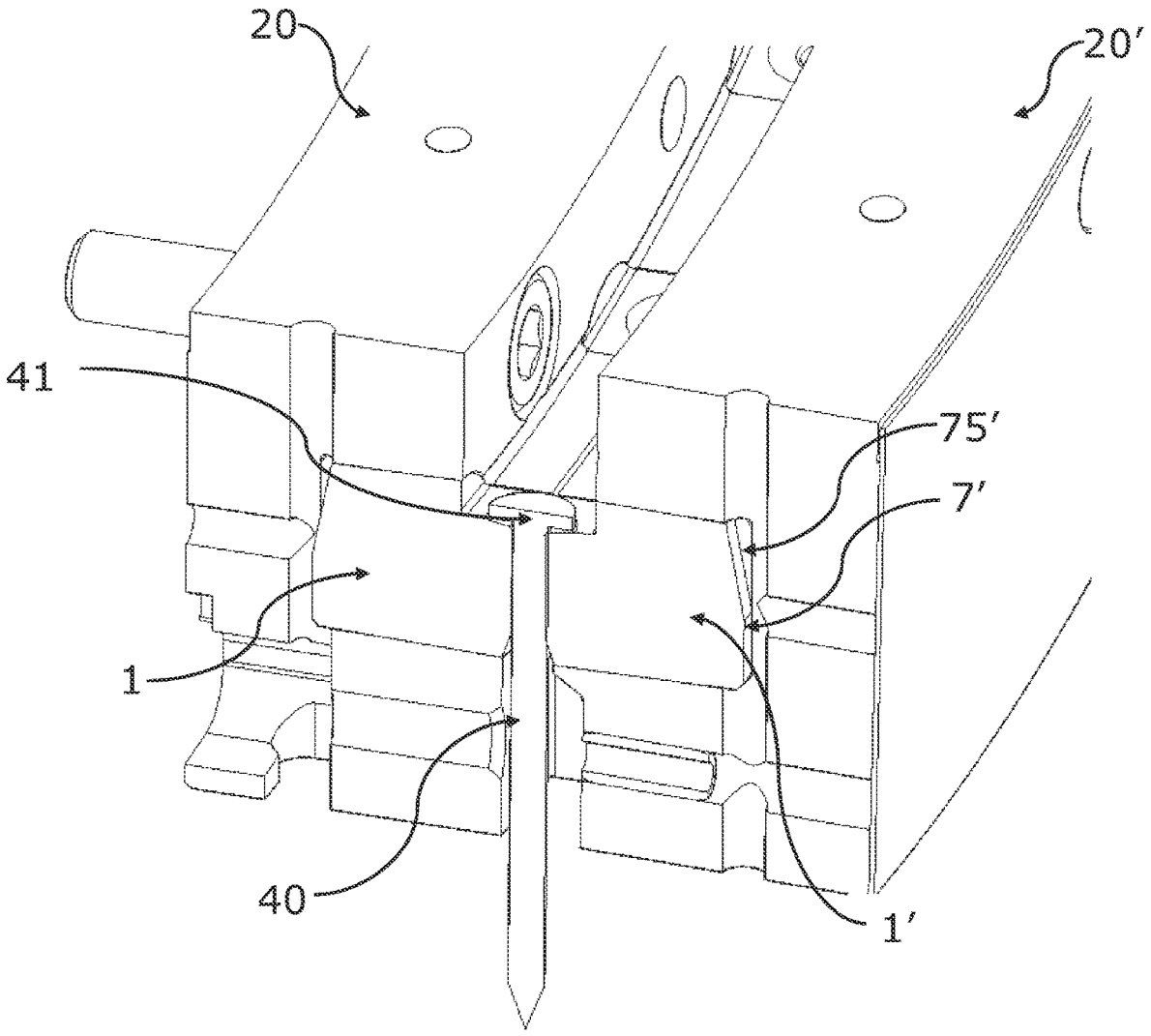
FIG. 23 is a cross-section of a side view of an elongate body formed into a nail with a head, fixed between two corresponding dies with an inclined groove at the bottom surface.

FIG. 23 is a cross-section of a side view of an elongate body 40 formed into a nail with a head 41, fixed between two corresponding dies 1, 1' mounted in two corresponding ring-shaped die holders 20, 20', according to the subject application. On the bottom surface 7' of the die 1', an inclined groove 75' is visible.

Figure 24:
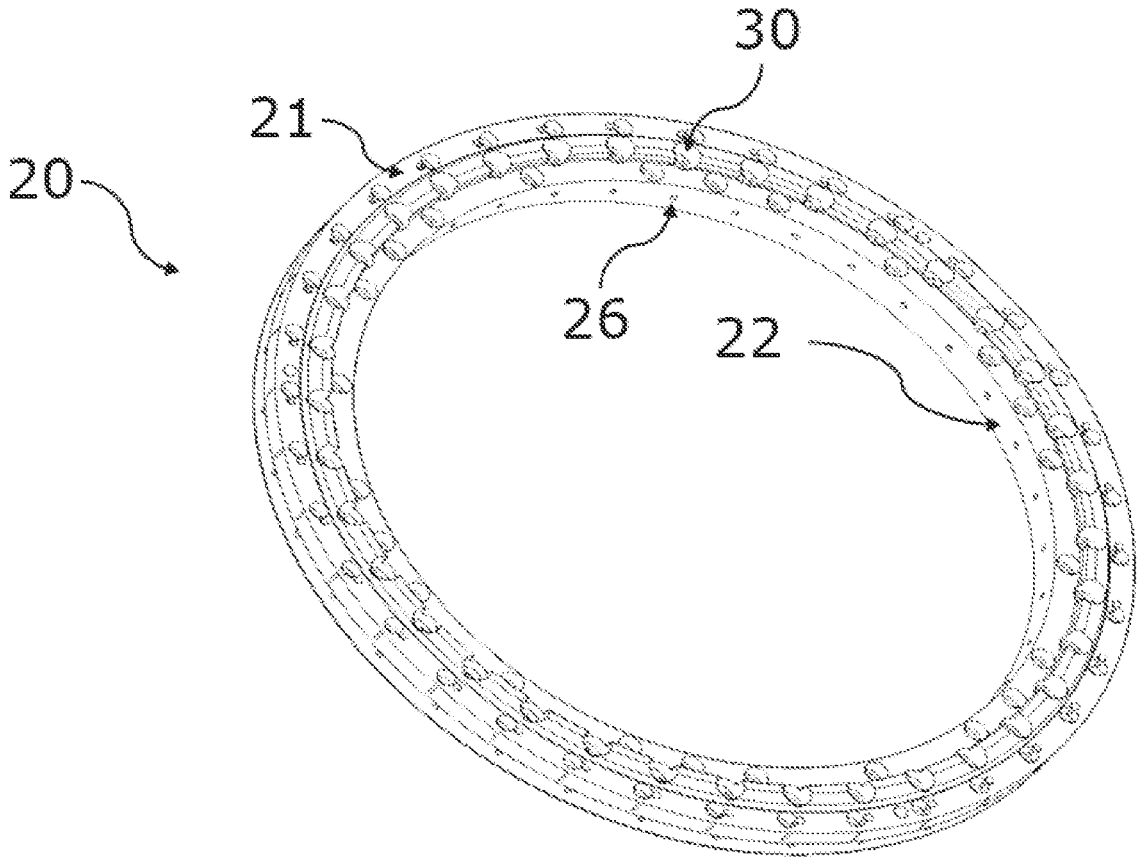
FIG. 24 is a trimetric view of a die holder embodiment in the form of a tool ring for a nail producing machine for holding 36 dies.

FIG. 24 is a trimetric view of an embodiment of a die holder 20 in the form of a ring shaped tool ring for a nail manufacturing machine. The die holder 20 comprises a top surface 21 with a plurality of evenly distributed holes or bores 30 each formed to receive a die shaped for press fit mounting. The die holder 20, further comprises a side surface 22 with openings 26, corresponding to each of the holes or bores 30. These openings 26 serve to insert an elongate tool for removing the dies when press fit mounted in the holes or bores 30.

Figure 25:
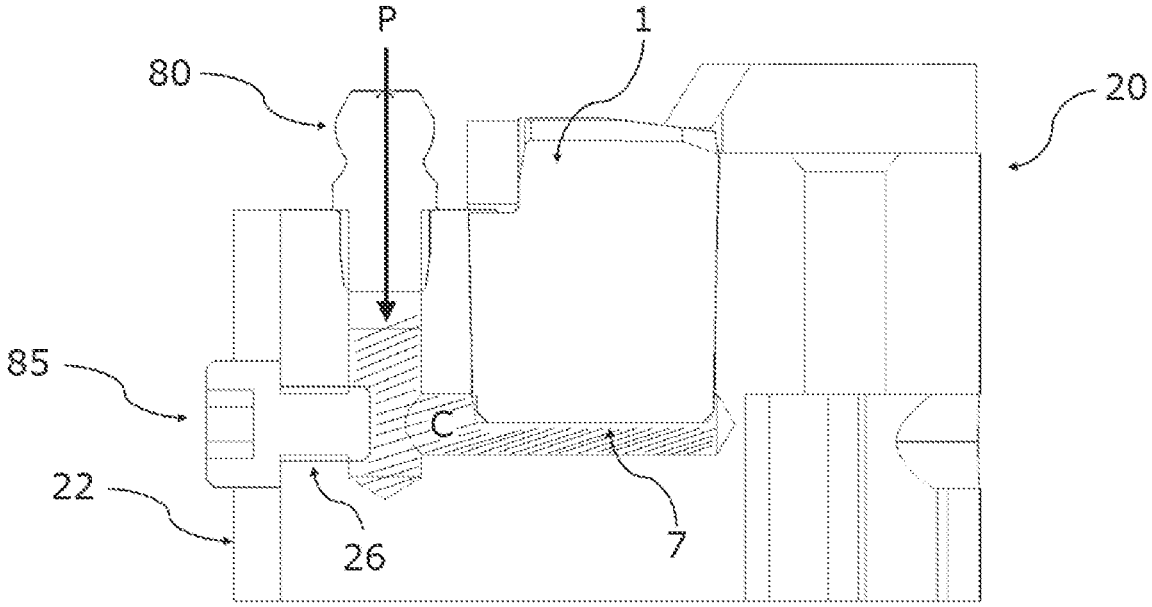
FIG. 25 is a side view of a cross-section of a die holder and die, the die pressed into the die holder with a bushing attached to the die holder.

FIG. 25 is a side view of a cross-section of a die holder 20 and die 1, the die 1 being pressed into the die holder 20 with a bushing 80 attached to the die holder 20. In order to remove the die 1 from the die holder 20, a hydraulic pressure P may be applied into a cavity C within the die holder 20, so as to eject the die 1 from said die holder 20. In order to contain the hydraulic pressure P within the cavity C, a plug 85 has been inserted into the opening 26 in the side surface 22 of the die holder 20.

Figure 26:
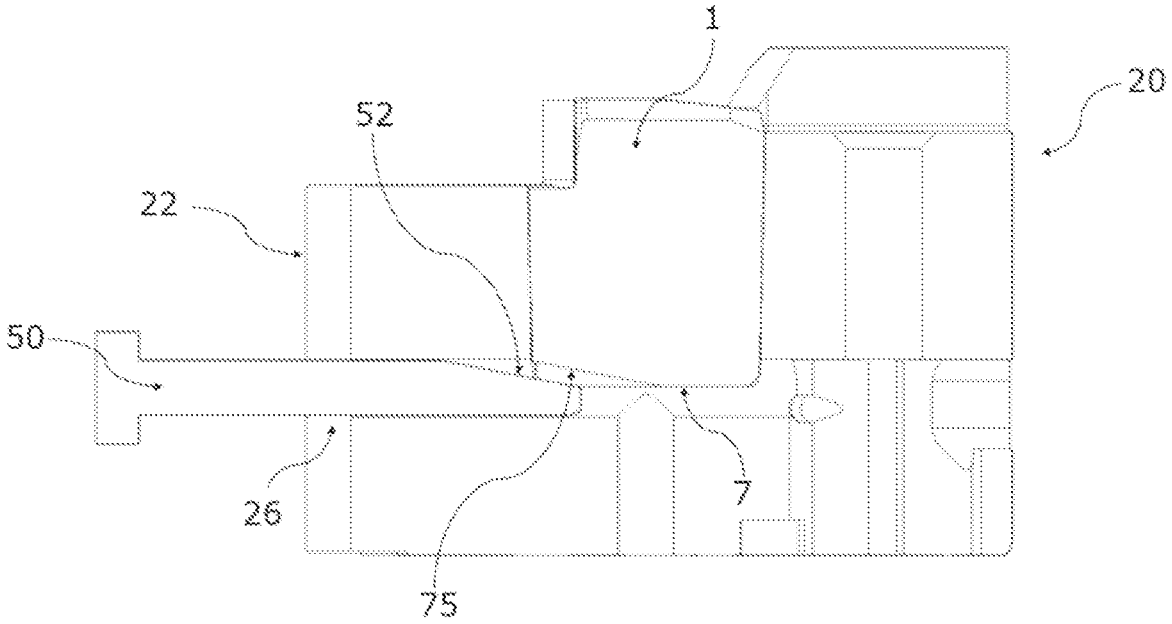
FIG. 26 is a side-view of a cross-section of an elongate tool, placed in an opening of a die holder.

FIG. 26 is a side-view of a cross-section of an elongate tool 50, placed in an opening 26 of a die holder 20. The elongate tool 50 is inserted through the opening 26 of a side surface 22 of said die holder 20 and the figure illustrates how the inclined tip 52 on the elongate tool 50 corresponds to the inclination of the groove 75 on the bottom surface 7 of the die 1. In this way the elongate tool 50 can apply an upwards force on the die 1 based on a wedge principle.

Figure 27:
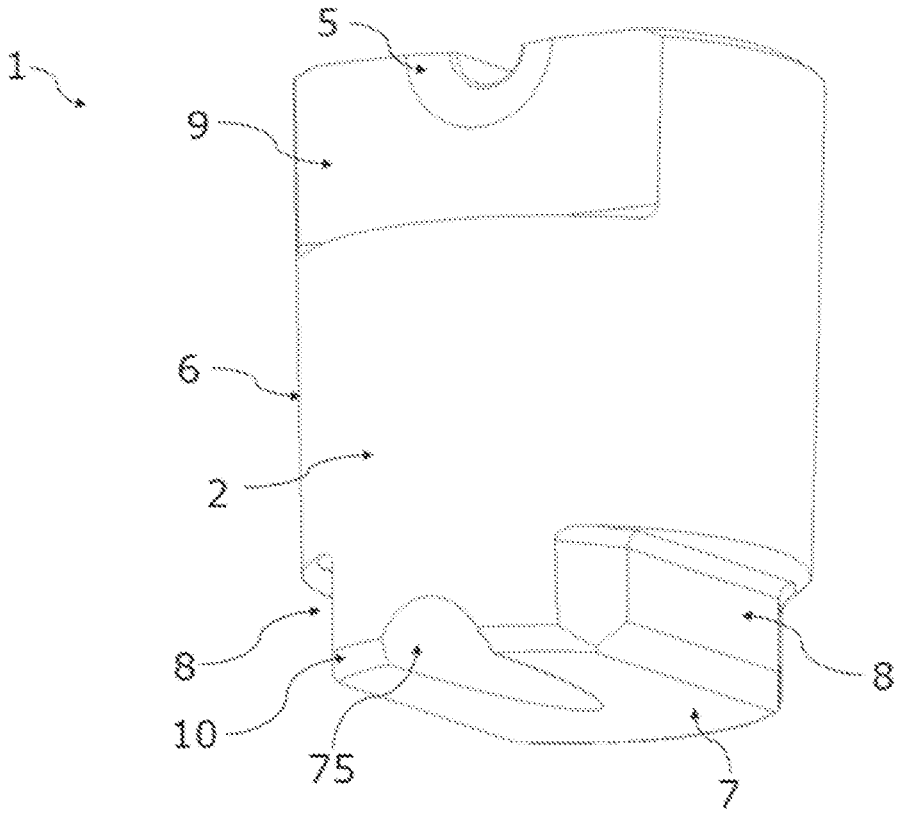
FIG. 27 is a trimetric view of a die embodiment with a rounded groove at a bottom surface.
Figure 28:
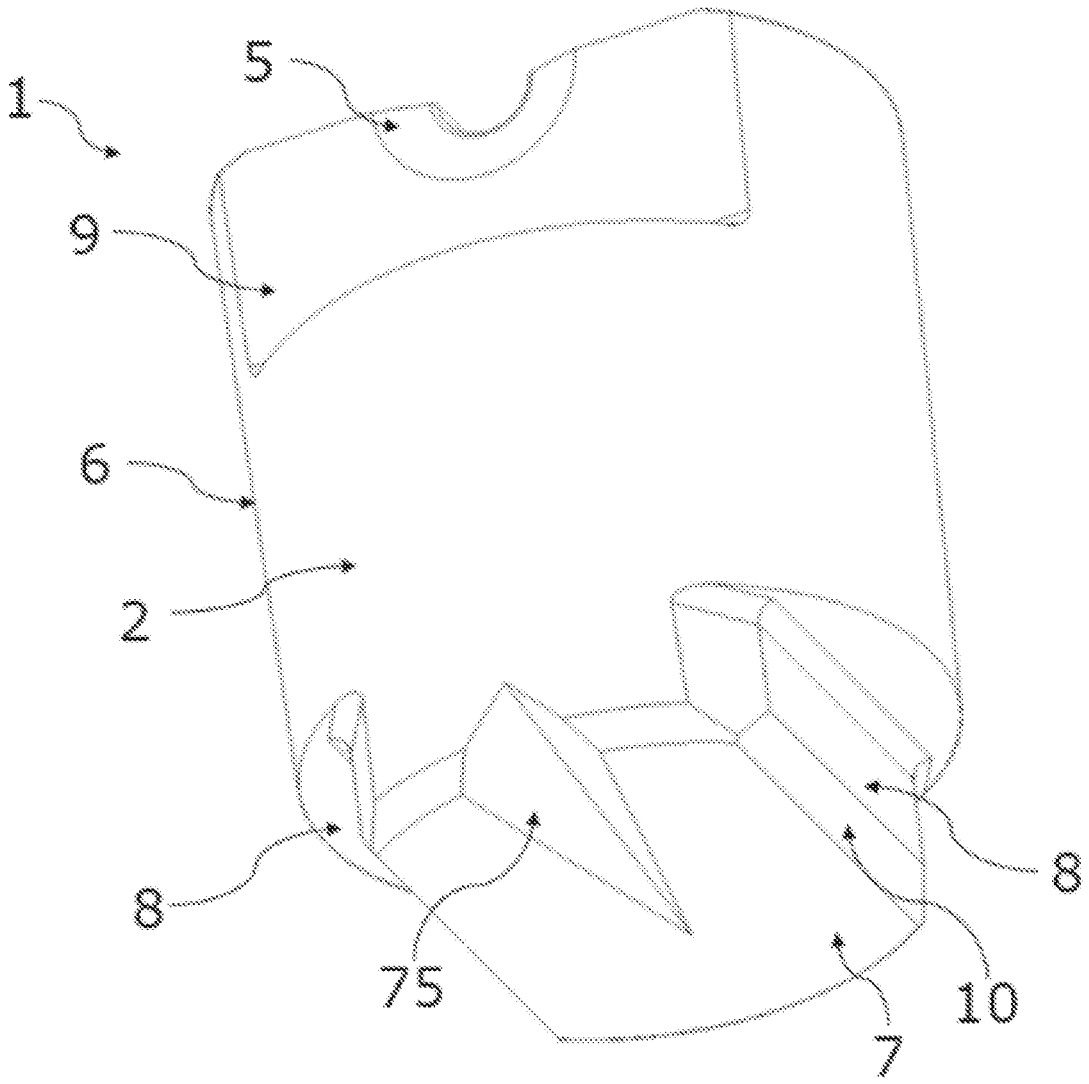
FIG. 28 is a trimetric view of a die embodiment with a v-shaped groove at a bottom surface.

FIGS. 27 and 28 serve to illustrate other examples of shapes of the groove 75 than the plane groove shape shown above. Preferably, as already described, an elongate tool for removing the die has a tip shaped to match the shape of the groove 75 of the die embodiments in FIGS. 27 and 28, i.e. rounded or v-shaped.

FIG. 27 is a trimetric view of a die 1 embodiment with a rounded groove 75 at a bottom surface 7. The figure illustrates a die 1 for mounting in an associated die holder for the production of heads on elongate bodies, such as a metal nail or screw. The die 1 comprises a body 2 with a cut-out surface 9 on one side and the cut-out surface 9 has a recess 5, which extends from the cut-out surface 9. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder. On the bottom surface 7, a rounded groove 75 has been cut into the body 2 of the die 1. The purpose of this groove 75 is to allow an elongate tool with a rounded tip matching the rounded groove 75 to engage with the groove in order to push the die 1 upwards, when press fit mounted in a die holder.

FIG. 28 is a trimetric view of a die 1 embodiment with a v-shaped groove 75 at a bottom surface 7. The figure illustrates a die 1 for mounting in an associated die holder for the production of heads on elongate bodies, such as a metal nail or screw. The die 1 comprises a body 2 with a cut-out surface 9 on one side and the cut-out surface 9 has a recess 5, which extends from the cut-out surface 9. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder. On the bottom surface 7, a v-shaped groove 75 has been cut into the body 2 of the die 1. The purpose of this groove 75 is to allow an elongate tool with a corresponding v-shaped tip matching the v-shaped groove 75 to engage with the groove in order to push the die 1 upwards, when press fit mounted in a die holder.

To sum up, the subject application provides a die (1) for mounting in an associated die holder (20) for the production of heads on elongate bodies such as nails or screws. The die has a body (2) with a top surface (3) provided with a through-going groove (4) for receiving and holding an elongate body longitudinally in said groove. Furthermore, the die has a recess in the form of a cut-out (9) on one side merging into the groove (4) at one end of the groove (4) suitable for forming the head of a nail or screw. The die is preferably shaped tapered or conical for press fit by contact with the inner surface of a bore or hole (30) in the associated die holder. The top surface (3) of the die (1) is plane in relation to the top surface (21) of the die holder (20) through a stop or bottom surface (7) which engages with a stop or bottom part (28) within the hole or bore (30) of the die holder (20). Furthermore, the bottom portion of the die has at least one recess (8) or protrusion serving to engage with a corresponding protrusion (27) or recess of the associated die holder, in order to fix angular orientation of the groove (4) relative to the die holder (20). In order to produce a nail or screw from an elongate body (40), two opposite dies are brought together by two opposite die holders, the dies together forming the head (41) with their combined recesses.

Figure 29:
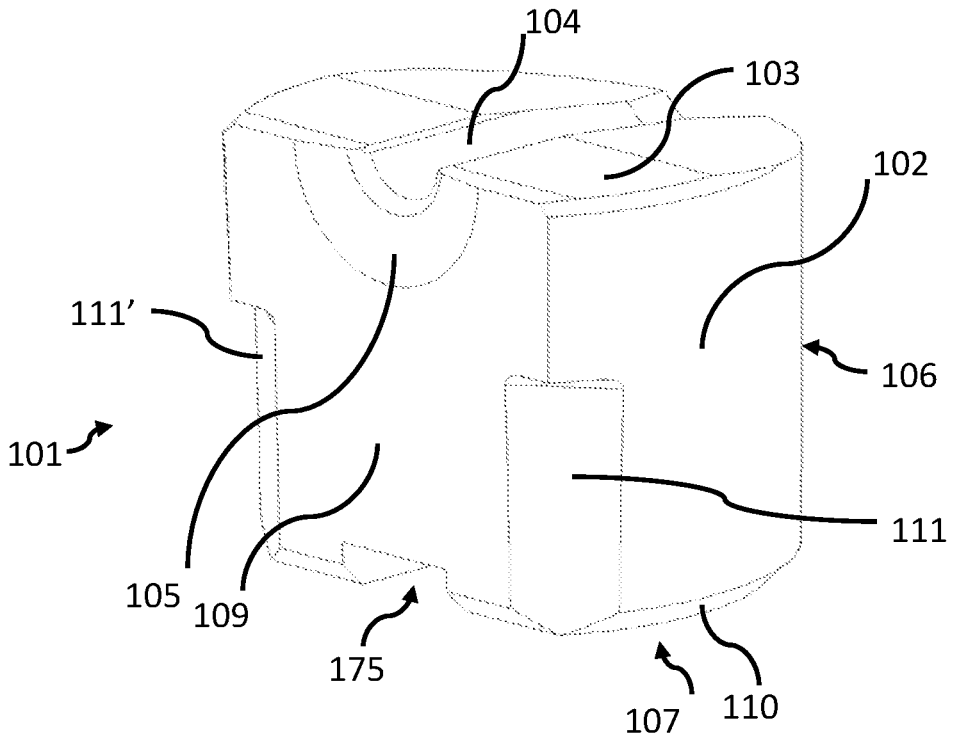
FIG. 29 is a trimetric view of a die embodiment.

FIG. 29 is a trimetric view of a die 101 embodiment. The figure illustrates a die 101 for mounting in an associated die holder (not shown) for the production of heads on elongate bodies, such as a metal nail or screw. The die 101 comprises a body 102 with a top surface 103. The top surface has a through-going groove 104 suitable for receiving and holding the elongate body longitudinally in the groove 104. The groove 104 may have gripper marks (not visible) for increased friction with the elongate body to improve the holding effect. The body 102 of the die 101 has a side surface 106 comprising a first, substantially round portion and a second portion 109. The second portion 109 has a recess 105, which extends from the second portion 109 and merges into the groove 104. The recess 105 is shaped to form half of the head on the elongate body. The side surface 106 is shaped for press fit by contact with an inner surface of a bore or hole in the associated die holder. The die 101 has a bottom surface 107 with a chamfer 110 for easy mounting of the die 101 into the hole or bore of the associated die holder. The second portion 109 of the side surface 106 is flat for higher durability and furthermore serves to engage with a corresponding flat surface of the associated die holder, in order to fix angular orientation of the groove 104 relative to the associated die holder. On the side surface 106 of the body 102 of the die 101, a first chamfered portion 111 and a second chamfered portion 111' is positioned, interconnecting the first portion of the side surface 106 with the second portion 109. In some embodiments of the die 101, the first and second chamfered portions 111, 111' extends from the bottom surface 107 to the top surface 103 of the die 101. On the bottom surface 107, a groove 175 has been cut into the body 102 of the die 101, extending from the bottom surface 107 to the second portion 109 of the side surface 106. The purpose of this groove 175 is to allow an associated elongate tool (not shown) with a tip matching the groove 175 to engage with the groove in order to push the die 101 upwards, when press fit mounted in an associated die holder 120. Especially, such elongate tool can be inserted in an opening in the associated die holder 120 and thus facilitate removing the die for replacement.

In some embodiments, the inclined groove 175 is a plane surface being parallel with an axis perpendicular to the central axis, as shown in FIG. 2 and FIG. 3, of the die 101. The angle of inclination is preferably 2°-20°. The inclined plane surface helps to provide a force in an upward direction to drive out the die 101 from a die holder. The tool preferably has a tip with an inclination angle matching the inclination angle of the plane surface of the groove 175.

Figure 30:
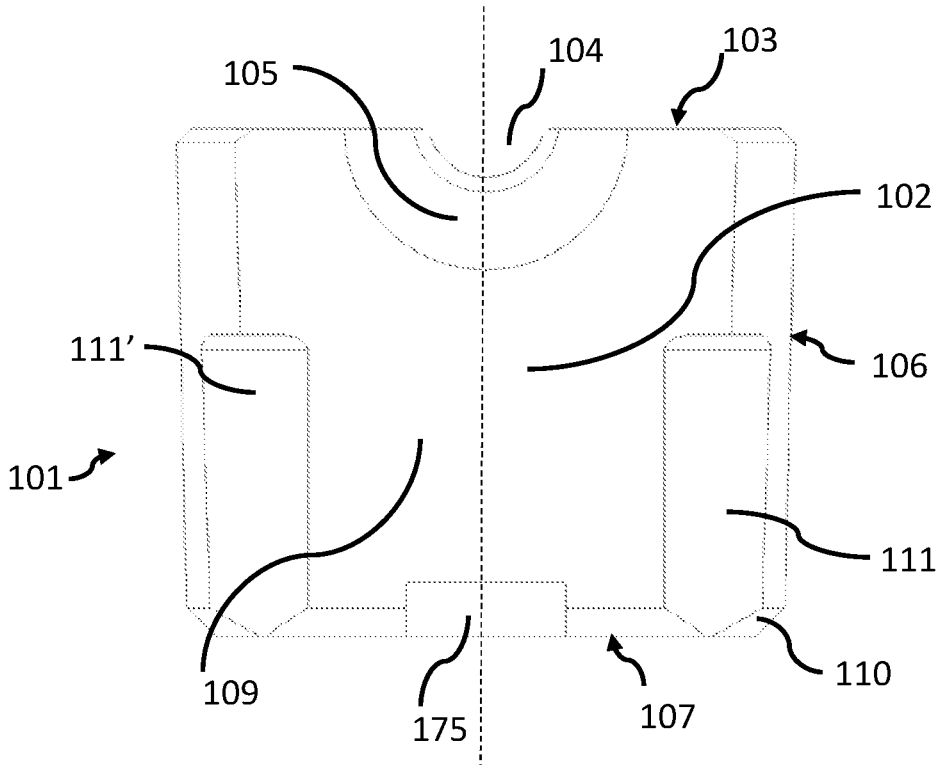
FIG. 30 is a frontal view of a die embodiment.

FIG. 30 is a side view of a die 101 embodiment having a conical shaped side surface 106. The figure illustrates the body 102 of the die 101 when viewed directly towards the second portion 109 of the side surface 106. The second portion has a recess 105, which merges into the groove 104 on the top surface 103 of the die 101. The recess 105 is substantially round, shaped so at to form half of the head of a nail or screw. On the side surface 106 of the body 102 of the die 101, a first chamfered portion 111 and a second chamfered portion 111' is positioned, interconnecting the first portion of the side surface 106 with the second portion 109. The side surface 106 of the die 101 is angled, suitable for press fitting into a corresponding shape of an associated die holder. The angle of the side surface 106 with a central axis (dotted line) of the body 102 is between one and two degrees in this particular embodiment, but could be in the range of a tenth of a degree to 5 degrees. The bottom surface 107 of the die 101 is chamfered 10 for easy insertion and guiding of the die 101 into the die holder. In some embodiments of the die 101, the first and second chamfered portions 111, 111' extends from the bottom surface 107 to the top surface 103 of the die 101. On the bottom surface 107, a groove 175 has been cut into the body 102 of the die 101, extending from the bottom surface 107 to the second portion 109 of the side surface 106.

Figure 31:
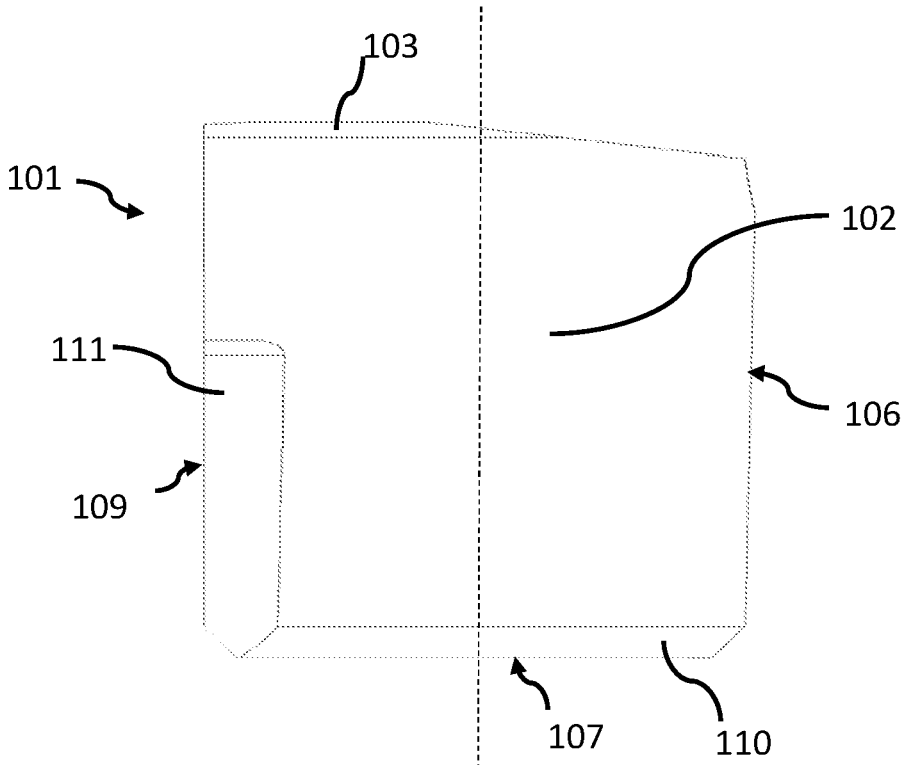
FIG. 31 is a side view of a die embodiment.

FIG. 31 is another side view of a die 101 embodiment having a conical shaped side surface 106. The figure illustrates the body 102 of the die 101 when viewed perpendicular, relative to the second portion 109 of the side surface 106. On the side surface 106 of the body 102 of the die 101, a first chamfered portion 111 and a second chamfered portion (not shown) is positioned, interconnection the first portion of the side surface 106 with the second portion 109. The side surface 106 of the die 101 is angled, suitable for press fitting into a corresponding shape of an associated die holder. The angle of the side surface 106 with a central axis (dotted line) of the body 102 is between one and two degrees in this particular embodiment, but could be in the range of a tenth of a degree to 5 degrees. The bottom surface 107 of the die 101 is chamfered 10 for easy insertion and guiding of the die 101 into the die holder.

Figure 32:
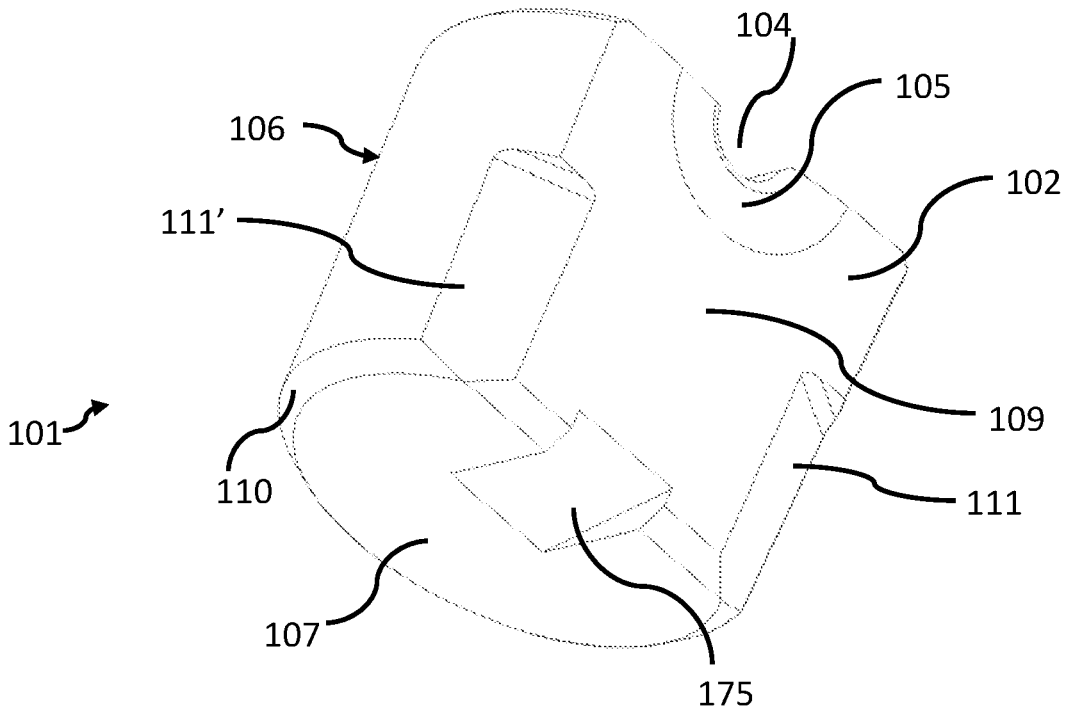
FIG. 32 is another trimetric view of a die embodiment.

FIG. 32 is another trimetric bottom view of a die 101 embodiment. The figure illustrates a die 101 for mounting in an associated die holder (not shown) for the production of heads on elongate bodies, such as a metal nail or screw. The body 102 of the die 101 has a side surface 106 comprising a first, substantially round portion and a second portion 109. The second portion 109 has a recess 105, shaped to form half of the head on the elongate body. The side surface 106 is shaped for press fit by contact with an inner surface of a bore or hole in the associated die holder. The die 101 has a bottom surface 107 with a chamfer 110 for easy mounting of the die 101 into the hole or bore of the associated die holder. The second portion 109 of the side surface 106 is flat for higher durability and furthermore serves to engage with a corresponding flat surface of the associated die holder, in order to fix angular orientation of the die 101, relative to the associated die holder. On the side surface 106 of the body 102 of the die 101, a first chamfered portion 111' is positioned, interconnecting the first portion of the side surface 106 with the second portion 109. On the bottom surface 107, a groove 175 has been cut into the body 102 of the die 101, extending to the second portion 109 of the side surface 106.

Figure 33:
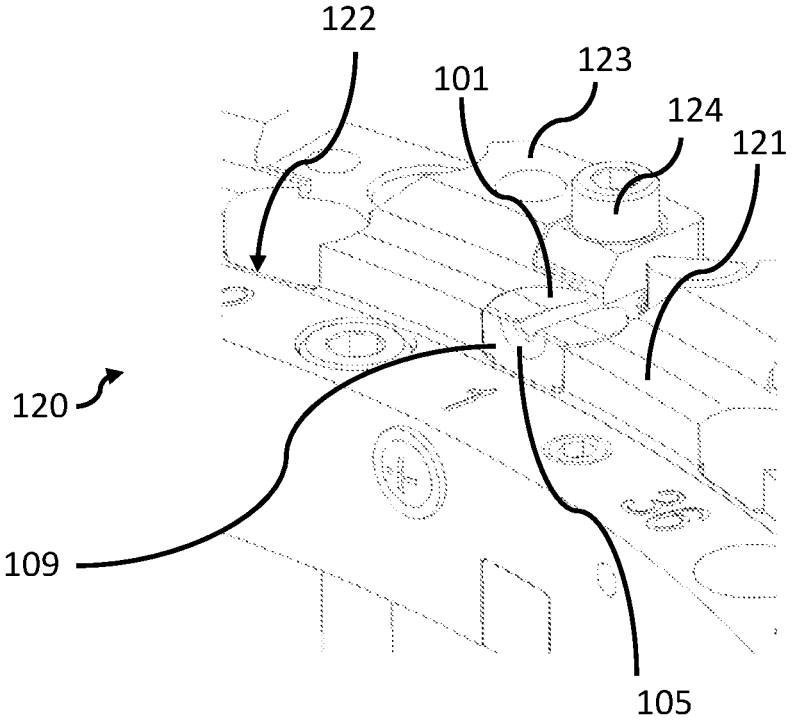
FIG. 33 is a trimetric view of a die holder with a mounted die embodiment.

FIG. 33 is a trimetric view of a section of a die holder 120 with a mounted die 101. The figure illustrates a mounted die 101 and a section of a rings-shaped die holder 120. A side surface 122 (not visible) of the die holder 120 is furthermore plane in respect to the second portion 109 of the side surface of the die 101, wherein the recess 105 of the die 101 for shaping the head of the elongate body is placed. On a third surface 123 of the die holder 120, parallel to the top surface 121 of the die holder 120, a pin or bolt 124 is seated for mounting the die holder 120 to a machine (not shown).

Figure 34:
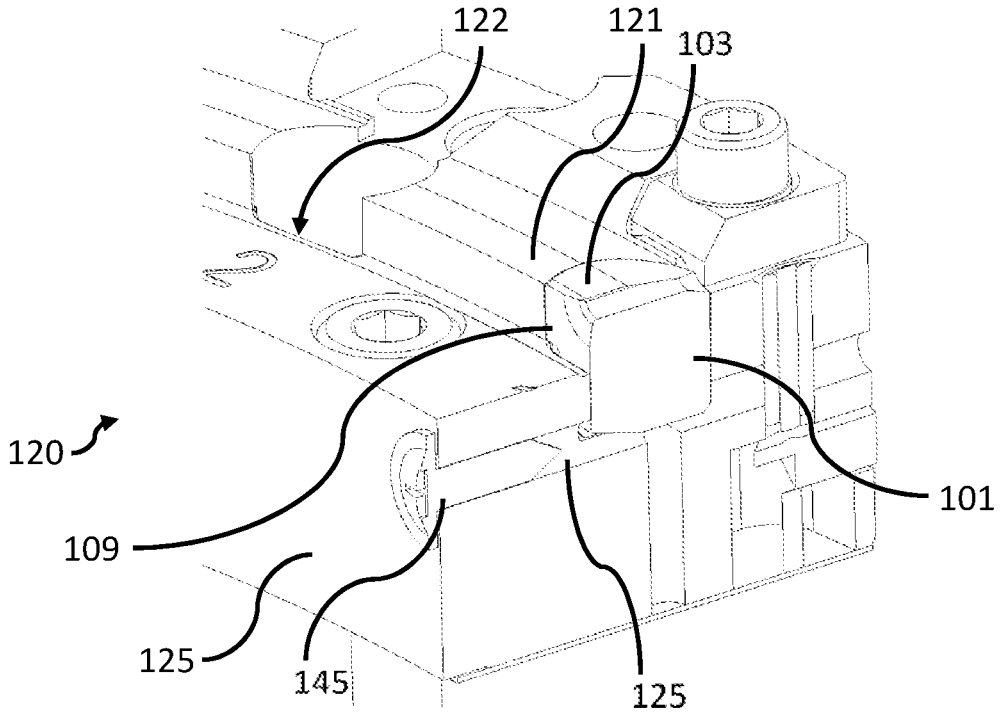
FIG. 34 is a trimetric view of a cross-section of a die holder and a mounted die embodiment.

FIG. 34 is a trimetric view of a section of a die holder 120 with a mounted die 101. The figure illustrates a section of a rings-shaped die holder 120 with a cross-section view of the die holder 120 and a mounted die 101. The top surface 103 of the die 101 and the top surface part 121 of the die holder 120 are plane in respect to each other. A side surface 122 (not visible) of the die holder 120 is furthermore plane in respect to the second portion 109 of the side surface of the die 101, wherein the recess 105 of the die 101 for shaping the head of the elongate body is placed. On the inner side 125 of the die holder 120, an opening 126 is located, the opening 126 extending to the bottom surface 107 of the die 101. In this particular embodiment, a plug 145 has been inserted into the opening 126 of the die holder 120.

Figure 35:
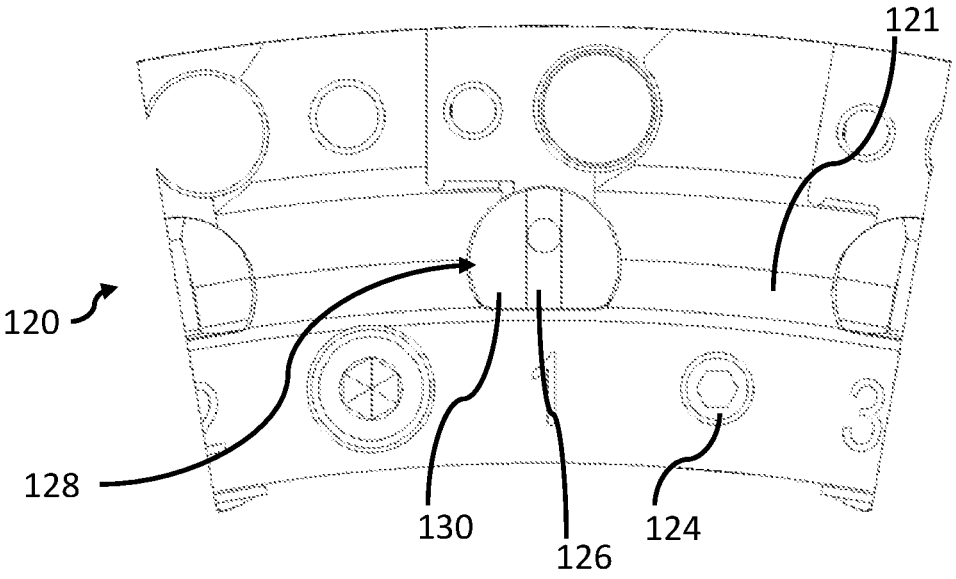
FIG. 35 is a top view of a section of a die holder embodiment.

FIG. 35 is a top view of a section of a ring-shaped die holder 120, according to the subject application. In the middle of the figure, the bore 130 in the top surface 121 of the die holder 120 is located. In the bottom surface 128 of the die holder 120, the opening 126 of die holder 120 is visible. On a third surface 123 of the die holder 120, parallel to the top surface 121, a pin or bolt 124 is seated for mounting the die holder 120 to a machine (not illustrated).

Preferably, the die holder 120 is a monolithic element made of metal, preferably a metal, which is softer than the metal or other material which forms the associated dies to be press fit in the holes or bores 130. The dies are preferably made of a hard material, e.g. a hard metal, to provide a long lifetime. By the press fitting principle, the hard material die is securely fastened in the hole or bore 130, thus providing optimal support of the edge of the hard material die, thereby providing a long life time of the die.

The holes or bores 130 each has an inner surface shaped for receiving a die and for press fit by contact with the side surface of the die. In the hole or bore 130, a stop part is formed so as to allow engagement with a stop surface of the die when the die is being pressed into the hole or bore, so as to fix a height of a top surface of the die in relation to the top surface part of the die holder 120. Further, the die holder 120 has a protrusion or recess serving to engage with a corresponding recess or protrusion of the die, in order to fix angular orientation of the die relative to the die holder, thereby facilitating precise angular orientation of the die during the mounting in the die holder 120, e.g. after replacement of the die.

Figure 36:
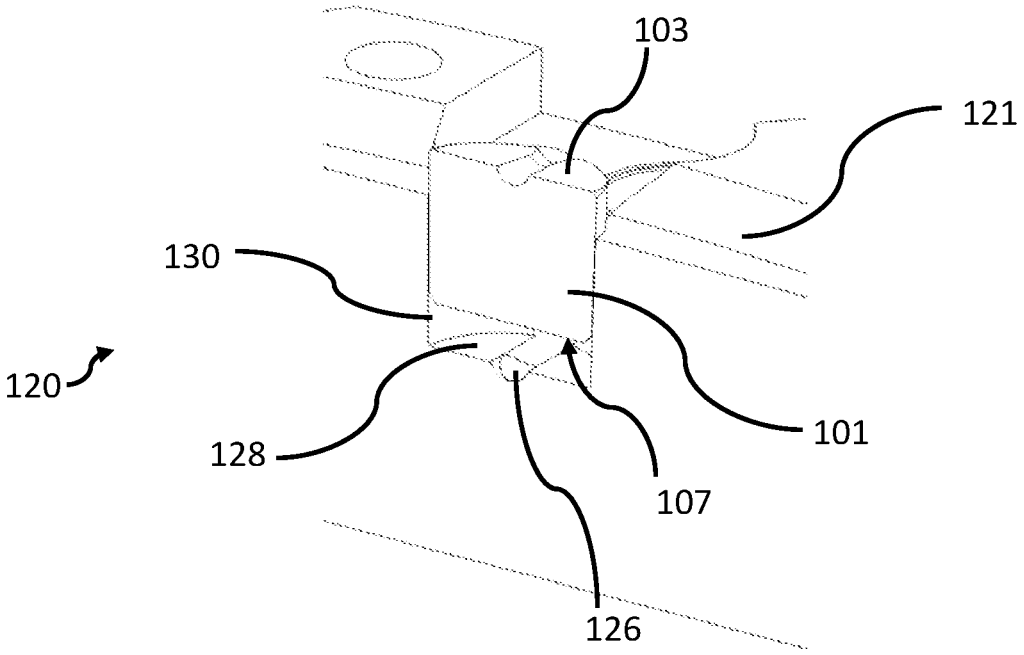
FIG. 36 is a trimetric view of a cross-section of a die holder and an unmounted die embodiment.

FIG. 36 is a trimetric view of a section of a die holder 120 with an unmounted die 101. The figure illustrates a section of a rings-shaped die holder 120 with a cross-section view of the die holder 120 and an unmounted die 101, floating above a bore 130 in the top surface 121 of the die holder 120. The floating die 101 has a bottom surface 107 corresponding to a bottom surface 128 of the die holder 120. The top surface 103 of the die 101 and the surface part 121 of the die holder 120 are plane in respect to each other when the stop or bottom surface 107 of the die 101 is abutting the bottom surface 128 of the die holder 120.

Figure 37:
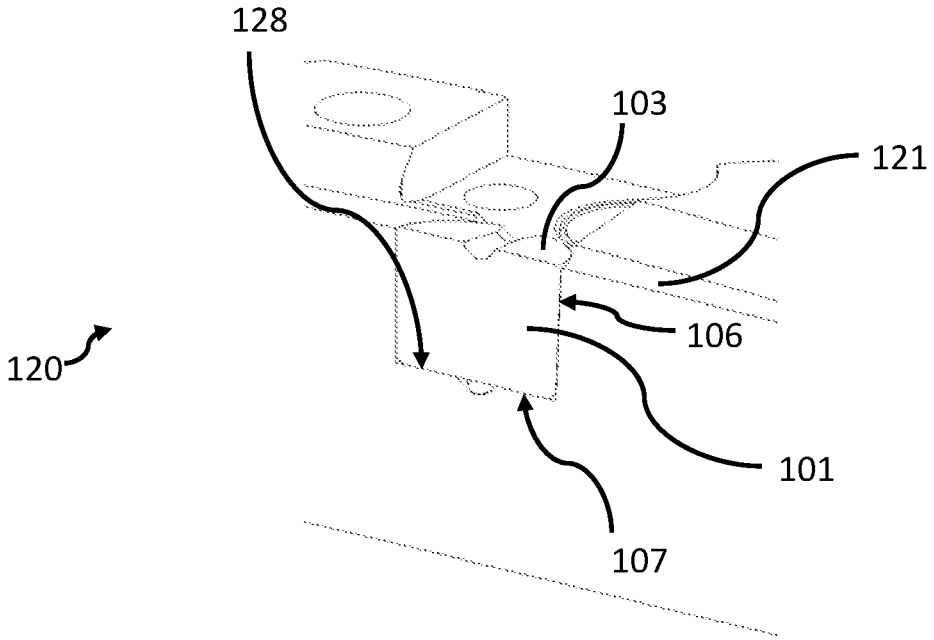
FIG. 37 is a trimetric view of a cross-section of a die holder and amounted die embodiment.

FIG. 37 is a side view of a cross-section of a die holder 120 and die 101, the die 101 mounted into the bore in the die holder 120. The die 101 has a side surface 106 shaped for press fit by contact with a corresponding inner surface of the bore in the die holder 120. The press fit serves to interlock the die 101 within the bore 130 of the die holder 120. When the bottom surface 107 of the die 101 abuts with the bottom surface 128 of the die holder 120, the top surface 103 of the die 101 becomes flush or plane with the top surface 121 of the die holder 120.

Figure 38:
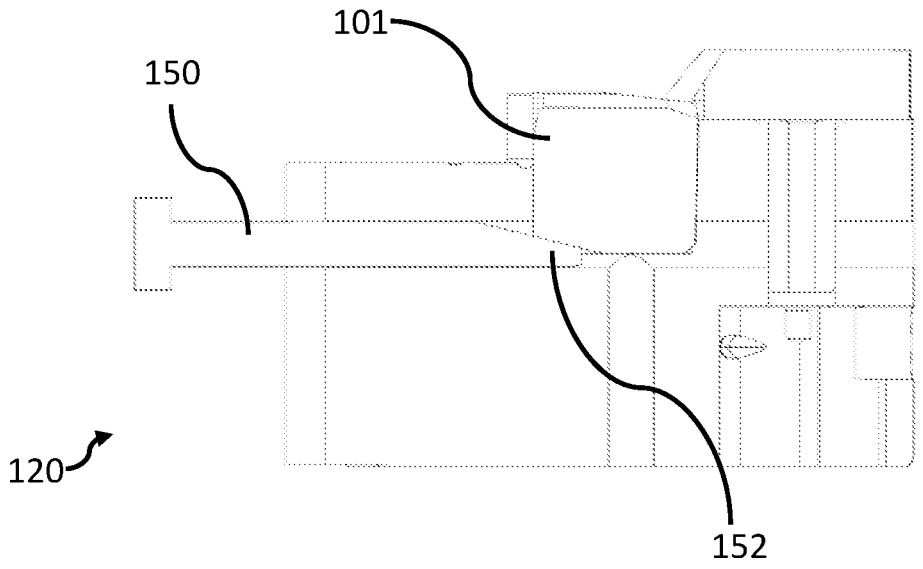
FIG. 38 is a side view of a cross-section of an elongate tool, placed in an opening of a die holder, between the die holder and a die, according to an embodiment.

FIG. 38 is a side view of a cross-section of an elongate tool 50, placed in an opening of a die holder 120, between the die holder 120 and a die 101, according to the subject application. The elongate tool has a tapered tip 152 abutting the bottom surface 107 of the die 101. When the elongate tool 50 is forced towards the die 101, the die 101 is forced away from the die holder 120, releasing the die 101 from the die holder 120 for maintenance of the die holder 120 or die 101.

Figure 39:
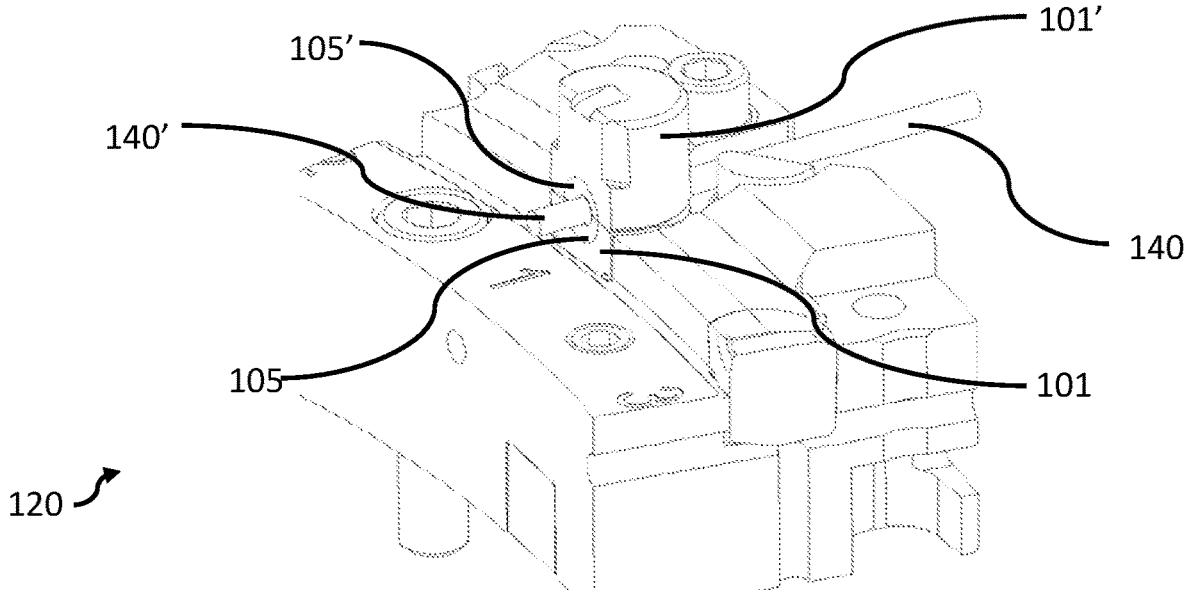
FIG. 39 is a trimetric view of an elongate body fixed between two corresponding dies and a section of a die holder.

FIG. 39 is a trimetric view of an elongate body 140 fixed between two corresponding dies 10101, 101' and a section of a ring-shaped die holder 120. The recesses 105, 105' on each die 101, 101' forms the shape of the head of a nail, when the two dies 10101, 101' are positioned with their corresponding top surfaces facing towards each other and their grooves aligned and the head end 140' of the elongate body 140 is pressed in a longitudinal direction, towards the recesses 105, 105' of the dies 10101, 101'.

Figure 40:
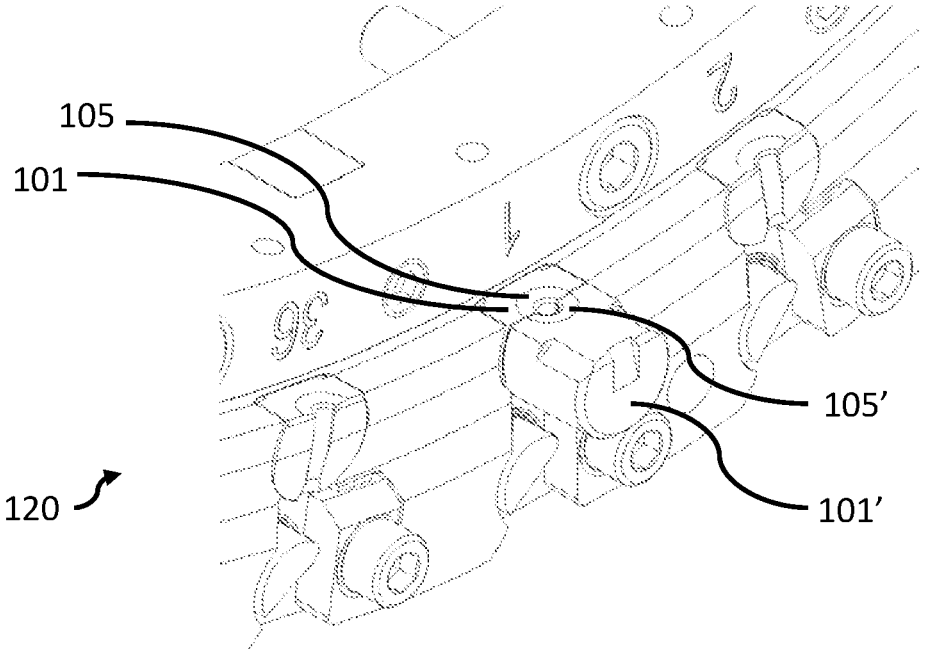
FIG. 40 is trimetric view of a section of a ring-shaped die holder with a mounted die and a corresponding, free-floating die to illustrate cooperation of recesses of two dies for producing a head on a nail.

FIG. 40 is a trimetric view of two corresponding dies 10101, 101' and a section of a ring-shaped die holder 120. In the illustration, one die 101 is mounted in the die holder 120 and the second die 101' is floating, as how it would be mounted in a second die holder (not shown), and wherein the top surfaces of the dies 10101, 101' are abutting each other. The recesses 105, 105' on each die 101, 1' forms the shape of the head of a nail, when the two dies 10101, 101' are positioned with their corresponding top surfaces facing towards each other and their grooves are aligned.

Figure 41:
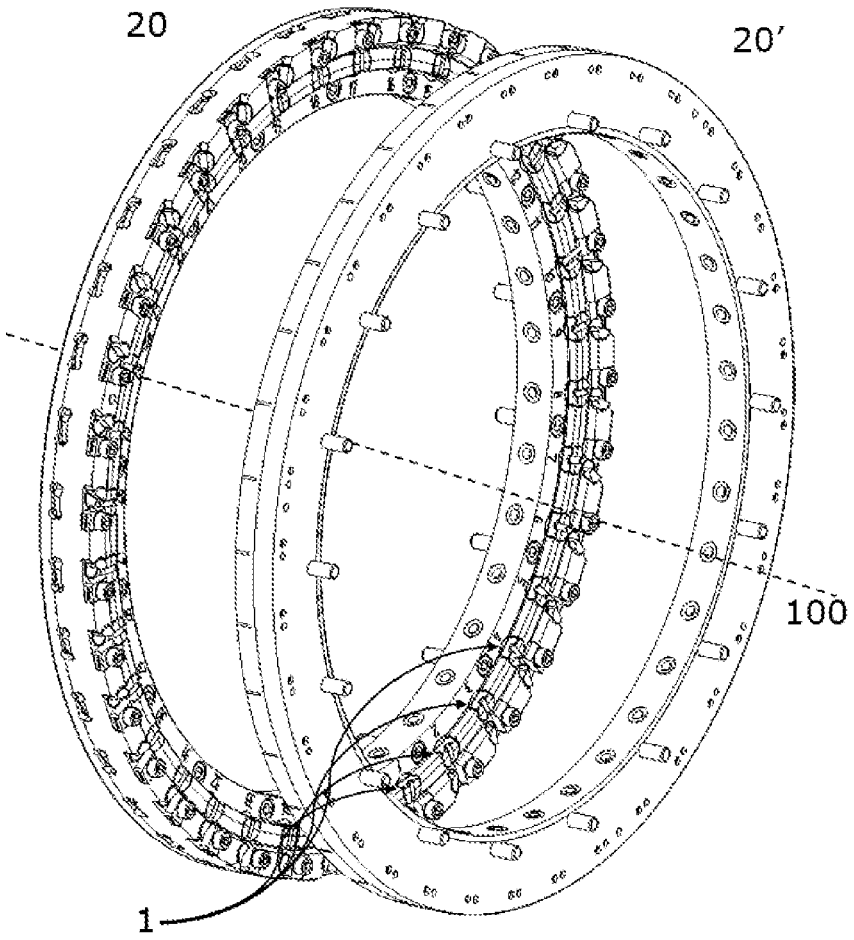
FIG. 41 is a side view of two ring-shaped die holders oriented towards each other, such as for forming part of a nail, in a nail producing machine.

FIG. 41 is a trimetric view of two ring-shaped die holder embodiments 20, 20' oriented towards each other. The ring-shaped die holders 120, 120' have a central axis of rotation 100, about which they are arranged to rotate. A plurality of dies 101 are positioned within the die holders 120, 120' around the circumference. The dies 101 are mounted on each of the die holders 120, 120' are arranged facing towards each other. Especially, one of the die holders 20, the bores or holes for the dies are parallel with the axis of rotation 100, while on the other die holder 120', the bores or holes for the dies are slightly angled. It is to be understood, that the position and angle of the die holders 120, 120' are configured so as to be closer at one point, such as at the bottom portions, than at the top portions, to enable the plurality of dies 101 of a first die holder 120, to abut with corresponding dies of the opposite die holder 120'.

Figure 42:
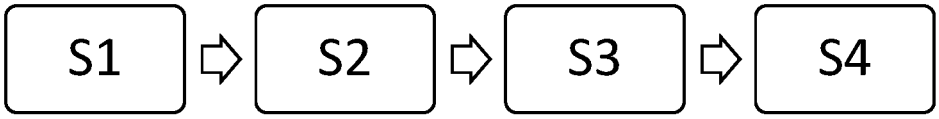
FIG. 42 is a flow-chart of a method according to the subject application.

FIG. 42 is a flow-chart of a method embodiment for manufacturing a head on an elongate body, such as metal nails or screws, the method comprising:

e. providing S1 first and second die holders 120, 120', each of the first and second die holders comprising:
   i. a body having at least a surface part 121,
   ii. a hole or bore 130 in the surface part, wherein the hole or bore has a first inner surface portion 129 with a curved shaped and arranged for receiving the die and for press fit by contact with a first side surface portion 6 of the die,
   iii. a stop part 28 located in the hole or bore for engaging with a bottom surface 107 of the die when being pressed into the hole or bore, so as to fix a height of the top surface 103 of the die in relation to the surface part of the die holder, and iv. a second inner surface portion of the bore or hole engaging with a corresponding second side surface portion of the die, in order to fix angular orientation of the groove 104 of the die relative to the die holder, f. providing S2 first and second dies 101, 101', each of the first and second dies comprising:

vi. a body 102 with a top surface provided with a through-going groove for receiving and holding an elongate body longitudinally in said groove, vii. a recess 105 at one end of the groove suitable for forming the head on the elongate body, viii. a first side surface portion with a curved shape for press fit by contact with a first inner surface portion of a bore or hole in the associated die holder, ix. a stop surface for engaging with a stop part in the hole or bore of the associated die holder, so as to determine a height of the top surface of the die in relation to a surface part of the associated die holder, and x. a second side surface portion serving to engage with the corresponding second inner surface portion of the die holder, in order to fix angular orientation of the groove relative to the die holder, g. bringing S3 the top surface of the first die 101 so near to the top surface of the second die 101' that the grooves of the first and second dies hold the elongate body, and h. providing S4 force onto the elongate body at the recess end of the grooves so as to form a head on the elongate body.

Figure 43A:
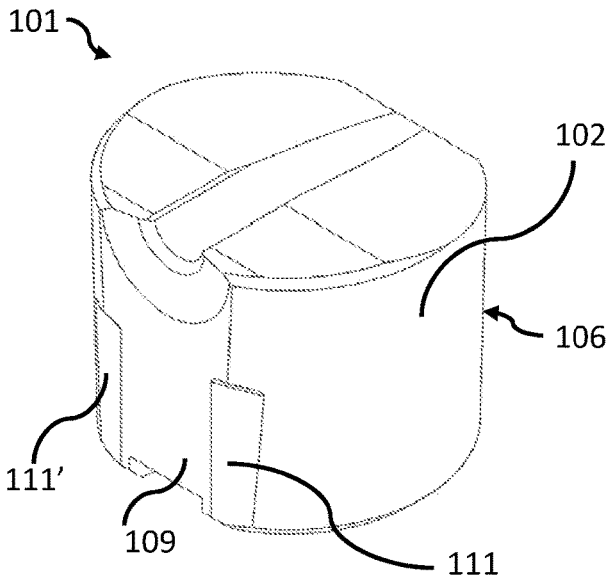
FIG. 43*a* and FIG. 43*b* are trimetric views of alternative die embodiments.
Figure 43B:
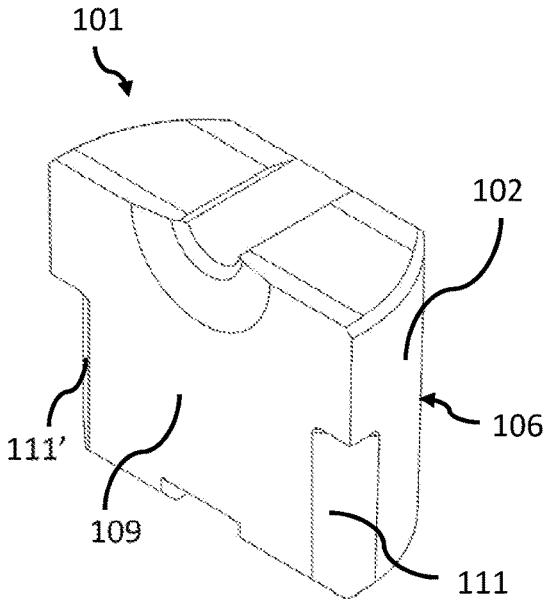

FIG. 43*a* and FIG. 43*b* are trimetric views of alternative die embodiments.

FIG. 43*a* is a trimetric view of a die 101 embodiment. The figure illustrates a die 101 for mounting in an associated die holder (not shown) for the production of heads on elongate bodies, such as a metal nail or screw. The die 101 comprises a body 102 with has a side surface 106 comprising a first, substantially round portion and a second portion 109. The second portion 109 has a large surface area relative to some embodiments of the die 101. The side surface 106 is shaped for press fit by contact with an inner surface of a bore or hole in the associated die holder. The second portion 109 of the side surface 106 is flat for higher durability and furthermore serves to engage with a corresponding flat surface of the associated die holder, in order to fix angular orientation of the die 101, relative to the associated die holder. On the side surface 106 of the body 102 of the die 101, a first chamfered portion 111 and a second chamfered portion 111' is positioned, interconnecting the first portion of the side surface 106 with the second portion 109. In some embodiments of the die 101, the first and second chamfered portions 111, 111' extends from a bottom surface to a top surface of the die 101.

FIG. 43*b* is a trimetric view of a die 101 embodiment. The figure illustrates a die 101 for mounting in an associated die holder (not shown) for the production of heads on elongate bodies, such as a metal nail or screw. The die 101 comprises a body 102 with has a side surface 106 comprising a first, substantially round portion and a second portion 109. The second portion 109 has a small surface area relative to some embodiments of the die 101. The side surface 106 is shaped for press fit by contact with an inner surface of a bore or hole in the associated die holder. The second portion 109 of the side surface 106 is flat for higher durability and furthermore serves to engage with a corresponding flat surface of the associated die holder, in order to fix angular orientation of the die 101, relative to the associated die holder. On the side surface 106 of the body 102 of the die 101, a first chamfered portion 111 and a second chamfered portion 111' is positioned, interconnecting the first portion of the side surface 106 with the second portion 109. In some embodiments of the die 101, the first and second chamfered portions 111, 111' extends from a bottom surface to a top surface of the die 101.

Figure 44A:
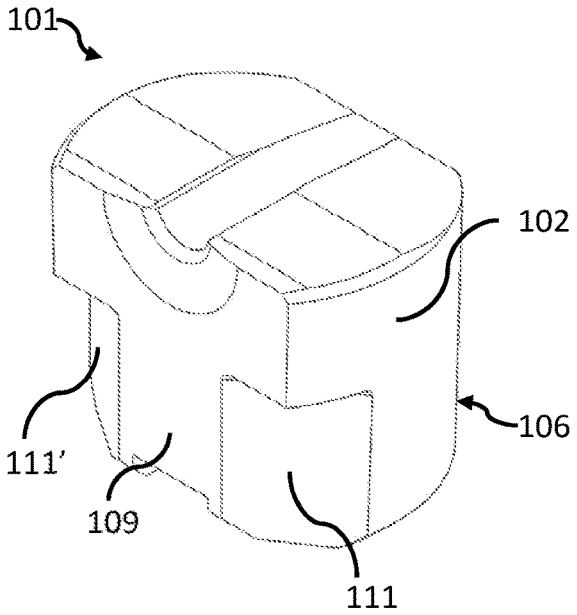
FIG. 44*a* and FIG. 44*b* are trimetric views of other alternative die embodiments.
Figure 44B:
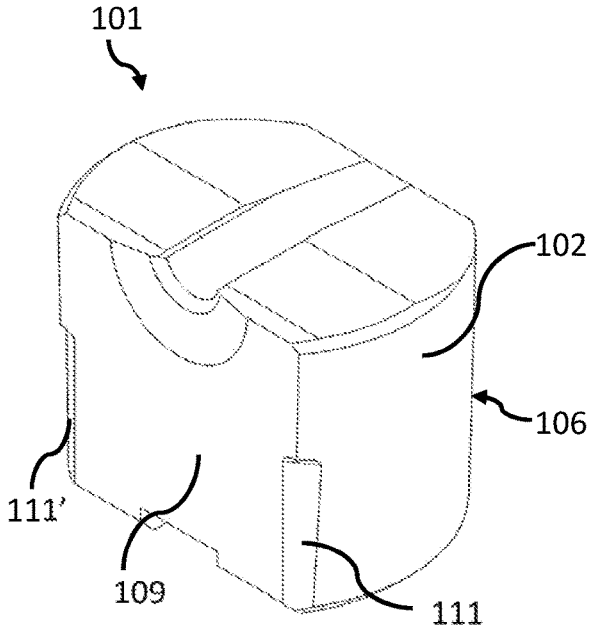

FIG. 44*a* and FIG. 44*b* are trimetric views of other alternative die embodiments.

FIG. 44*a* is a trimetric view of a die 101 embodiment. The figure illustrates a die 101 for mounting in an associated die holder (not shown) for the production of heads on elongate bodies, such as a metal nail or screw. The die 101 comprises a body 102 with has a side surface 106 comprising a first, substantially round portion and a second portion 109. The second portion 109 has a large surface area relative to some embodiments of the die 101. The side surface 106 is shaped for press fit by contact with an inner surface of a bore or hole in the associated die holder. The second portion 109 of the side surface 106 is flat for higher durability and furthermore serves to engage with a corresponding flat surface of the associated die holder, in order to fix angular orientation of the die 101, relative to the associated die holder. On the side surface 106 of the body 102 of the die 101, a first chamfered portion 111 and a second chamfered portion 111' is positioned, interconnecting the first portion of the side surface 106 with the second portion 109. The chamfered portions have a small surface area, relative to some embodiments of the die 101. In some embodiments of the die 101, the first and second chamfered portions 111, 111' extends from a bottom surface to a top surface of the die 101.

FIG. 44*b* is a trimetric view of a die 101 embodiment. The figure illustrates a die 101 for mounting in an associated die holder (not shown) for the production of heads on elongate bodies, such as a metal nail or screw. The die 101 comprises a body 102 with has a side surface 106 comprising a first, substantially round portion and a second portion 109. The side surface 106 is shaped for press fit by contact with an inner surface of a bore or hole in the associated die holder. The second portion 109 of the side surface 106 is flat for higher durability and furthermore serves to engage with a corresponding flat surface of the associated die holder, in order to fix angular orientation of the die 101, relative to the associated die holder. On the side surface 106 of the body 102 of the die 101, a first chamfered portion 111 and a second chamfered portion 111' is positioned, interconnecting the first portion of the side surface 106 with the second portion 109. The chamfered portions have a large surface area, relative to some embodiments of the die 101. In some embodiments of the die 101, the first and second chamfered portions 111, 111' extends from a bottom surface to a top surface of the die 101.

Figure 45A:
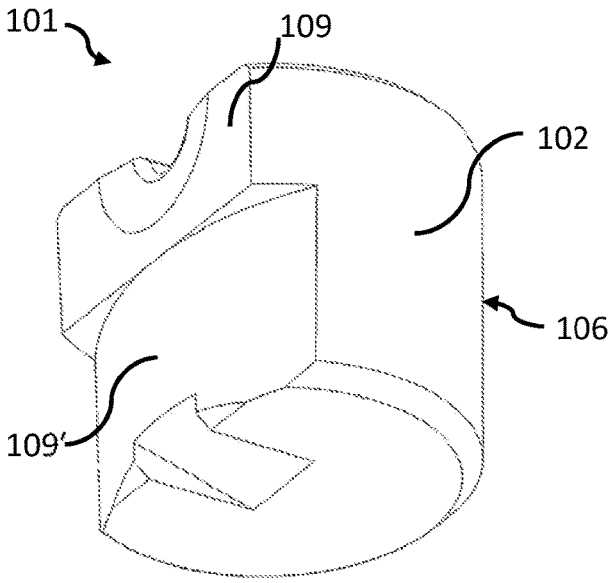
FIG. 45*a* and FIG. 45*b* are trimetric views of yet other alternative die embodiments.
Figure 45B:
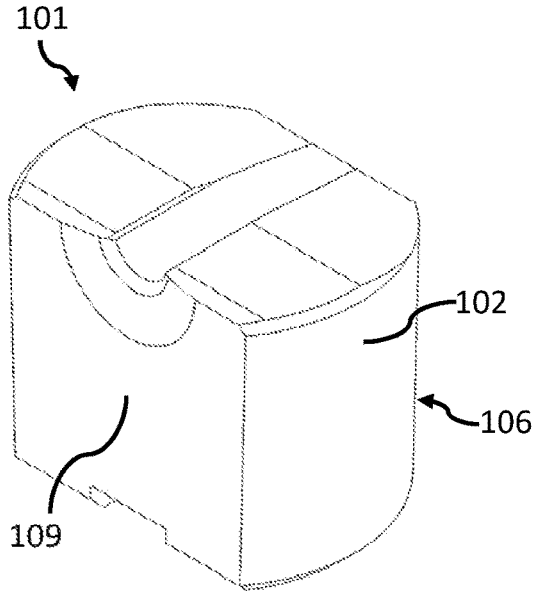

FIG. 45*a* and FIG. 45*b* are trimetric views of yet other alternative die embodiments.

FIG. 45*a* is a trimetric view of a die 101 embodiment. The figure illustrates a die 101 for mounting in an associated die holder (not shown) for the production of heads on elongate bodies, such as a metal nail or screw. The die 101 comprises a body 102 with has a side surface 106 comprising a first, substantially round portion and a second portion 109. The side surface 106 is shaped for press fit by contact with an inner surface of a bore or hole in the associated die holder. The second portion 109 of the side surface 106 is flat for higher durability and furthermore serves to engage with a corresponding flat surface of the associated die holder, in order to fix angular orientation of the die 101, relative to the associated die holder.

FIG. 45*b* is a trimetric view of a die 101 embodiment. The figure illustrates a die 101 for mounting in an associated die holder (not shown) for the production of heads on elongate bodies, such as a metal nail or screw. The die 101 comprises a body 102 with has a side surface 106 comprising a first, substantially round portion, a second portion 109 and a third portion 109'. The side surface 106 is shaped for press fit by contact with an inner surface of a bore or hole in the associated die holder. The second portion 109 of the side surface 106 is flat for higher durability during nail production. The third portion 109' of the side surface 106 is curved and serves to engage with a corresponding curved surface of the associated die holder, in order to fix angular orientation of the die 101, relative to the associated die holder. In some embodiments, the curvature of the side surface 106 and the curvature of the third portion 109' are substantially identical. In this particular embodiment, the curvature of the side surface 106 and the curvature of the third portion 109' are different.

To sum up, the subject application provides a die 101 for mounting in an associated die holder 120 for the production of heads on elongate bodies such as nails or screws. The die has a body 102 with a top surface 103 provided with a through-going groove 104 for receiving and holding an elongate body longitudinally in said groove. Furthermore, the die has a recess 105 on one side merging into the groove 104 at one end of the groove 104 suitable for forming the head of a nail or screw. The die has a side surface portion, e.g. conical, shaped for press fit by contact with a corresponding inner surface portion of a bore or hole 130 in the associated die holder. Further, a second side surface portion (9), e.g. a plane portion, of the die serves to engage with a corresponding inner surface portion of the bore or hole of the die holder. Hereby, it is ensured, that angular orientation of the groove 104 is fixed relative to the die holder 120, and it has been proven that the two different side surface portions of the die, e.g. with a conical portion and a plane portion, provides an efficient press fit which ensures a long lifetime of the die. Further, the die is very simple to mount in the die holder, e.g. by hand, and it is simple to eject by a tool. Thus, altogether a highly efficient nail production can be obtained with such die and die holder system.

Although the subject application has been described in connection with the specified embodiments, it should not be construed as being in any way limited to the presented examples. The scope of the subject application is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the subject application. Furthermore, individual features mentioned in different claims, may possibly be advantageously combined, and the mentioning of these features in different claims does not exclude that a combination of features is not possible and advantageous.

It is claimed:

1. A die for mounting in an associated die holder for the production of heads on elongate bodies, the die comprising: a body with a top surface provided with a through-going groove to receive and hold an elongate body longitudinally in said groove, a recess at one end of the groove configured to form the heads on the elongate bodies, a side surface comprising a first portion with a curved shaped configured for press fit by contact with a cured portion of an inner surface of a bore or hole in the associated die holder, and a stop surface configured to engage a stop part in the hole or bore of the associated die holder, so as to determine a height of the die in relation to the associated die holder, wherein the side surface further comprises a second portion configured to engage with a corresponding portion of the inner surface of the bore or hole in the associated die holder to guide angular orientation of the groove relative to the associated die holder, wherein the first portion of the side surface has a cylindrical shape or a conical shape, wherein the second portion of the side surface comprises a plane portion configured to engage with a corresponding plane portion of the inner surface of the bore or hole in the associated die holder, and wherein said plane portion forms an angle of 0.5-2.0° with a central axis of the die.

2. The die according to claim 1, wherein said second portion of the side surface is further configured for press fit by contact with the corresponding portion of the inner surface of the bore or hole in the associated die holder.

3. The die according to claim 1, wherein an area of the second portion of the side surface is smaller than an area of the first portion of the side surface, wherein the area of the second portion of the side surface is 10-40% of the area of the first portion of the side surface.

4. The die according to claim 1, wherein the side surface has chamfered portions configured to interconnect said first and second portions of the side surface.

5. The die according to claim 1, wherein the die is configured to be placed in at least a portion of the hole or bore.

6. A machine for producing heads on elongated bodies, the machine comprising:

at least one die comprising a body with a top surface provided with a through-going groove to receive and hold an elongate body longitudinally in said groove, a recess at one end of the groove configured to form the heads on the elongate bodies, a side surface comprising a first portion with a curved shaped configured for press fit by contact with a curved portion of an inner surface of a bore or hole in an associated die holder, and a stop surface configured to engage a stop part in the hole or bore of the associated die holder, so as to determine a height of the die in relation to the associated die holder, wherein the side surface further comprises a second portion configured to engage with a corresponding portion of the inner surface of the bore or hole in the associated die holder to guide angular orientation of the groove relative to the associated die holder, and the associated die holder a body having a surface part, and a plurality of holes or bores in the surface part, wherein each of the plurality of holes or bores has a first inner side surface portion with a curved shaped and configured for receiving a die of the at least one die and for press fit engagement with the die by contact with a side surface of the die, wherein each of the holes or bores has a second inner side surface portion are configured to engage with a corresponding side surface portion of the die to fix angular orientation of the die relative to the die holder, and wherein in each of the holes or bores has a stop part configured to fix a height of a top surface of the die in relation to the surface part of the die holder.

7. The machine according to claim 6, further comprising a head forming mechanism configured to apply a force onto the elongate body at the recess end of the groove of the die, when the elongate body is configured to engage the groove of the die, so as to form a head on the elongate body shaped corresponding to the recess of the die.

8. The machine according to claim 6, wherein said first portion of the side surface of the at least one die has a conical shape, wherein the conical shaped portion of the side surface forms a first angle relative to a central axis of the die, and wherein each of the plurality of holes or bores of the die holder has a first inner side surface portion with a conical shape which forms a second angle relative to a central axis of the holes or bores.

9. The machine according to claim 8, wherein the first angle is 0.02°-0.10° larger than the second angle.

10. A method of manufacturing a head on an elongate body, comprising: providing a die comprising a body with a top surface provided with a through-going groove to receive and hold an elongate body longitudinally in said groove, a recess at one end of the groove configured to form the heads on the elongate bodies, a side surface comprising a first portion with a curved shaped configured for press fit by contact with a curved portion of an inner surface of a bore or hole in the associated die holder, and a stop surface configured to engage a stop part in the hole or bore of the associated die holder, so as to determine a height of the die in relation to the associated die holder, wherein the side surface further comprises a second portion configured to engage with a corresponding portion of the inner surface of the bore or hole in the associated die holder to guide angular orientation of the groove relative to the associated die holder, and a ring-shaped die holder comprising a body having a surface part, and a plurality of holes or bores in the surface part, wherein each of the plurality of holes or bores has a first inner side surface portion with a curved shaped and configured for receiving a die and for press fit engagement with the die by contact with a side surface of the die, wherein each of the holes or bores has a second inner side surface portion are configured to engage with a corresponding side surface portion of the die to fix angular orientation of the die relative to the die holder, and wherein in each of the holes or bores has a stop part configured to fix a height of a top surface of the die in relation to the surface part of the die holder.

11. The method according to claim 10, further comprising mounting the die in the hole or bore of the die holder in a tool-less mounting process.

12. The method according to claim 10, further comprising:

providing first and second die holders, each of the first and second die holders comprising:

a body having at least a surface part, a hole or bore in the surface part, wherein the hole or bore has a first inner surface portion with a curved shaped and arranged for receiving the die and for press fit by contact with a first side surface portion of the die, a stop part located in the hole or bore for engaging with a bottom surface of the die when being pressed into the hole or bore, so as to fix a height of the top surface of the die in relation to the surface part of the die holder, and a second inner surface portion of the bore or hole engaging with a corresponding second side surface portion of the die, in order to fix angular orientation of the groove of the die relative to the die holder, providing first and second dies, each of the first and second dies comprising:

a body with a top surface provided with a through-going groove for receiving and holding an elongate body longitudinally in said groove, a recess at one end of the groove suitable for forming the head on the elongate body, a first side surface portion with a curved shape for press fit by contact with a first inner surface portion of a bore or hole in the associated die holder, a stop surface for engaging with a stop part in the hole or bore of the associated die holder, so as to determine a height of the top surface of the die in relation to a surface part of the associated die holder, and a second side surface portion serving to engage with the corresponding second inner surface portion of the die holder, in order to fix angular orientation of the groove relative to the die holder, bringing the top surface of the first die so near to the top surface of the second die that the grooves of the first and second dies hold the elongate body, and providing force onto the elongate body at the recess end of the grooves so as to form a head on the elongate body.

* * * * *